US012735291B2

(12) United States Patent
Kubo et al.

(10) Patent No.: US 12,735,291 B2
(45) Date of Patent: Sep. 15, 2026

(54) SHEET PROCESSING APPARATUS AND IMAGE FORMING SYSTEM

(71) Applicant: CANON FINETECH NISCA INC., Saitama (JP)

(72) Inventors: Mamoru Kubo, Yamanashi (JP); Kakeru Aoki, Yamanashi (JP)

(73) Assignee: Canon Finetech Nisca Inc., Saitama (JP)

( * ) Notice: Subject to any disclaimer, the term of this patent is extended or adjusted under 35 U.S.C. 154(b) by 245 days.

(21) Appl. No.: 18/749,825

(22) Filed: Jun. 21, 2024

(65) Prior Publication Data

US 2025/0002288 A1 Jan. 2, 2025

(30) Foreign Application Priority Data

Jun. 30, 2023 (JP) ..... 2023-108588
May 28, 2024 (JP) ..... 2024-086112

(51) Int. Cl.
*B65H 37/04* (2006.01)
*B65H 31/02* (2006.01)
*B65H 31/38* (2006.01)

(52) U.S. Cl.
CPC ..... *B65H 37/04* (2013.01); *B65H 31/02* (2013.01); *B65H 31/38* (2013.01); *B65H 2301/426* (2013.01); *B65H 2301/5161* (2013.01); *B65H 2404/1441* (2013.01); *B65H 2801/27* (2013.01)

(58) Field of Classification Search
CPC .. B65H 37/04; B65H 31/02; B65H 2301/426; B65H 2301/5161
See application file for complete search history.

(56) References Cited

U.S. PATENT DOCUMENTS

| | | | | |
|---|---|---|---|---|
| 9,676,584 | B2 * | 6/2017 | Takemasa | B65H 31/34 |
| 12,441,577 | B2 * | 10/2025 | Nakajima | B65H 33/08 |
| 12,600,586 | B2 * | 4/2026 | Tokoro | B65H 5/26 |
| 2024/0025679 | A1 | 1/2024 | Kubo | |
| 2024/0025692 | A1 | 1/2024 | Katsumata | |
| 2024/0025693 | A1 | 1/2024 | Kubo | |
| 2024/0158199 | A1 | 5/2024 | Nakajima | |

FOREIGN PATENT DOCUMENTS

JP 2023-020999 A 2/2023

* cited by examiner

*Primary Examiner* — Michael Mccullough
(74) *Attorney, Agent, or Firm* — Venable LLP

(57) ABSTRACT

A sheet processing apparatus performs a binding discharge process and a sorting discharge process. In the sorting discharge process, a second operation is repeatedly performed to form an unbound first sheet bundle on the stacking portion, and a third operation is repeatedly performed to form an unbound second sheet bundle on the stacking portion. In the second operation, a sheet conveyed in a first conveyance direction is nipped by a pair of alignment plates without conveying the sheet in a second conveyance direction, and a shift operation of moving a position of the sheet in a shift direction is performed. Then the sheet is discharged to a shift position on the stacking portion. In the third operation, the sheet is discharged to a position displaced from the shift position on the stacking portion without conveying the sheet in the second conveyance direction.

8 Claims, 32 Drawing Sheets

FIG.17

| No | MOTOR | DRIVEN PART | OPERATION | NORMAL ROTATION DIRECTION | REVERSE ROTATION DIRECTION |
|---|---|---|---|---|---|
| 1 | CONVEYANCE MOTOR MT11(HB) | UPSTREAM (INLET) ROLLER | ROTATION | CONVEYANCE DIRECTION | NO ROTATION |
| 2 | | PRE-PROCESSING ROLLER | ROTATION | CONVEYANCE DIRECTION | NO ROTATION |
| 3 | | REVERSING PADDLE | ROTATION | REVERSING DIRECTION | NO ROTATION |
| 4 | | RETURNING MEMBER (KNURLED) | ROTATION | REVERSING DIRECTION | NO ROTATION |
| 5 | PROCESSING UPPER MOTOR MT12(PM) | REVERSING PADDLE | ASCENT/DESCENT | DESCENT | ASCENT |
| 6 | | TRAILING END DROPPING MEMBER | ASCENT/ DESCENT | DESCENT | ASCENT |
| 7 | | UPPER DISCHARGE ROLLER (NIPPING MEMBER) | ASCENT/ DESCENT | ASCENT | DESCENT |
| 8 | RETURNING LIFTING/ LOWERING MOTOR MT13(PM) | RETURNING MEMBER (KNURLED) | ASCENT/ DESCENT | ASCENT | DESCENT |
| 9 | DISCHARGE ROLLER MOTOR MT14(PM) | UPPER DISCHARGE ROLLER | ROTATION | CONVEYANCE DIRECTION | REVERSING DIRECTION |
| 10 | REVERSING MOTOR MT15(PM) | DISCHARGED SHEET REVERSING PADDLE | ROTATION | CONVEYANCE DIRECTION | NO ROTATION |
| 11 | F-SIDE ALIGNMENT PLATE MOVING MOTOR MT16(PM) | FRONT ALIGNMENT PLATE | LATERAL MOVEMENT | INWARD IN PROCESSING PORTION | OUTWARD IN PROCESSING PORTION |
| 12 | R-SIDE ALIGNMENT PLATE MOVING MOTOR MT17(PM) | REAR ALIGNMENT PLATE | LATERAL MOVEMENT | INWARD IN PROCESSING PORTION | OUTWARD IN PROCESSING PORTION |
| 13 | STP MOVING MOTOR MT18(PM) | STP | LATERAL MOVEMENT | MOVEMENT TO R-SIDE | MOVEMENT TO F-SIDE |
| 14 | STP MOTOR MT19(DC) | STP | CLINCHING | ARM DESCENT (STAPLING) | ARM ASCENT |
| 15 | STACKING TRAY LIFTING/LOWERING MOTOR MT20(DC) | STACKING TRAY | ASCENT/ DESCENT | ASCENT | DESCENT |

SHEET PROCESSING APPARATUS AND IMAGE FORMING SYSTEM

BACKGROUND OF THE INVENTION

Field of the Invention

The present invention relates to a sheet processing apparatus that performs a binding process on sheets, and an image forming system including the sheet processing apparatus.

Description of the Related Art

Japanese Patent Application Laid-Open No. 2023-20999 discloses a configuration of a sheet processing apparatus capable of performing a binding discharge process and a switchbackless shift discharge process. In the binding discharge process, sheets are conveyed to a processing tray, the sheets are switched back on the processing tray, a binding process is performed in a state in which the trailing end of the sheets is abutting against a trailing end regulating portion, and then the sheets are discharged onto a stacking tray. In the switchbackless shift discharge process, the sheets are moved in a shift direction intersecting with a conveyance direction by a pair of alignment plates without switching back the sheets, and thus the sheets are discharged onto the stacking tray.

SUMMARY OF THE INVENTION

In the shift discharge process in which sheets are moved in the shift direction and then discharged, further acceleration is desired. The present invention provides a sheet processing apparatus capable of a quicker shift discharge process, and an image forming system including the sheet processing apparatus.

According to a first aspect of the present invention, a sheet processing apparatus includes a first conveyance portion configured to convey a sheet in a first conveyance direction, a placement portion on which the sheet conveyed by the first conveyance portion is placed, an abutment portion against which an upstream edge in the first conveyance direction of the sheet on the placement portion abuts, a second conveyance portion configured to convey the sheet in a second conveyance direction in which the upstream edge in the first conveyance direction of the sheet on the placement portion moves toward the abutment portion, a pair of alignment plates disposed on two sides of the sheet in a width direction intersecting with the first conveyance direction and configured to align the sheet, abutting against the abutment portion, in the width direction, a driving portion configured to move the pair of alignment plates in the width direction, a processing portion configured to perform a binding process on a sheet bundle constituted by a plurality of sheets aligned in the width direction by the pair of alignment plates, a stacking portion disposed downstream of the placement portion in the first conveyance direction and on which the sheet conveyed in the first conveyance direction by the first conveyance portion is stacked, a pair of discharge rotary members configured to discharge the sheet conveyed in the first conveyance direction by the first conveyance portion onto the stacking portion, and, a moving portion configured to move a position of at least one of the pair of discharge rotary members to a nipping position and a separated position, the nipping position being a position where the pair of discharge rotary members are configured to nip the sheet, the separated position being a position where the pair of discharge rotary members are separated from each other. The sheet processing apparatus is configured to perform a binding discharge process and a sorting discharge process. In the binding discharge process, a first operation is repeatedly performed to align a plurality of sheets at a binding position, the binding process is performed by the processing portion on the plurality of sheets aligned at the binding position, and the plurality of sheets having undergone the binding process are discharged onto the stacking portion by the pair of discharge rotary members. In the first operation, the sheet is conveyed in the first conveyance direction by the first conveyance portion, then the sheet conveyed by the first conveyance portion is conveyed in the second conveyance direction on the placement portion by the second conveyance portion to cause a downstream edge in the second conveyance direction of the sheet to abut against the abutment portion, and the sheet is aligned by the pair of alignment plates at the binding position. In the sorting discharge process, a second operation is repeatedly performed to form an unbound first sheet bundle on the stacking portion, and a third operation is repeatedly performed to form an unbound second sheet bundle on the stacking portion. In the second operation, the sheet is conveyed in the first conveyance direction by the first conveyance portion such that a downstream end of the sheet in the first conveyance direction passes through a gap between the pair of discharge rotary members and an upstream end of the sheet in the first conveyance direction passes the first conveyance portion in a state in which the pair of discharge rotary members are at the separated position, then the sheet is nipped by the pair of alignment plates without conveying the sheet in the second conveyance direction by the second conveyance portion and in a state in which the sheet is moving in the first conveyance direction, a shift operation of moving a position of the sheet in a shift direction is performed by moving the pair of alignment plates nipping the sheet, the shift direction being a direction toward one of the two sides in the width direction, and then the sheet is discharged to a shift position on the stacking portion by the pair of discharge rotary members after the pair of alignment plates are retracted in the width direction from the sheet subjected to the shift operation and the pair of discharge rotary members are moved to the nipping position. In the third operation, the sheet conveyed by the first conveyance portion is discharged by the pair of discharge rotary members to a position displaced upstream from the shift position on the stacking portion in the shift direction without conveying the sheet in the second conveyance direction by the second conveyance portion.

According to a second aspect of the present invention, an image forming system includes an image forming portion configured to form an image on a sheet, a first conveyance portion configured to convey a sheet on which the image has been formed by the image forming portion in a first conveyance direction, a placement portion on which the sheet conveyed by the first conveyance portion is placed, an abutment portion against which an upstream edge in the first conveyance direction of the sheet on the placement portion abuts, a second conveyance portion configured to convey the sheet in a second conveyance direction in which the upstream edge in the first conveyance direction of the sheet on the placement portion moves toward the abutment portion, a pair of alignment plates disposed on two sides of the sheet in a width direction intersecting with the first conveyance direction and configured to align the sheet, abutting against the abutment portion, in the width direction, a driving portion configured to move the pair of alignment plates in the width direction, a processing portion configured to perform a binding process on a sheet bundle constituted by a plurality of sheets aligned in the width direction by the pair of alignment plates, a stacking portion disposed downstream of the placement portion in the first conveyance direction and on which the sheet conveyed in the first conveyance direction by the first conveyance portion is stacked, a pair of discharge rotary members configured to discharge the sheet conveyed in the first conveyance direction by the first conveyance portion onto the stacking portion, a moving portion configured to move a position of at least one of the pair of discharge rotary members to a nipping position and a separated position, the nipping position being a position where the pair of discharge rotary members are configured to nip the sheet, the separated position being a position where the pair of discharge rotary members are separated from each other, and, a control portion. The control portion is configured to perform a binding discharge process and a sorting discharge process. In the binding discharge process, a first operation is repeatedly performed to align a plurality of sheets at a binding position, the binding process is performed by the processing portion on the plurality of sheets aligned at the binding position, and the plurality of sheets having undergone the binding process are discharged onto the stacking portion by the pair of discharge rotary members. In the first operation, the sheet is conveyed in the first conveyance direction by the first conveyance portion, then the sheet conveyed by the first conveyance portion is conveyed in the second conveyance direction on the placement portion by the second conveyance portion to cause a downstream edge in the second conveyance direction of the sheet to abut against the abutment portion, and the sheet is aligned by the pair of alignment plates at the binding position. In the sorting discharge process, a second operation is repeatedly performed to form an unbound first sheet bundle on the stacking portion, and a third operation is repeatedly performed to form an unbound second sheet bundle on the stacking portion. In the second operation, the sheet is conveyed in the first conveyance direction by the first conveyance portion such that a downstream end of the sheet in the first conveyance direction passes through a gap between the pair of discharge rotary members and an upstream end of the sheet in the first conveyance direction passes the first conveyance portion in a state in which the pair of discharge rotary members are at the separated position, then the sheet is nipped by the pair of alignment plates without conveying the sheet in the second conveyance direction by the second conveyance portion and in a state in which the sheet is moving in the first conveyance direction, a shift operation of moving a position of the sheet in a shift direction is performed by moving the pair of alignment plates nipping the sheet, the shift direction being a direction toward one of the two sides in the width direction, and then the sheet is discharged to a shift position on the stacking portion by the pair of discharge rotary members after the pair of alignment plates are retracted in the width direction from the sheet subjected to the shift operation and the pair of discharge rotary members are moved to the nipping position. In the third operation, the sheet conveyed by the first conveyance portion is discharged by the pair of discharge rotary members to a position displaced upstream from the shift position on the stacking portion in the shift direction without conveying the sheet in the second conveyance direction by the second conveyance portion.

According to a third aspect of the present invention, a sheet processing apparatus includes a first conveyance portion configured to convey a sheet in a first conveyance direction, a placement portion on which the sheet conveyed by the first conveyance portion is placed, an abutment portion against which an upstream edge in the first conveyance direction of the sheet on the placement portion abuts, a second conveyance portion configured to convey the sheet in a second conveyance direction in which the upstream edge in the first conveyance direction of the sheet on the placement portion moves toward the abutment portion, a pair of alignment plates disposed on two sides of the sheet in a width direction intersecting with the first conveyance direction and configured to align the sheet abutting against the abutment portion in the width direction, a driving portion configured to move the pair of alignment plates in the width direction, a processing portion configured to perform a binding process on a sheet bundle constituted by a plurality of sheets aligned in the width direction by the pair of alignment plates, a stacking portion disposed downstream of the placement portion in the first conveyance direction and on which the sheet conveyed in the first conveyance direction by the first conveyance portion is stacked, a pair of discharge rotary members configured to discharge the sheet conveyed in the first conveyance direction by the first conveyance portion onto the stacking portion, and, a moving portion configured to move a position of at least one of the pair of discharge rotary members to a nipping position and a separated position, the nipping position being a position where the pair of discharge rotary members are configured to nip the sheet, the separated position being a position where the pair of discharge rotary members are separated from each other. The sheet processing apparatus is configured to perform a binding discharge process and a sorting discharge process. In the binding discharge process, a first operation is repeatedly performed to align a plurality of sheets at a binding position, the binding process is performed by the processing portion on the plurality of sheets aligned at the binding position, and the plurality of sheets having undergone the binding process are discharged onto the stacking portion by the pair of discharge rotary members. In the first operation, the sheet is conveyed in the first conveyance direction by the first conveyance portion, then the sheet conveyed by the first conveyance portion is conveyed in the second conveyance direction on the placement portion by the second conveyance portion to cause a downstream edge in the second conveyance direction of the sheet to abut against the abutment portion, and the sheet is aligned by the pair of alignment plates at the binding position. In the sorting discharge process, a second operation is repeatedly performed to form an unbound first sheet bundle on the stacking portion, and a third operation is repeatedly performed to form on the stacking portion. In the second operation, the sheet is conveyed in the first conveyance direction by the first conveyance portion such that a downstream end of the sheet in the first conveyance direction passes through a gap between the pair of discharge rotary members and an upstream end of the sheet in the first conveyance direction passes the first conveyance portion in a state in which the pair of discharge rotary members are at the separated position, then a shift operation of moving a position of the sheet in a predetermined shift direction is performed by moving one of the pair of alignment plates on one side in the width direction in the predetermined shift direction that is a direction toward another side in the width direction without conveying the sheet in the second conveyance direction by the second conveyance portion and in a state in which the sheet is moving in the first conveyance direction, and after the shift operation, the one alignment plate is retracted in the width direction from the sheet subjected to the shift operation and the pair of discharge rotary members are moved to the nipping position, and then the sheet is discharged to a shift position on the stacking portion by the pair of discharge rotary members. In the third operation, the sheet conveyed by the first conveyance portion is discharged by the pair of discharge rotary members to a position displaced upstream from the shift position on the stacking portion in the predetermined shift direction without conveying the sheet in the second conveyance direction by the second conveyance portion.

According to a fourth aspect of the present invention, an image forming system includes an image forming portion configured to form an image on a sheet, a first conveyance portion configured to convey a sheet on which the image has been formed by the image forming portion in a first conveyance direction, a placement portion on which the sheet conveyed by the first conveyance portion is placed, an abutment portion against which an upstream edge in the first conveyance direction of the sheet on the placement portion abuts, a second conveyance portion configured to convey the sheet in a second conveyance direction in which the upstream edge in the first conveyance direction of the sheet on the placement portion moves toward the abutment portion, a pair of alignment plates disposed on two sides of the sheet in a width direction intersecting with the first conveyance direction and configured to align the sheet abutting against the abutment portion in the width direction, a driving portion configured to move the pair of alignment plates in the width direction, a processing portion configured to perform a binding process on a sheet bundle constituted by a plurality of sheets aligned in the width direction by the pair of alignment plates, a stacking portion disposed downstream of the placement portion in the first conveyance direction and on which the sheet conveyed in the first conveyance direction by the first conveyance portion is stacked, a pair of discharge rotary members configured to discharge the sheet conveyed in the first conveyance direction by the first conveyance portion onto the stacking portion, a moving portion configured to move a position of at least one of the pair of discharge rotary members to a nipping position and a separated position, the nipping position being a position where the pair of discharge rotary members are configured to nip the sheet, the separated position being a position where the pair of discharge rotary members are separated from each other, and, a control portion. The control portion is configured to perform a binding discharge process and a sorting discharge process. In the binding discharge process, a first operation is repeatedly performed to align a plurality of sheets at a binding position, the binding process is performed by the processing portion on the plurality of sheets aligned at the binding position, and the plurality of sheets having undergone the binding process are discharged onto the stacking portion by the pair of discharge rotary members. In the first operation, the sheet is conveyed in the first conveyance direction by the first conveyance portion, then the sheet conveyed by the first conveyance portion is conveyed in the second conveyance direction on the placement portion by the second conveyance portion to cause a downstream edge in the second conveyance direction of the sheet to abut against the abutment portion, and the sheet is aligned by the pair of alignment plates at the binding position. In the sorting discharge process, a second operation is repeatedly performed to form an unbound first sheet bundle on the stacking portion, and a third operation is repeatedly performed to form on the stacking portion. In the second operation, the sheet is conveyed in the first conveyance direction by the first conveyance portion such that a downstream end of the sheet in the first conveyance direction passes through a gap between the pair of discharge rotary members and an upstream end of the sheet in the first conveyance direction passes the first conveyance portion in a state in which the pair of discharge rotary members are at the separated position, then a shift operation of moving a position of the sheet in a predetermined shift direction is performed by moving one of the pair of alignment plates on one side in the width direction in the predetermined shift direction that is a direction toward another side in the width direction without conveying the sheet in the second conveyance direction by the second conveyance portion and in a state in which the sheet is moving in the first conveyance direction, and after the shift operation, the one alignment plate is retracted in the width direction from the sheet subjected to the shift operation and the pair of discharge rotary members are moved to the nipping position, and then the sheet is discharged to a shift position on the stacking portion by the pair of discharge rotary members. In the third operation, the sheet conveyed by the first conveyance portion is discharged by the pair of discharge rotary members to a position displaced upstream from the shift position on the stacking portion in the predetermined shift direction without conveying the sheet in the second conveyance direction by the second conveyance portion.

Further features of the present invention will become apparent from the following description of exemplary embodiments with reference to the attached drawings.

BRIEF DESCRIPTION OF THE DRAWINGS

FIG. 17 is a table illustrating a correspondence relationship between each motor and each component of the sheet processing apparatus according to the first embodiment.

DESCRIPTION OF THE EMBODIMENTS

First Embodiment

A first embodiment will be described with reference to FIGS. 1 to 28B. First, a schematic configuration of an image forming system of the present embodiment will be described with reference to FIG. 1.

Image Forming System

Figure 1:
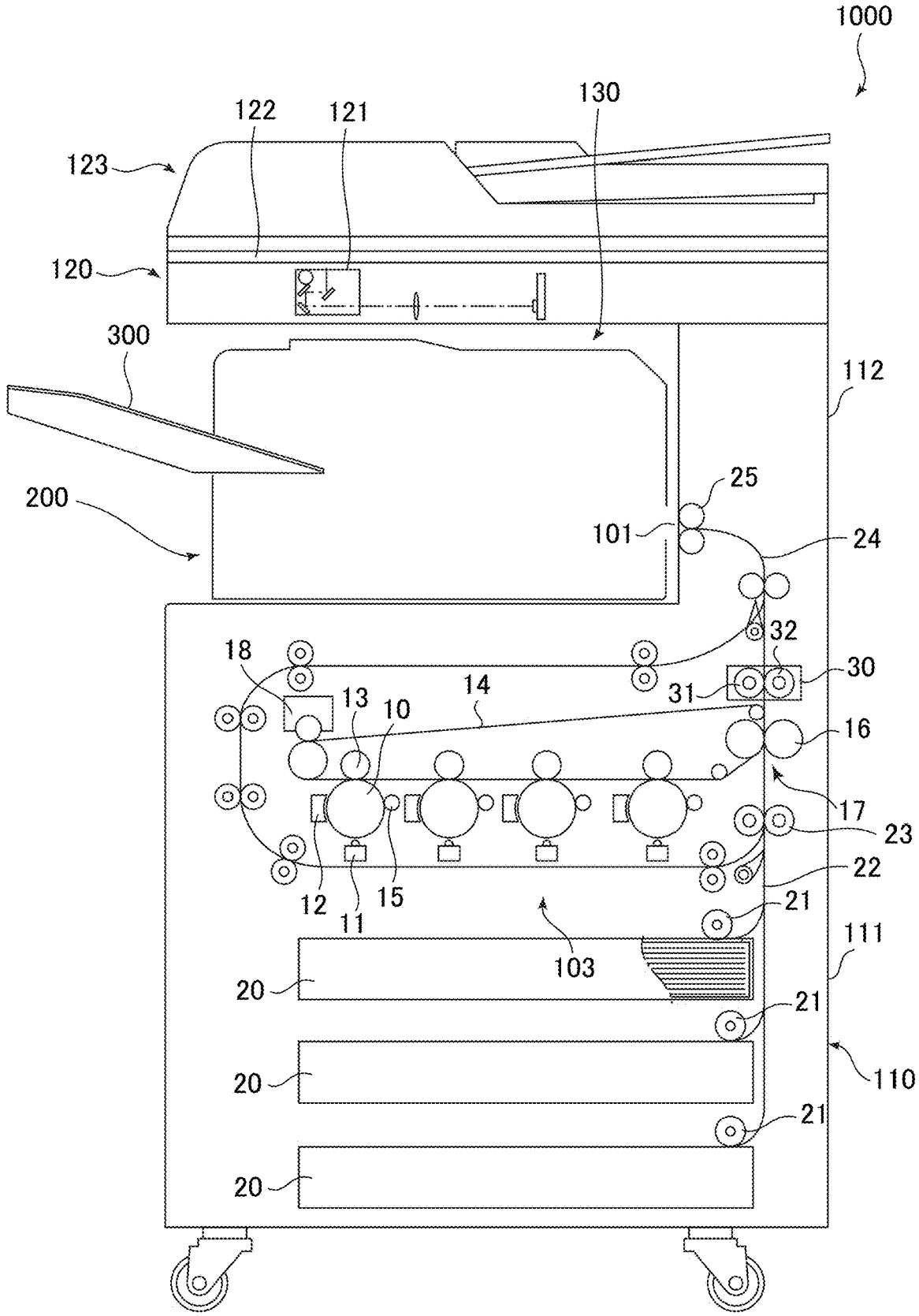
FIG. 1 is a schematic configurational section view of an image forming system according to a first embodiment.

FIG. 1 is a section view illustrating a schematic configuration of the image forming system of the present embodiment. An image forming system 1000 includes an image forming apparatus 100 and a sheet processing apparatus 200. The image forming apparatus 100 is, for example, a copier, a printer, a facsimile machine, or a multifunctional apparatus having functions of these, and forms an image on a sheet such as a paper sheet or a plastic sheet. In the present embodiment, the image forming apparatus 100 is a printer of an electrophotographic system, and a sheet on which a toner image has been formed is discharged through a discharge port 101. To be noted, the image forming apparatus 100 may be an image forming apparatus of an ink jet system.

The image forming apparatus 100 of the present embodiment includes an image forming apparatus body 110, and an image reading apparatus 120 disposed above the image forming apparatus body 110. In the image forming apparatus body 110, a toner image is formed on a sheet in an image forming portion 103. The image forming portion 103 of the present embodiment forms a full-color toner image by using toners of four colors of yellow (y), magenta (m), cyan (c), and black (k). Therefore, the image forming portion 103 includes a plurality of image forming stations that form toner images of respective colors. The image forming stations of respective colors have the same configuration except for the color of the toner.

In the image forming stations of each color, the surface of a photosensitive drum 10 is charged by a charging member 11, and an electrostatic latent image is formed on the surface of the photosensitive drum 10 by exposing the surface by an unillustrated exposing unit. Further, this electrostatic latent image is developed into a toner image by a developing unit 12 by using a developer. The toner image formed on the photosensitive drum 10 is transferred onto an intermediate transfer belt 14 by a primary transfer roller 13 through primary transfer. Transfer residual toner remaining on the photosensitive drum 10 after the primary transfer is removed by a drum cleaner 15.

The cycle of charging, exposure, development, primary transfer, and drum cleaning is similarly repeated in each image forming station, toner images of respective colors of yellow, magenta, cyan, and black are sequentially transferred onto the intermediate transfer belt 14 so as to be superimposed on each other, and thus a full-color toner image is formed.

Meanwhile, the image forming apparatus 100 includes a plurality of cassettes 20 each accommodating sheets. A sheet accommodated in each cassette 20 is conveyed to a sheet conveyance path 22 by rotation of a feeding roller 21, and reaches registration rollers 23. The registration rollers 23 feed the sheet to a secondary transfer portion 17 formed by the intermediate transfer belt 14 and a secondary transfer roller 16 at a timing matching the timing of the toner image on the intermediate transfer belt 14. The multi-color toner image formed on the intermediate transfer belt 14 is collectively transferred onto the sheet through secondary transfer at the secondary transfer portion 17. Transfer residual toner, paper dust, and the like remaining on the intermediate transfer belt 14 after the secondary transfer are removed by a belt cleaner 18.

The sheet having passed the secondary transfer portion 17 is conveyed to the fixing unit 30 serving as an image heating apparatus. The fixing unit 30 includes a heating roller 31 and a pressurizing roller 32, and forms a heating nip portion where the sheet is nipped and conveyed between the heating roller 31 and the pressurizing roller 32. The sheet conveyed to the fixing unit 30 is heated and pressurized in the heating nip portion, and thus the unfixed toner image is fixed to the sheet. The sheet to which the toner image is fixed is conveyed through a discharge conveyance path 24, and is discharged to the outside of the apparatus by discharge rollers 25 through the discharge port 101, and thus the series of image forming operations is finished.

As described above, the image forming apparatus 100 of the present embodiment includes the image forming apparatus body 110 and the image reading apparatus 120. The image reading apparatus 120 reads an image on a document placed on a platen glass 122 by the image reading portion 121, and transmits a read image signal to the image forming apparatus body 110. In addition, an auto document feeder (ADF) 123 that conveys the document to the image reading portion 121 is disposed above the image reading apparatus 120. The image reading apparatus 120 is also capable of reading an image on a document fed by the ADF 123.

The image forming apparatus body 110 includes a first casing portion 111 in which the image forming portion 103 and the like are disposed, and a second casing portion 112 in which the discharge conveyance path 24 and the discharge rollers 25 are disposed, and the second casing portion 112 is disposed above the first casing portion 111. The image reading apparatus 120 is provided above the second casing portion 112. In addition, the second casing portion 112 is provided with an unillustrated operation panel such that an instruction from a user (such as printing conditions and mode settings) for the image forming apparatus 100 and the sheet processing apparatus 200 can be input.

In the present embodiment, according to this configuration, an in-body space 130 surrounded by the first casing portion 111, the second casing portion 112, and the image reading apparatus 120 is provided. Further, in this configuration, the sheet is discharged to the in-body space 130 through the discharge port 101 of the image forming apparatus body 110. In addition, the sheet processing apparatus 200 and the like are attachable to and detachable from this in-body space 130. Although the image forming system 1000 is constituted by attaching the sheet processing apparatus 200 in the present embodiment, an apparatus that performs different sheet processing may be attached.

The sheet processing apparatus 200 is connected to the discharge port 101, and receives the sheet discharged through the discharge port 101. Further, as will be described in detail later, the sheet processing apparatus 200 is capable of performing predetermined processing such as a binding process on this sheet.

Sheet Processing Apparatus

The configuration of the sheet processing apparatus 200 of the present embodiment will be described with reference to FIGS. 2 to 16. First, an overall configuration of the sheet processing apparatus 200 will be described with reference to FIGS. 2 and 3. In the description below, the front (F) side is one side (front side of FIG. 2 and front-right side of FIG. 3) in the sheet width direction orthogonal to the sheet conveyance direction on which an operator operates the image forming system 1000, and for example, a side on which an operation panel is provided. In addition, the rear (R) side is an opposite side to the front side, and is the other side (rear side of FIG. 2 and rear-left side of FIG. 3) in the sheet width direction.

Overall Configuration of Sheet Processing Apparatus

The sheet processing apparatus 200 includes a conveyance path 210A, pre-processing rollers 211A and 212A serving as a first conveyance portion, a processing tray 220 serving as a placement portion, an upper discharge roller (nipping member) 230A and a lower discharge roller 230B serving as a pair of discharge rotary members (discharge portion), a reversing paddle (rake-in paddle) 240A serving as a second conveyance portion, a trailing end dropping member 250A serving as a sheet dropping portion, an alignment portion 270A serving as first and second shifting portions, a returning member 280, a trailing end regulating member 290 serving as an abutment portion, a stacking tray 300 serving as a stacking portion, a discharged sheet reversing paddle (sheet pressing paddle) 320A serving as a rake-in portion, and the like. The sheet received from the image forming apparatus 100 is conveyed to the conveyance path 210A.

The sheet conveyed from the conveyance path 210A is directly discharged onto the stacking tray 300 or placed on the processing tray 220, in accordance with the sheet processing mode. To be noted, directly discharging onto the stacking tray 300 means discharging the sheet onto the stacking tray 300 without conveying the sheet in a reverse direction on the processing tray 220 to a position where a stapling process (binding process) is executable. In other words, the sheet processing apparatus 200 has a mode for discharging the sheet subjected to the stapling process by the stapling unit 400 onto the stacking tray 300 and a mode for discharging the sheet onto the stacking tray 300 without performing the stapling process by the stapling unit 400. In the present embodiment, alignment of sheets is enabled by a pair of alignment plates 271A and 271B of the alignment portion 270A without placement on the processing tray 220. In addition, alignment of sheets is also possible on the processing tray 220, and stapling can be performed on the sheets placed on the processing tray 220 by the stapling unit 400. In addition, a sheet or a sheet bundle placed on the processing tray 220 can be discharged onto the stacking tray 300 by the upper discharge roller 230A and the lower discharge roller 230B serving as a pair of discharge rotary members, and the like. Detailed description of the configuration of each component will be given below Conveyance Path The conveyance path 210A is a path for conveying the sheet in a first conveyance direction (predetermined direction), and includes an upper guide 2101 that guides the upper surface of the conveyed sheet, and a lower guide 2102 that guides the lower surface of the sheet. In the conveyance path 210A, the pre-processing rollers 211A and 212A serving as a first conveyance portion (pair of conveyance rotary members), and upstream rollers (inlet rollers) 213*a* and 213*b* are disposed. These pairs are disposed so as to be separated in a width direction of the sheet (arrow γ direction of FIG. 3) intersecting with the conveyance direction of the sheet (first conveyance direction, arrow β direction (left-right direction) of FIG. 2).

The pre-processing rollers 211A and 212A are a first conveyance portion and a pair of conveyance rotary members that convey the sheet, and at least one thereof rotates while nipping the sheet. At least one of the upstream rollers 213*a* and 213*b* rotates while nipping the sheet. The upstream rollers 213*a* and 213*b* are disposed at an entrance of the sheet processing apparatus 200, receive the sheet conveyed from the upstream side of the sheet processing apparatus 200, and conveys the received sheet to the conveyance path 210A. Then, the sheet having passed the conveyance path 210A reaches the pre-processing rollers 211A and 212A.

The pre-processing rollers 211A and 212A form a pre-processing nip portion 211*a* capable of nipping and conveying the sheet. Then, the sheet is nipped and conveyed in the first conveyance direction in the pre-processing nip portion 211*a*, and is discharged from the conveyance path 210A. The pre-processing rollers 211A and 212A are capable of coming into contact with or out of contact from each other, or the nip pressure thereof can be changed.

Processing Tray

The processing tray 220 serving as a placement portion is disposed downstream of the conveyance path 210A in the sheet conveyance direction (first conveyance direction) and below the conveyance path 210A in the vertical direction. In addition, the processing tray 220 is inclined with respect to the horizontal surface such that the upstream side thereof in the first conveyance direction is lower than the downstream side thereof. On the processing tray 220, the sheet conveyed downstream in the first conveyance direction by the pre-processing rollers 211A and 212A is temporarily placed. In addition, a plurality of sheets can be stacked and supported on the processing tray 220, and alignment in the width direction and movement in the width direction of the sheets (shift of the sheets) are performed by the alignment portion 270A on the processing tray 220. To be noted, the "shifting" of the present embodiment means, regarding a sheet conveyed by the pre-processing rollers 211A and 212A on the basis of the center of the sheet, moving the sheet to the front side and/or the rear side, and in a shift discharge process that will be described later, includes a pattern in which the sheet is discharged while moving the sheet to the front side and then another sheet is discharged to the rear side and a pattern in which the sheet is discharged on the basis of the center and then another sheet is discharged while moving the other sheet to the front side or the rear side. In addition, discharging a next sheet while displacing the next sheet to the front side or the rear side with respect to an already-discharge sheet will be also referred to as shift discharge. In addition, a trailing end regulating member 290 serving as an abutment portion against which the upstream edge in the first conveyance direction of the sheet placed on the processing tray 220 (a trailing end of the sheet) is caused to abut is disposed at an upstream end of the processing tray 220 in the first conveyance direction. To be noted, part (for example, a downstream end portion in the first conveyance direction) of the processing tray 220 may project upward in the vertical direction more than the conveyance path 210A.

In addition, the stapling unit 400 serving as a processing portion is disposed upstream of the processing tray 220 in the first conveyance direction. The stapling unit 400 performs the stapling process (binding process) serving as a predetermined process on a sheet bundle subjected to alignment in the width direction and regulation of the trailing end on the processing tray 220. The stapling unit 400 is capable of changing the stapling position on the sheet bundle, and moves in accordance with the stapling position. To be noted, the predetermined process may be a process different from stapling such as punching. The sheet or sheet bundle placed on the processing tray 220 is discharged onto the stacking tray 300 by the upper discharge roller 230A and the lower discharge roller 230B as will be described later.

Reversing Paddle

The reversing paddle 240A serving as a second conveyance portion conveys the sheet on the processing tray 220 in a second conveyance direction in which the upstream edge in the first conveyance direction of the sheet on the processing tray 220 moves toward the trailing end regulating member 290 (switchback conveyance). The reversing paddle 240A includes a paddle portion 2401 serving as a rotary member, a paddle arm 2402 serving as a support portion that supports the paddle portion 2401, and a swing fulcrum 2403 that swingably supports the paddle arm 2402. That is, the paddle arm 2402 is capable of swinging in the up-down direction about the swing fulcrum 2403, and the paddle portion 2401 is rotatably provided at a distal end of the paddle arm 2402.

Figure 3:
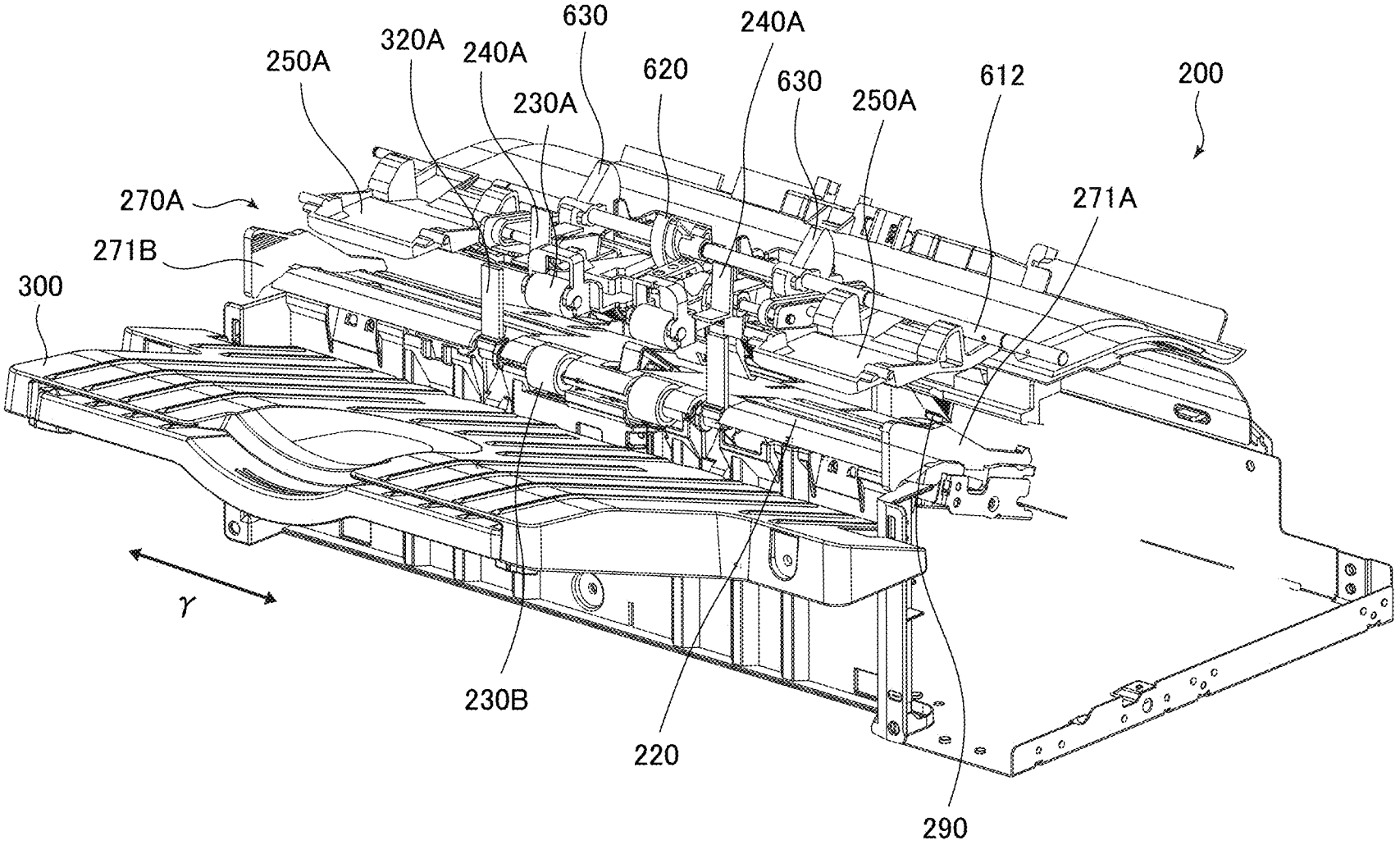
FIG. 3 is a schematic configurational perspective view of the sheet processing apparatus according to the first embodiment in a state in which a top cover is detached.

The reversing paddle 240A configured in this manner is capable of swinging about the swing fulcrum 2403, between a returning position where the paddle portion 2401 abuts against the upper surface of the sheet on the processing tray 220 and is capable of conveying the sheet in the second conveyance direction and an upper retracted position where the paddle portion 2401 is retracted upward from the returning position. The swing fulcrum 2403 is disposed at a position upstream of the pre-processing nip portion 211*a* serving as a nip position where the pre-processing rollers 211A and 212A nip the sheet in the first conveyance direction and above the pre-processing nip portion 211*a* in the vertical direction. Further, the paddle arm 2402 is provided to extend downstream in the first conveyance direction from the swing fulcrum 2403, and the paddle portion 2401 is provided at a distal end portion thereof. In addition, the reversing paddle 240A is provided as a pair on respective sides of the upper discharge roller 230A, which will be described later, in the width direction as illustrated in FIG. 3.

Trailing End Dropping Member

The trailing end dropping member 250A serving as a sheet dropping portion is provided as a pair on respective sides of the pair of reversing paddles 240A. That is, the pair of trailing end dropping members 250A are disposed on respective sides of the reversing paddles 240A in the width direction, moves in the up-down direction in an interlocked manner with the reversing paddles 240A as will be described later, and thus abut against the upper surface of the upstream side of the sheet in the first conveyance direction to operate to drop the upstream end portion (trailing end portion) of the sheet toward the processing tray 220. To be noted, the trailing end dropping members 250A may be configured to operate by being driven by a different driving system than the reversing paddles 240A.

The trailing end dropping members 250A configured in this manner include a pivot shaft 2501 serving as a pivot center at a position downstream of the pre-processing rollers 211A and 212A serving as a pair of conveyance rollers in the first conveyance direction, are provided to extend upstream in the first conveyance direction from the pivot shaft 2501, and are capable of pivoting between an upper position above the pre-processing rollers 211A and 212A and a lower position below the pre-processing rollers 211A and 212A about the pivot shaft 2501. The trailing end dropping members 250A pivot from the upper position to the lower position, and thus abut, from above, the sheet conveyed by the pre-processing rollers 211A and 212A to drop the sheet onto the processing tray 220 below. That is, the trailing end dropping members 250A move from a position above the sheet conveyed in the first conveyance direction by the pre-processing rollers 211A and 212A to a position below the sheet in the vertical direction, and thus drop an upstream end portion in the first conveyance direction (trailing end portion) of the sheet conveyed in the first conveyance direction by the pre-processing rollers 211A and 212A toward the processing tray 220.

Returning Member

The returning member 280 conveys the sheet conveyed toward the trailing end regulating member 290 by the reversing paddles 240A as described above further toward the trailing end regulating member 290, and causes the trailing end of the sheet to abut against the trailing end regulating member 290 to regulate the trailing end position of the sheet. The returning member 280 configured in this manner is constituted by a knurled belt 281, and by rotationally driving the knurled belt 281, the sheet conveyed upstream in the first conveyance direction by the reversing paddles 240A is further raked in, and thus the trailing end is caused to abut against the trailing end regulating member 290. The returning member 280 is capable of moving between an abutting position where the returning member 280 is capable of abutting against the sheet and a retracted position where the returning member 280 is retracted upward from the abutting position, and moves to the abutting position in the case of conveying the sheet toward the trailing end regulating member 290 and to the retracted position in the case of conveying the sheet on the processing tray 220 toward the stacking tray 300, respectively.

Discharge Roller

The upper discharge roller (upper discharge rotary member) 230A and the lower discharge roller (lower discharge rotary member) 230B constitute a pair of discharge rotary members and a discharge portion, and convey the sheet conveyed downstream in the first conveyance direction by the pre-processing rollers 211A and 212A to the downstream side of the processing tray 220 in the first conveyance direction to discharge the sheet. At least one (discharge rotary member) of the upper discharge roller 230A and the lower discharge roller 230B is capable of moving between a nipping position where the sheet is nipped between the upper discharge roller 230A and the lower discharge roller 230B and a separated position where the upper discharge roller 230A and the lower discharge roller 230B are more separated from each other than at the nipping position. In the present embodiment, the upper discharge roller 230A serving as the one discharge rotary member is movable to the nipping position where the sheet is nipped between the upper discharge roller 230A and the lower discharge roller 230B and the separated position where the upper discharge roller 230A and the lower discharge roller 230B are more separated from each other than at the nipping position. That is, the upper discharge roller 230A functions as a nipping member that nips the sheet with the lower discharge roller 230B at the nipping position. Two of each of the upper discharge roller 230A and the lower discharge roller 230B are provided at an interval in the width direction of the sheet. In the present embodiment, these are disposed on the inside of the pair of reversing paddles 240A in the width direction. To be noted, the lower discharge roller 230B may move in the up-down direction between the nipping position and the separated position, or each of the discharge rollers 230A and 230B may move from the nipping position to the separated position.

The upper discharge rollers 230A and the lower discharge rollers 230B nip the sheet or sheet bundle at the nipping position, and convey the nipped sheet or sheet bundle by, for example, rotation of the lower discharge rollers 230B. To be noted, the upper discharge rollers 230A are driven rollers that rotate in accordance with the rotation of the lower discharge rollers 230B, but may be configured to be driven. That is, in the present embodiment, the upper discharge rollers 230A are configured as driven rotary members, and the lower discharge rollers 230B are configured as driving rotary members. In addition, although the upper discharge rollers 230A function as nipping members capable of nipping the sheet with the lower discharge rollers 230B at the nipping position, these nipping members may be different rotary members such as belts instead of rollers, and may be abutting members against which abut the sheet without rotating such as lever members.

In addition, the lower discharge rollers 230B may be rotary members such as belts other than rollers. In the case where the lower discharge rollers 230B serving as lower discharge rotary members are replaced by an endless belt, for example, this belt is stretched by a plurality of rollers, and the outer circumferential surface of the belt stretched by one of the plurality of rollers forms a discharge nip portion 230*a* (see FIG. 13B that will be described later) by abutting against a nipping member such as the upper discharge rollers 230A. In this case, the rotation shaft of the lower discharge rotary member is the rotation shaft of the roller stretching the belt at the position where the discharge nip portion 230*a* is formed.

The upper discharge rollers 230A are capable of pivoting between the nipping position and the separated position about the pivot shaft 2301. In other words, the upper discharge rollers 230A are capable of moving up and down between the nipping position and the separated position. As will be described in detail later, there are two separated positions, and the upper discharge rollers 230A are movable to a first separated position and a second separated position. The upper discharge rollers 230A are provided at a distal end of a discharge arm 2302 serving as a support portion. The pivot shaft 2301 is coaxially provided with the swing fulcrum 2403 described above, and is provided at a position upstream of the pre-processing nip portion 211*a* where the pre-processing rollers 211A and 212A nip the sheet in the first conveyance direction and above the pre-processing nip portion 211*a* in the vertical direction. Further, the discharge arm 2302 is provided to extend downstream in the first conveyance direction from the pivot shaft 2301, and the upper discharge rollers 230A are provided at the distal end portion thereof. The pivot shaft 2301 does not have to be coaxially provided with the swing fulcrum 2403, but in the present embodiment, the pivot shafts of the upper discharge rollers 230A and the reversing paddles 240A are configured to be coaxial.

The pivot shaft 2301 is disposed upstream of the discharge nip portion where the sheet is nipped between the upper discharge rollers 230A and the lower discharge rollers 230B in the nipping position in the first conveyance direction. In addition, at the separated position, the upper discharge rollers 230A are positioned above the pre-processing nip portion 211*a* where the sheet is nipped between the pre-processing rollers 211A and 212A in the vertical direction, and the pivot shaft 2301 is positioned above the center of the upper discharge rollers 230A at the separated position in the vertical direction.

In the state of being at the separated position, the upper discharge rollers 230A allow the sheet having passed the pre-processing nip portion 211*a* to move toward the stacking tray 300 because the positional relationship thereof with the pivot shaft 2301 and the pre-processing nip portion 211*a* is defined as described above. Meanwhile, the upper discharge rollers 230A move downward from the separated position to the nipping position by pivoting about the pivot shaft 2301 in a counterclockwise direction of FIG. 2. Then, as a result of the upper discharge rollers 230A moving to the nipping position, the sheet can be nipped between the upper discharge rollers 230A and the lower discharge rollers 230B.

First Separated Position and Second Separated Position

Figure 4:
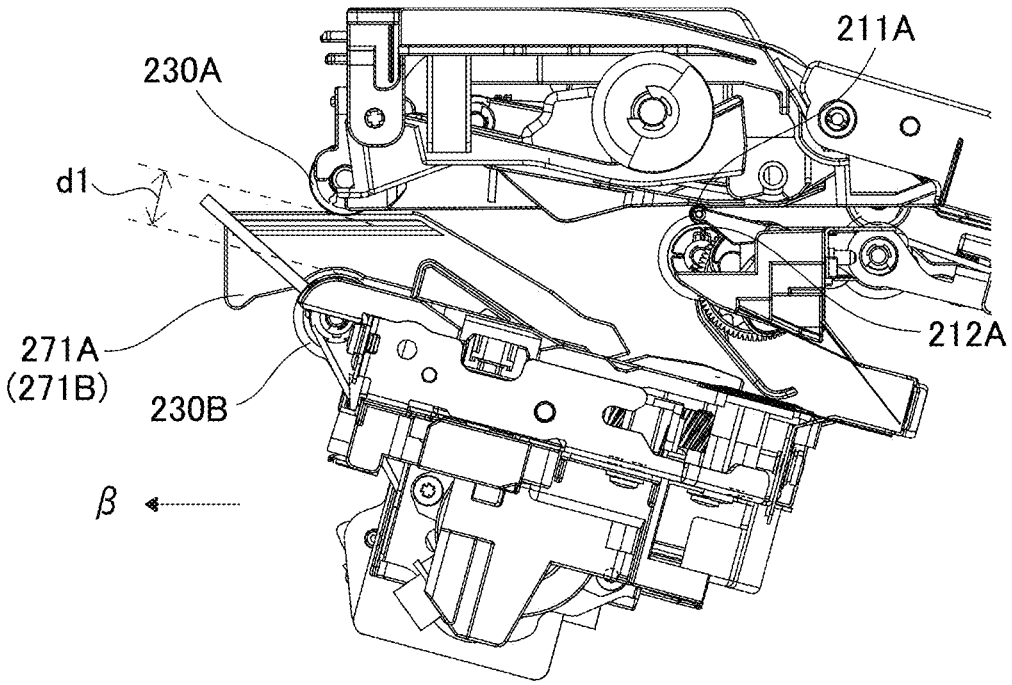
FIG. 4 is a side view of an upper discharge roller and a lower discharge roller according to the first embodiment at a first separated position.
Figure 5:
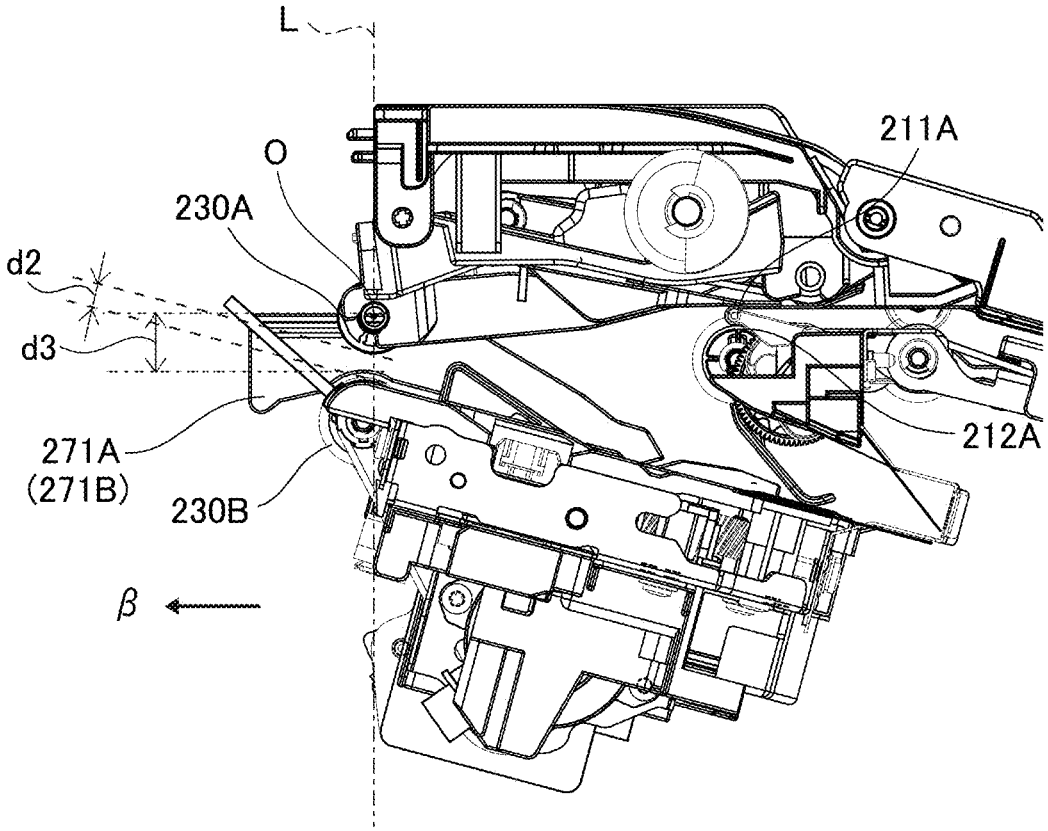
FIG. 5 is a side view of the upper discharge roller and the lower discharge roller according to the first embodiment at a second separated position.

As described above, separated positions of the upper discharge rollers 230A include a first separated position and a second separated position. FIG. 4 illustrates a state in which the upper discharge rollers 230A are at the first separated position, and FIG. 5 illustrates a state in which the upper discharge rollers 230A are at the second separated position. FIGS. 4 and 5 each illustrate the upper discharge rollers 230A, the lower discharge rollers 230B, and the surroundings thereof as viewed from the side (one side in the sheet width direction, front side). As illustrated in FIG. 4, the first separated position is a position where the upper discharge rollers 230A are more separated from the lower discharge rollers 230B than at the nipping position, and as illustrated in FIG. 5, the second separated position is a position where the upper discharge rollers 230A are more separated from the lower discharge rollers 230B than at the nipping position and the distance between the upper discharge rollers 230A and the lower discharge rollers 230B is smaller than at the first separated position.

Here, the distance between the upper discharge rollers 230A at the first separated position and the lower discharge rollers 230B will be denoted by d1 (FIG. 4), and the distance between the upper discharge rollers 230A at the second separated position and the lower discharge rollers 230B will be denoted by d2 (FIG. 5). In addition, the height in the vertical direction of the pair of alignment plates 271A and 271B at the same position as the rotation center O of the upper discharge rollers 230A at the second separated position in the first conveyance direction (arrow β direction) will be denoted by d3 (FIG. 5). That is, as illustrated in FIG. 5, in the case where a line in the vertical direction passing through the rotation center O of the upper discharge rollers 230A is a virtual line L, the height of the alignment plates 271A and 271B at the part that the virtual line L passes through is d3. The gap of the distance d2 at the second separated position at least partially overlaps with the range of the height d3 of the pair of alignment plates 271A and 271B as viewed in the width direction.

In the present embodiment, the magnitude relationship of d1, d2, and d3 is d2<d1<d3. For example, d1 is 12.4 mm, d2 is 5 mm, and d3 is 13 mm. In addition, as viewed from one side in the width direction of the sheet, part including a lower end portion in the vertical direction of the upper discharge rollers 230A at the second separated position and part of a space thereunder are at a position overlapping with the pair of alignment plates 271A and 271B. In addition, the gap between the lower end portion of the alignment plates 271A and 271B and the lower discharge rollers 230B at the part that the virtual line L passes through is very small. Therefore, the sheet between the upper discharge rollers 230A at the second separated position and the lower discharge rollers 230B abuts against the alignment plates 271A and 271B when the alignment plates 271A and 271B move closer to the sheet in the width direction. To be noted, in the present embodiment, the part including the lower end portion in the vertical direction of the upper discharge rollers 230A and the part of the space thereunder also overlap with the pair of alignment plates 271A and 271B at the first separated position as viewed from one side of the sheet in the width direction. In addition, a configuration in which part including an upper end portion in the vertical direction of the lower discharge rollers 230B also overlaps with the pair of alignment plates 271A and 271B as viewed from one side in the width direction of the sheet may be employed.

Alignment Portion

Figure 2:
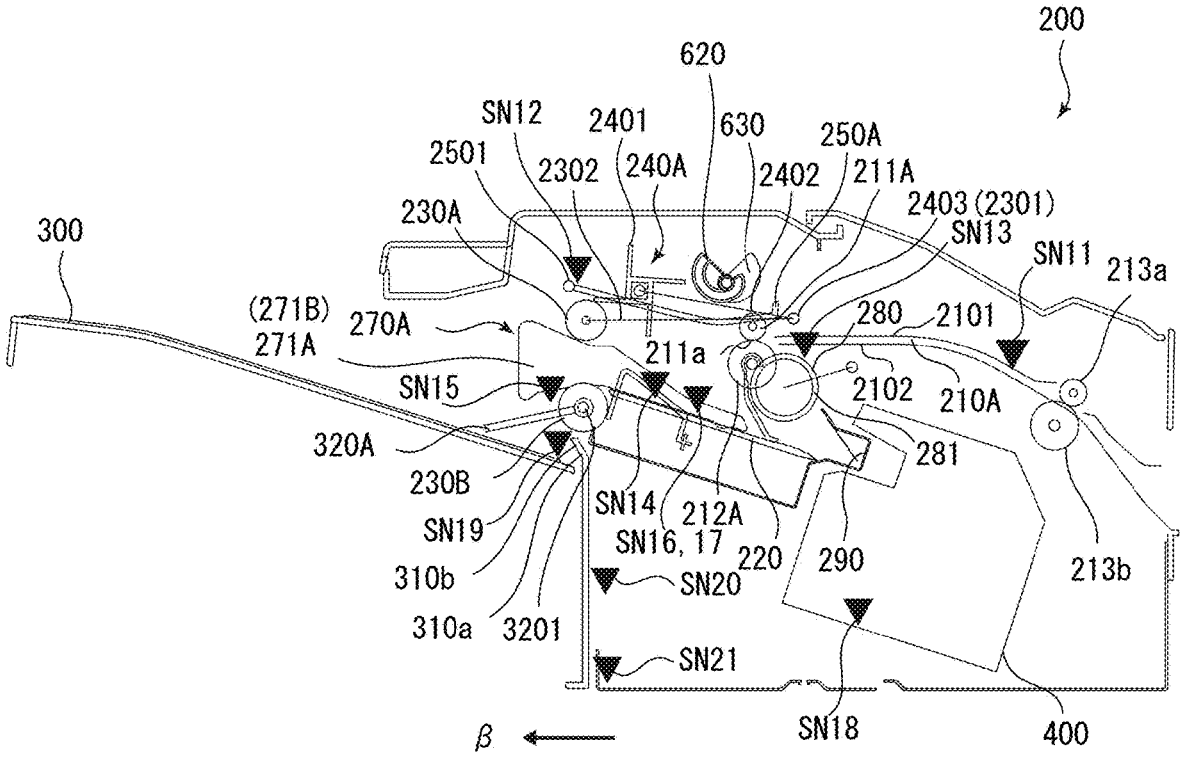
FIG. 2 is a schematic configurational section view of a sheet processing apparatus according to the first embodiment.
Figure 6:
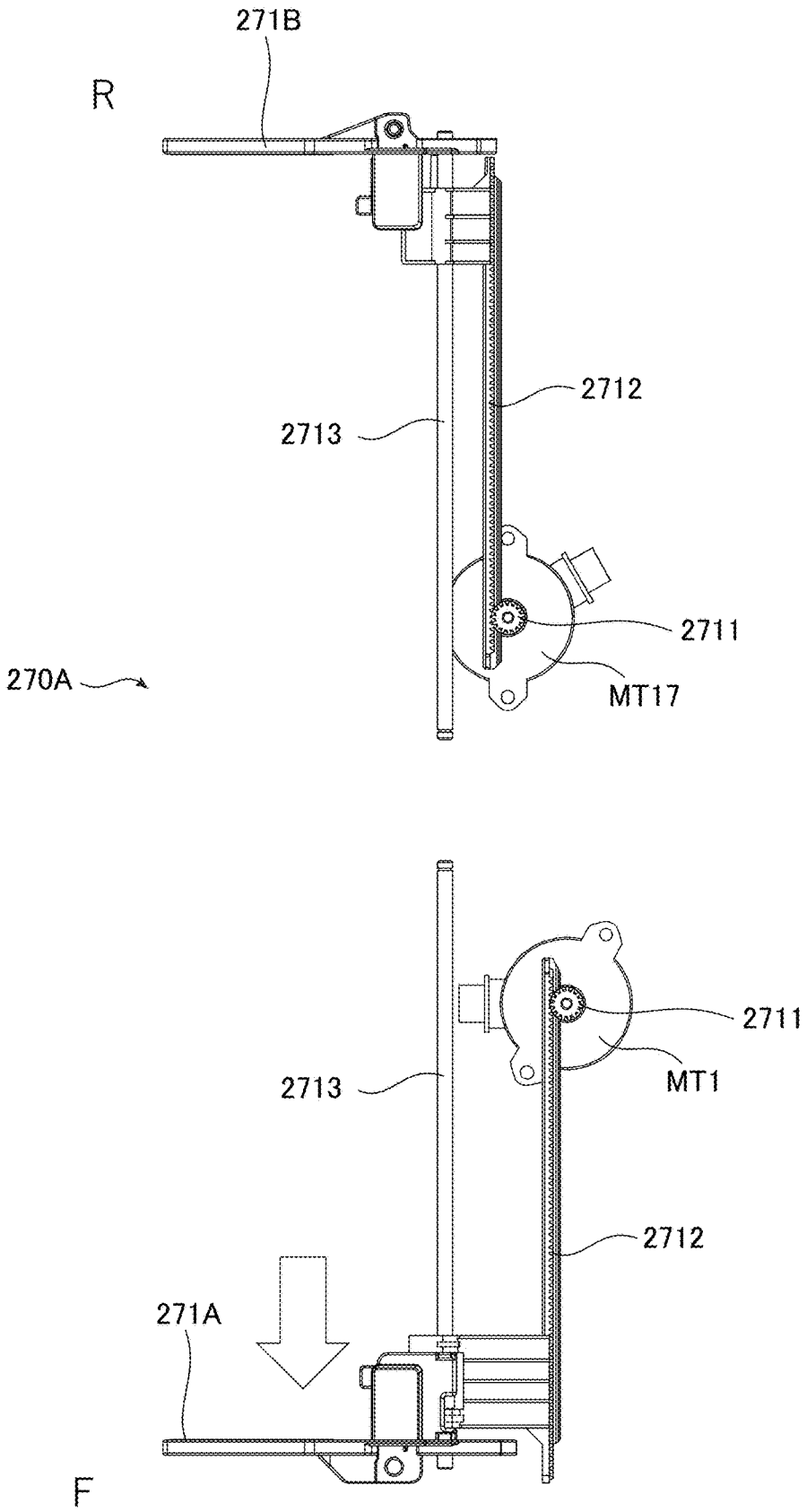
FIG. 6 is a plan view of a pair of alignment plates and the surroundings thereof according to the first embodiment as viewed from above.
Figure 7:
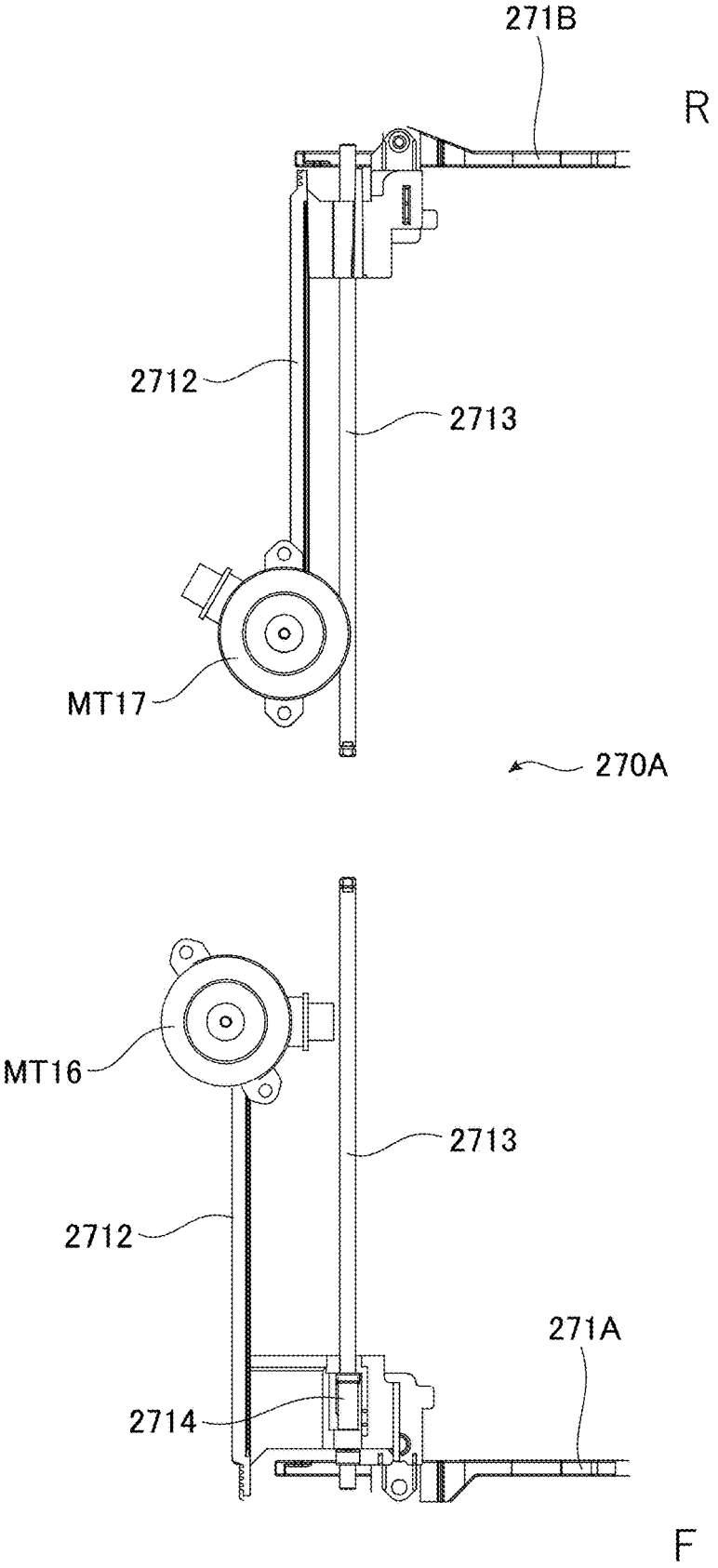
FIG. 7 is a plan view of the pair of alignment plates and the surroundings thereof according to the first embodiment as viewed from below.

The alignment portion 270A serving as a shifting portion will be described with reference to FIGS. 6 to 9 in addition to FIGS. 2 and 3. The alignment portion 270A moves the sheet in a shift direction (width direction) intersecting with the first conveyance direction by moving in the shift direction in the state of abutting against an edge following the first conveyance direction of the sheet conveyed downstream in the first conveyance direction by the pre-processing rollers 211A and 212A. The alignment portion 270A configured in this manner includes a pair of alignment plates 271A and 271B serving as a first shifting portion and a second shifting portion disposed to oppose each other in the shift direction as illustrated in FIGS. 6 and 7. To be noted, FIG. 6 is a plan view of the alignment portion 270A as viewed from above in the vertical direction, and FIG. 7 is a plan view of the alignment portion 270A as viewed from below in the vertical direction.

The pair of alignment plates 271A and 271B are disposed further downstream of the downstream end portion of the conveyance path 210A in the first conveyance direction, and align the sheet in the width direction by abutting against edges of the sheet in the width direction by moving in the width direction. In the present embodiment, these are disposed on respective sides of the sheet placed on the processing tray 220 in the width direction, and are each capable of moving in the width direction. In addition, the pair of alignment plates 271A and 271B are provided to extend from the upstream side to the downstream side in the first conveyance direction with respect to the upper discharge rollers 230A and the lower discharge rollers 230B. That is, the pair of alignment plates 271A and 271B are disposed to each extend across the upper discharge rollers 230A and the lower discharge rollers 230B in the first conveyance direction. Therefore, part of the pair of alignment plates 271A and 271B including a downstream end portion thereof in the first conveyance direction is positioned downstream of the upper discharge rollers 230A and the lower discharge rollers 230B in the first conveyance direction. To be noted, the pair of alignment plates 271A and 271B have the same configuration.

The pair of alignment plates 271A and 271B move in the shift direction by being driven by a front-side (F-side) alignment plate moving motor MT16 and a rear-side (R-side) alignment plate moving motor MT17 serving as driving portions as illustrated in FIGS. 6 and 7. That is, the driving shaft of each of the F-side alignment plate moving motor MT16 and the R-side alignment plate moving motor MT17 is provided with a pinion gear 2711. In addition, the alignment plates 271A and 271B are each provided with a rack gear 2712. Further, the pinion gear 2711 and the rack gear 2712 are configured to engage with each other. The rack gear 2712 is disposed to extend in the width direction, and moves in the width direction in response to rotation of the pinion gear 2711. In addition, the pair of alignment plates 271A and 271B are each guided along a guide shaft 2713 provided along the width direction.

As a result of this, by driving the F-side alignment plate moving motor MT16, the alignment plate 271A on the front side (lower side of FIGS. 6 and 7) can be moved in the width direction, and by driving the R-side alignment plate moving motor MT17, the alignment plate 271B on the rear side (upper side of FIGS. 6 and 7) can be moved in the width direction. That is, in the present embodiment, the alignment plates 271A and 271B can be each individually moved.

In the shift discharge process that will be described later, among the pair of alignment plates 271A and 271B configured in this manner, the alignment plate 271B on the upstream side in the shift direction (one side in the width direction, rear side in the present embodiment) will be referred to as a first shifting portion, and the alignment plate 271A on the downstream side in the shift direction (the other side in the width direction, front side in the present embodiment) will be referred to as a second shifting portion. In addition, the motor that drives the first shifting portion will be referred to as a first driving portion, and the motor that drives the second shifting portion will be referred to as a second driving portion.

Figure 8A:
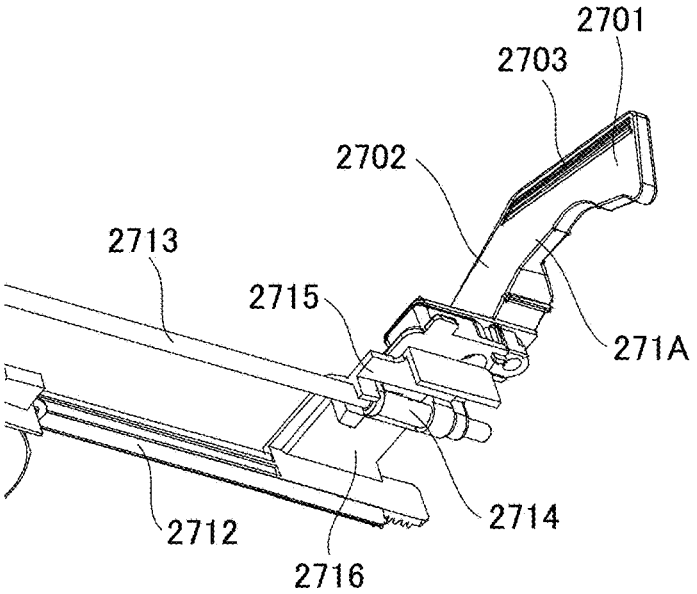
FIG. 8A is a perspective view of an alignment plate on the front side and the surroundings thereof according to the first embodiment as viewed from below.

The alignment plates 271A and 271B are formed such that the width thereof in the up-down direction on the downstream side in the first conveyance direction is larger as illustrated in FIG. 8A. That is, the alignment plates 271A and 271B each include a first plate portion 2701 on the downstream side in the first conveyance direction and a second plate portion 2702 formed on the upstream side in the first conveyance direction so as to be continuous with the first plate portion 2701. Although only the alignment plate 271A is illustrated in FIG. 8A, the same applies to the alignment plate 271B. The first plate portion 2701 has a larger area in the up-down direction than the second plate portion 2702 so as to be capable of abutting against the sheet even in the case where the leading end side of the conveyed sheet is curled up or down. In contrast, the second plate portion 2702 is formed to have a height in the up-down direction smaller than the first plate portion 2701 so as not to interfere with the trailing end dropping members 250A even in the case where the trailing end dropping members 250A are positioned at the lower position. In addition, the upper edge of the second plate portion 2702 is inclined so as to be lower on the upstream side in the first conveyance direction.

In addition, the first plate portion 2701 is formed so as to extend from the upstream side to the downstream side in the first conveyance direction with respect to the upper discharge rollers 230A and the lower discharge rollers 230B. As a result of this, even in the case where the sheet is discharged by the switchbackless shift discharge process that is a kind of shift discharge process that will be described later, at least the first plate portion 2701 is capable of abutting against the sheet. In addition, the second plate portion 2702 is positioned on the processing tray 220, and is formed to be continuous with the first plate portion 2701 in the first conveyance direction. As a result of this, at least the second plate portion 2702 is capable of abutting against the sheet placed on the processing tray 220 by the switchback shift discharge process that is a kind of shift discharge process that will be described later, at least the second plate portion 2702 is capable of abutting against the sheet placed on the processing tray 220.

In addition, the first plate portion 2701 includes a curl pressing portion 2703. The curl pressing portion 2703 is provided to extend from the upstream side to the downstream side of a discharge nip portion 230*a* (see FIG. 13B that will be described later) that is a nip position where the upper discharge rollers 230A and the lower discharge rollers 230B nip the sheet in the first conveyance direction and above the discharge nip portion 230*a* in the vertical direction, and presses the leading end of the sheet that is curled up. In the present embodiment, the curl pressing portion 2703 is a recess/projection portion formed to extend from the upper end portion to the inside in the width direction (sheet abutting side) of the first plate portion 2701, and the leading end of the sheet can be pressed as a result of the edge of the curled sheet in the width direction being caught by the curl pressing portion 2703.

Figure 8B:
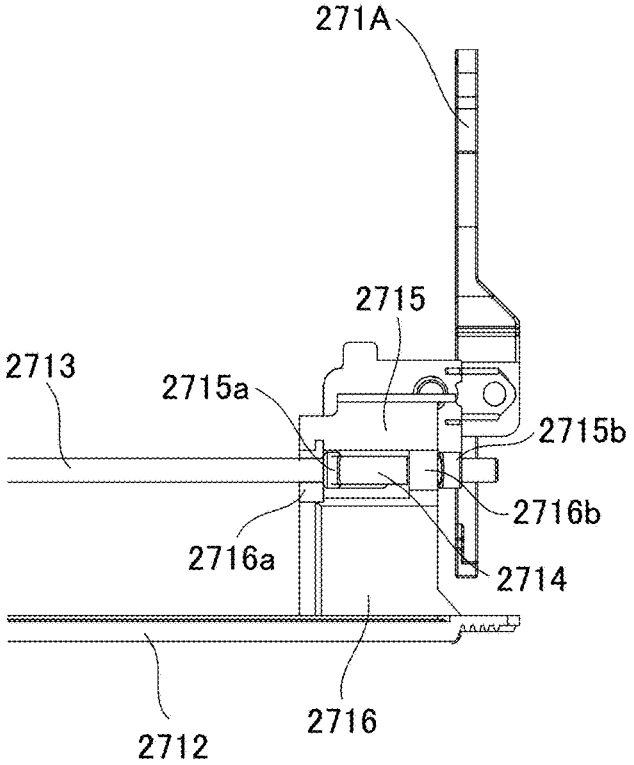
FIG. 8B is a plan view of the alignment plate on the front side and the surroundings thereof according to the first embodiment as viewed from below.

The alignment portion 270A of the present embodiment further includes an urging spring 2714 serving as an urging portion that urges the alignment plate 271A on the one side (front side) of the pair of alignment plates 271A and 271B configured in this manner toward the alignment plate 271B on the other side (rear side). As illustrated in FIGS. 8A and 8B, the alignment plate 271A on the front side is supported to be movable in the width direction with respect to the guide shaft 2713 via a support portion 2715 fixed to the alignment plate 271A. Meanwhile, the rack gear 2712 on the front side is supported to be movable in the width direction with respect to the guide shaft 2713 via a support portion 2716 fixed to the rack gear 2712. Further, the urging spring 2714 that is a compression spring is disposed between part of the support portion 2715 and part of the support portion 2716.

More specifically, the support portion 2716 of the rack gear 2712 is fitted on the guide shaft 2713 via a pair of fitting portions 2716*a* and 2716*b* separated from each other. Meanwhile, the support portion 2715 of the alignment plate 271A is fitted on the guide shaft 2713 via a pair of fitting portions 2715*a* and 2715*b* separated from each other. Further, the fitting portion 2715*a* on the inside (rear side) of the alignment plate 271A in the width direction is disposed more on the outside (front side) in the width direction than the fitting portion 2716*a* on the inside (rear side) of the rack gear 2712 in the width direction, and similarly the fitting portion 2715*b* on the outside in the width direction is disposed to be positioned more on the outside in the width direction than the fitting portion 2716*b*. In addition, the urging spring 2714 is disposed between the fitting portion 2715*a* of the alignment plate 271A and the fitting portion 2716*b* of the rack gear 2712 in a compressed state. As a result of this, when the alignment plate 271A is pushed to the front side by the sheet, the urging spring 2714 is compressed, and the alignment plate 271A moves to the front side with respect to the rack gear 2712. In this state, the alignment plate 271A pushes the sheet to the rear side by the elastic restoration force of the urging spring 2714.

Figure 9:
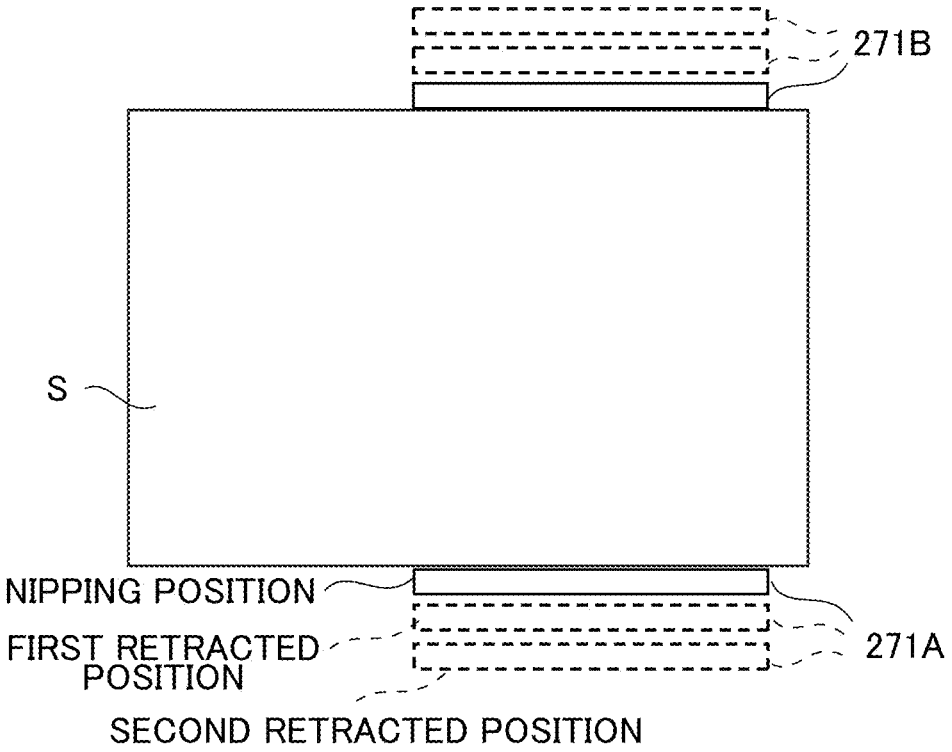
FIG. 9 is a schematic diagram for describing a nipping position, a first retracted position, and a second retracted position of the pair of alignment plates according to the first embodiment.

In addition, in the present embodiment, the pair of alignment plates 271A and 271B are movable to an aligning position (not illustrated) where alignment of the sheet S in the width direction is performed, a nipping position, a first retracted position, and a second retracted position as illustrated in FIG. 9. Further, the pair of alignment plates 271A and 271B are also movable to a receiving position (not illustrated) for receiving the sheet onto the processing tray 220 in addition to these positions. The aligning position is a position where a sheet S abutting against the trailing end regulating member 290 is aligned in the width direction in the switchback shift discharge process that will be described later. The nipping position is a position where the sheet S is nipped in the switchbackless shift discharge process that will be described later. The first retracted position is a position where the pair of alignment plates 271A and 271B are more retracted from the two edges of the sheet S in the width direction than at the nipping position. The second retracted position is a position where the pair of alignment plates 271A and 271B are further retracted from the two edges of the sheet S in the width direction than at the first retracted position. For example, the aligning position is a position where the pair of alignment plates 271A and 271B are at approximately the same position as the two edges of the sheet S in the width direction and may be the same position as the nipping position or a position slightly more retracted from the edges of the sheet S in the width direction than at the nipping position. The nipping position is a position where the pair of alignment plates 271A and 271B abut against the edges of the sheet S in the width direction. The first retracted position is a position where the pair of alignment plates 271A and 271B are retracted from the two edges of the sheet S in the width direction by 3 mm each. The second retracted position is a position where the pair of alignment plates 271A and 271B are retracted from the two edges of the sheet S in the width direction by 5 mm each. The receiving position is a position where the pair of alignment plates 271A and 271B are retracted from the two edges of the sheet S in the width direction by 10 mm each.

The first retracted position described above is a position where the distance from the two edges of the conveyed sheet in the width direction so as to suppress the skew of the sheet when the upper discharge rollers 230A and the lower discharge rollers 230B discharge the sheet. The second retracted position suppresses the contact of the sheet with the pair of alignment plates 271A and 271B after the sheet has passed the discharge nip portion 230*a* formed by the upper discharge rollers 230A and the lower discharge rollers 230B. After the sheet has passed the discharge nip portion 230*a*, the sheet is not nipped by a roller or the like, and therefore due to the influence of this, the sheet can be inclined if an edge of the sheet in the width direction comes into contact with at least one of the pair of alignment plates 271A and 271B. Therefore, in the present embodiment, the pair of alignment plates 271A and 271B are moved to the second retracted position after the trailing end of the sheet has passed the discharge nip portion 230*a*.

To be noted, in the first retracted position, the positions of the pair of alignment plates 271A and 271B may be slightly different from each other within a range where the effect of suppression of the skew of the sheet can be obtained. Similarly, in the second retracted position, the positions of the pair of alignment plates 271A and 271B may be slightly different from each other within a range where the sheet does not come into contact with the pair of alignment plates 271A and 271B. In addition, the distance from the two edges of the sheet in the width direction at each position may be different from the values described above as long as the above-described requirements are satisfied.

Stacking Tray

On the stacking tray 300 serving as a stacking portion, the sheet discharged by the upper discharge rollers 230A and the lower discharge rollers 230B is stacked as described above. The stacking tray 300 is provided downstream of the processing tray 220 in the first conveyance direction and below the processing tray 220 in the vertical direction so as to be capable of moving up and down in the vertical direction as illustrated in FIGS. 2 and 3. In addition, the stacking tray 300 is inclined with respect to the horizontal surface such that the upstream side thereof in the first conveyance direction is lower than the downstream side thereof. For example, the stacking tray 300 configured in this manner is supported to be movable in the up-down direction along a rail disposed in the up-down direction, and moves up and down by being driven by a stacking tray lifting/lowering motor MT20 (FIG. 17) serving as a lifting/lowering means.

At the upstream end of the stacking tray 300 in the first conveyance direction, an erecting surface 310*a* serving as a stacking side regulating means that regulates the upstream end (trailing end) in the first conveyance direction of the sheet or sheet bundle stacked on the stacking tray 300, and a trailing end pressor 310*b* that presses the trailing end of the sheet abutting against the erecting surface 310*a* are provided. The trailing end pressor 310*b* is inclined upward to the downstream side in the first conveyance direction, and even in the case where the trailing end of the sheet is curled up, the trailing end can be pressed by the trailing end pressor 310*b*.

In addition, a discharged sheet reversing paddle 320A is provided coaxially with the rotation shaft of the lower discharge rollers 230B. To be noted, a rotation shaft 3201 (see FIG. 2) of the discharged sheet reversing paddle 320A does not have to be coaxial with the rotation shaft of the lower discharge roller 230B. It suffices as long as the rotation shaft 3201 of the discharged sheet reversing paddle 320A is provided between the discharge nip portion 230*a* (see FIG. 13B described below) between the upper discharge roller 230A and the lower discharge roller 230B serving as a pair of discharge rotary members and the erecting surface 310*a* serving as a stacking side abutment portion provided on the upstream side in the first conveyance direction of the stacking tray 300. In the present embodiment, the rotation shaft 3201 of the discharged sheet reversing paddle 320A is disposed between the downstream end portion in the first conveyance direction of the processing tray 220 and the upper end portion of the erecting surface 310*a* in the vertical direction as illustrated in FIG. 2.

The stacking tray 300 is capable of being moved up and down by the stacking tray lifting/lowering motor MT20 between a first stacking position and a second stacking position below the first stacking position. The second stacking position is a position where the movement of the stacking tray 300 moving down when discharging the sheet onto the stacking tray 300 is switched to upward movement. When discharging the sheet, the stacking tray 300 moves up and down, the discharged sheet reversing paddle 320A rotates, and the sheet or sheet bundle on the stacking tray 300 (stacking portion) is conveyed (raked in) in a third conveyance direction in which the upstream edge of the sheet in the first conveyance direction moves toward the erecting surface 310*a*. Further, the upper surface of the sheet or sheet bundle constituted by a plurality of sheets on the stacking tray 300 is pressed by the discharged sheet reversing paddle 320A.

Driving Configuration of Each Portion

Figure 10A:
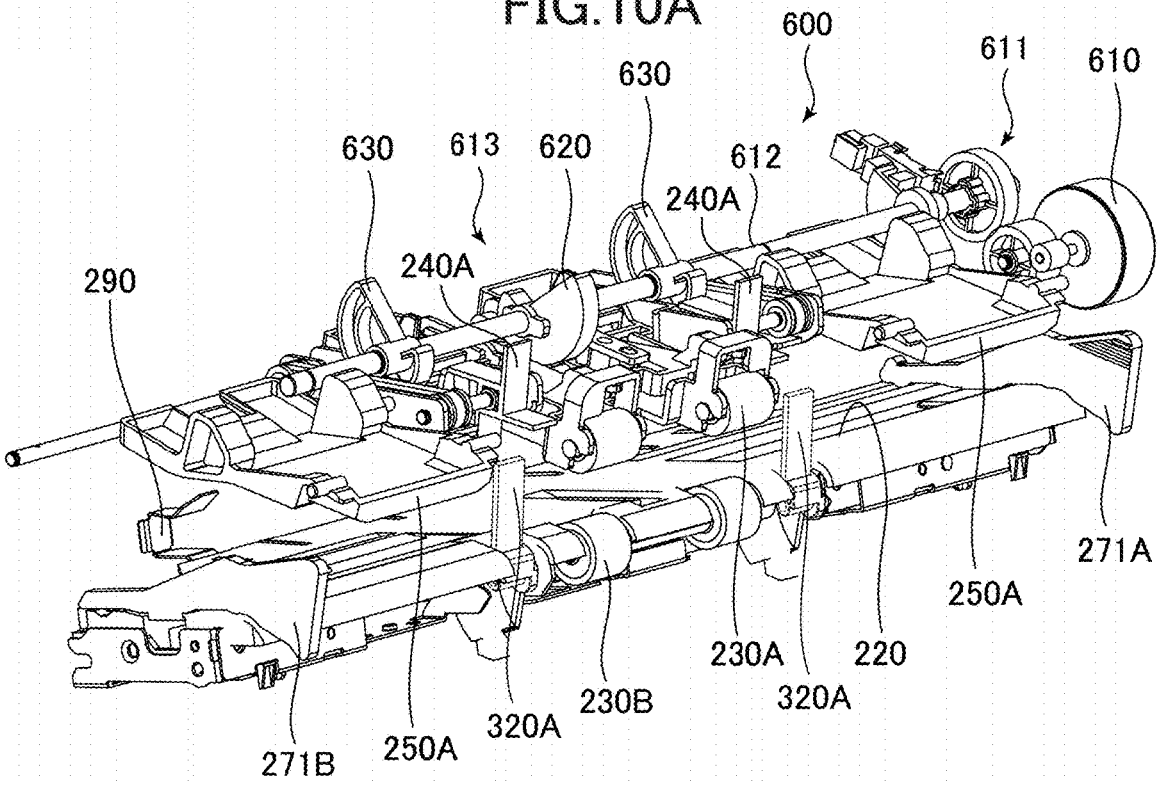
FIG. 10A is a perspective view of the vicinity of the processing tray at a home position of the sheet processing apparatus according to the first embodiment.
Figure 10B:
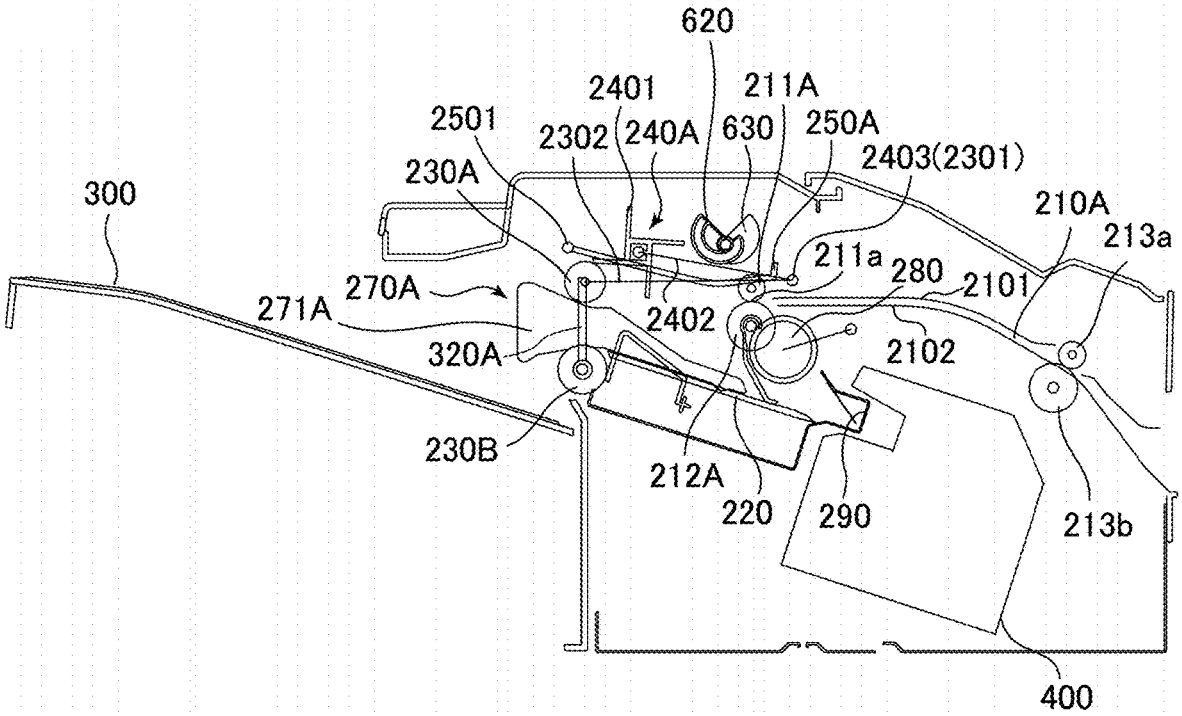
FIG. 10B is a schematic configurational section view of the sheet processing apparatus at the home position of the sheet processing apparatus according to the first embodiment.

Next, the driving configurations of the upper discharge rollers 230A, the reversing paddles 240A, and the trailing end dropping members 250A will be described with reference to FIGS. 10A to 16C. In the present embodiment, the upper discharge rollers 230A, the reversing paddles 240A, and the trailing end dropping member 250A are configured to operate in an interlocked manner. As illustrated in FIG. 10A, a driving configuration 600 for these includes a processing upper motor 610 (MT12, FIG. 17) serving as a drive source, a drive transmission mechanism 611, a rotation shaft 612, and a cam mechanism 613. The processing upper motor 610 is capable of rotating in a normal direction and a reverse direction, and the drive of the processing upper motor 610 is transmitted to the rotation shaft 612 via the drive transmission mechanism 611. In the present embodiment, the drive transmission mechanism 611 is constituted by a gear train, but may be a different drive transmission configuration such as a configuration in which the drive is transmitted by a belt.

The rotation shaft 612 is disposed to extend in the width direction above the upper discharge rollers 230A, the reversing paddles 240A, and the trailing end dropping members 250A. Further, the cam mechanism 613 is configured to operate by the rotation of the rotation shaft 612. The cam mechanism 613 includes a first cam member 620 and second cam members 630 that rotate together with the rotation shaft 612. The first cam member 620 is disposed between the pair of upper discharge rollers 230A, and moves the upper discharge rollers 230A. One second cam member 630 each is provided to be adjacent to each of the pair of reversing paddles 240A, and moves the reversing paddle 240A and the trailing end dropping member 250A.

Figure 11A:
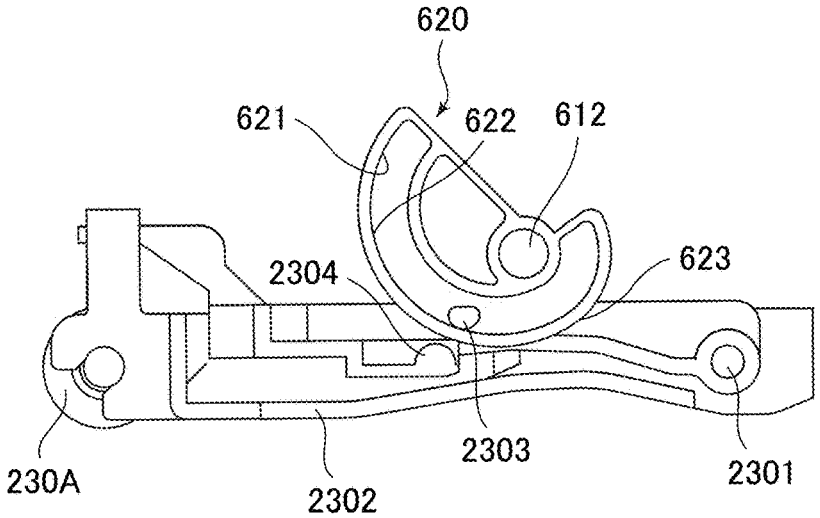
FIG. 11A is a diagram illustrating the state of a discharge roller at the home position of the sheet processing apparatus according to the first embodiment as viewed in the width direction.

As illustrated in FIG. 11A, a groove portion 621 that a protrusion portion 2303 provided on the discharge arm 2302 of the upper discharge rollers 230A is capable of entering is defined on the inside of the first cam member 620. The outer peripheral surface of the groove portion 621, that is, the inner peripheral surface of the first cam member 620 serves as an inner cam surface 622. The inner cam surface 622 is a cam surface whose distance from the rotational center of the rotation shaft 612 varies depending on the phase in the rotational direction. In addition, the outer peripheral surface of the first cam member 620 serves as an outer cam surface 623. The outer cam surface 623 is also a cam surface whose distance from the rotational center of the rotation shaft 612 varies depending on the phase in the rotational direction.

The discharge arm 2302 of the upper discharge rollers 230A includes an abutment portion 2304 capable of abutting against the outer cam surface 623 of the first cam member 620 in addition to the protrusion portion 2303 described above. The first cam member 620, by rotating together with the rotation shaft 612, changes the abutting position (phase) between the inner cam surface 622 and the protrusion portion 2303, separate these to change the abutting position (phase) between the outer cam surface 623 and the abutment portion 2304, and by separating these, as will be described later, pivots the upper discharge rollers 230A from the nipping position to the first separated position and the second separated position about the pivot shaft 2301.

Figure 11B:
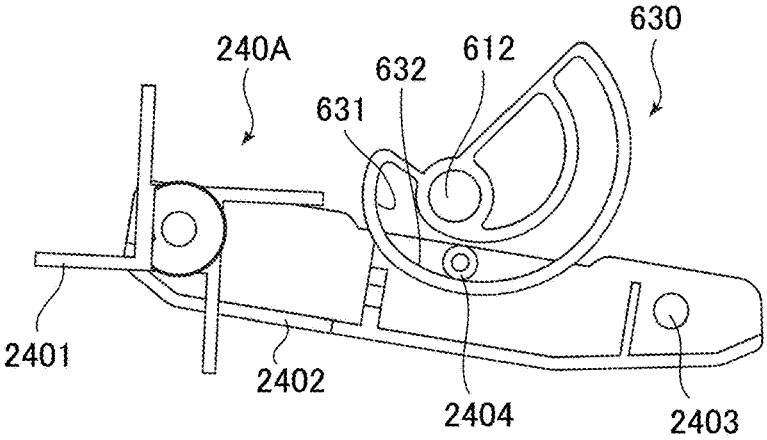
FIG. 11B is a diagram illustrating the state of a reversing paddle at the home position of the sheet processing apparatus according to the first embodiment as viewed in the width direction.

As illustrated in FIG. 11B, a groove portion 631 that a first protrusion portion 2404 provided on the paddle arm 2402 of the reversing paddle 240A is capable of entering is provided on the inside of the second cam member 630. The outer peripheral surface of the groove portion 631, that is, the inner peripheral surface of the second cam member 630 serves as an inner cam surface 632. The inner cam surface 632 is a cam surface whose distance from the rotational center of the rotation shaft 612 varies depending on the phase in the rotational direction. The second cam member 630 pivots the reversing paddle 240A between the returning position and the upper retracted position about the swing fulcrum 2403 as will be described later, by rotating together with the rotation shaft 612 and thus changing the abutting position (phase) between the inner cam surface 632 and the first protrusion portion 2404.

Figure 11C:
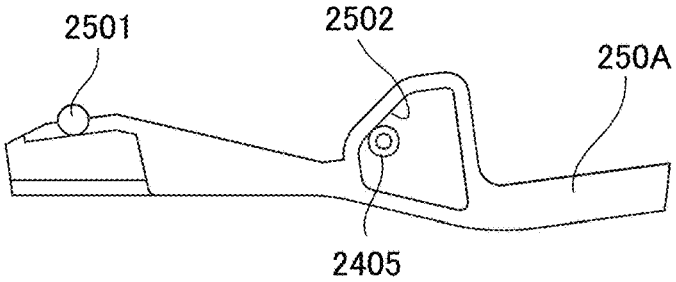
FIG. 11C is a diagram illustrating the state of a trailing end dropping member at the home position of the sheet processing apparatus according to the first embodiment as viewed in the width direction.
Figure 12:
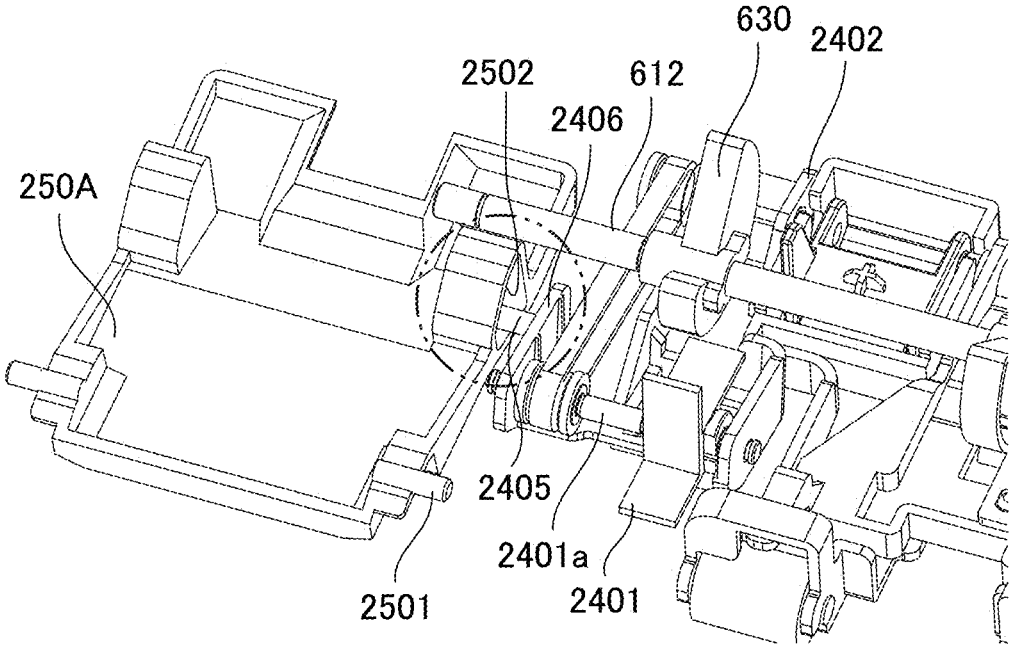
FIG. 12 is a perspective view illustrating an engagement relationship between the trailing end dropping member and the reversing paddle according to the first embodiment.

In addition, a support portion 2406 that swings about the swing fulcrum 2403 together with the paddle arm 2402 of the reversing paddle 240A and supports an end portion of a rotation shaft 2401*a* of the paddle portion 2401 is provided with a second protrusion portion 2405 capable of entering an engagement recess portion 2502 defined in the trailing end dropping member 250A as illustrated in FIGS. 11C and 12. The engagement recess portion 2502 pivots the trailing end dropping member 250A between the upper position and the lower position about the pivot shaft 2501 in an interlocked manner with pivoting of the reversing paddles 240A by abutting against or separating from the second protrusion portion 2405. Driving of the upper discharge rollers 230A, the reversing paddles 240A, and the trailing end dropping members 250A will be described in detail below.

Home Position

First, FIGS. 10A to 11C illustrate a home position (HP) of the upper discharge rollers 230A, the reversing paddles 240A, and the trailing end dropping members 250A. In the home position, as illustrated in FIGS. 10A and B, the upper discharge rollers 230A, the reversing paddles 240A, and the trailing end dropping members 250A are respectively positioned at the first separated position, the upper retracted position, and the upper position.

In this state, as illustrated in FIG. 11A, the protrusion portion 2303 of the upper discharge rollers 230A abuts against a portion of the first cam member 620 whose distance from the center of the rotation shaft 612 of the inner cam surface 622 is small, and thus the upper discharge rollers 230A are supported by the first cam member 620.

In addition, as illustrated in FIG. 11B, as a result of the first protrusion portions 2404 of the reversing paddles 240A abutting portions of the inner cam surfaces 632 of the second cam members 630 whose distance from the center of the rotation shaft 612 is small, the reversing paddles 240A are supported by the second cam members 630.

Further, as illustrated in FIG. 11C, as a result of engagement recess portions 2502 of the trailing end dropping members 250A abutting against second protrusion portions 2405 of the reversing paddles 240A, the trailing end dropping members 250A are supported by the reversing paddles 240A via the second protrusion portions 2405.

Descent of Upper Discharge Rollers

Next, an operation of moving the upper discharge rollers 230A from the home position (first separated position) to the nipping position will be described with reference to FIGS. 13A to 14C. In the case where the processing upper motor 610 is driven to rotate the rotation shaft 612 in a first direction (counterclockwise direction in FIGS. 14A and B) to move down the upper discharge rollers 230A from the home position, the first cam member 620 also rotates in the same direction, and the protrusion portion 2303 moves along the inner cam surface 622. The inner cam surface 622 is formed such that movement in a counterclockwise direction from the home position increases the distance from the center of the rotation shaft 612. Therefore, as a result of this operation, the upper discharge rollers 230A move down.

Figure 14A:
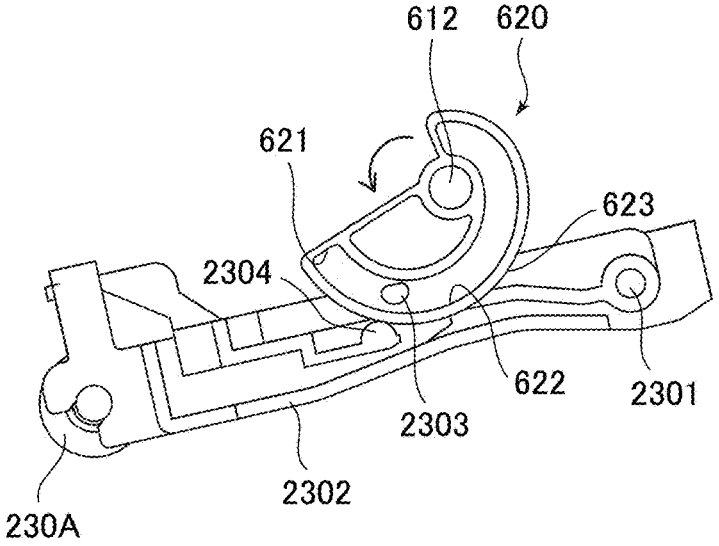
FIG. 14A is a diagram illustrating the state of the discharge roller at the time of sheet discharge of the sheet processing apparatus according to the first embodiment as viewed in the width direction.

Next, when the upper discharge rollers 230A move to the nipping position and come into contact with the lower discharge rollers 230B, as illustrated in FIG. 14A, the inner cam surface 622 of the first cam member 620 and the protrusion portion 2303 are separated, and the outer cam surface 623 abuts against the abutment portion 2304. By causing the outer cam surface 623 to abut against the abutment portion 2304 as described above, the upper discharge rollers 230A are pressurized toward the lower discharge rollers 230B, and a predetermined nip pressure is applied between these rollers.

Figure 13A:
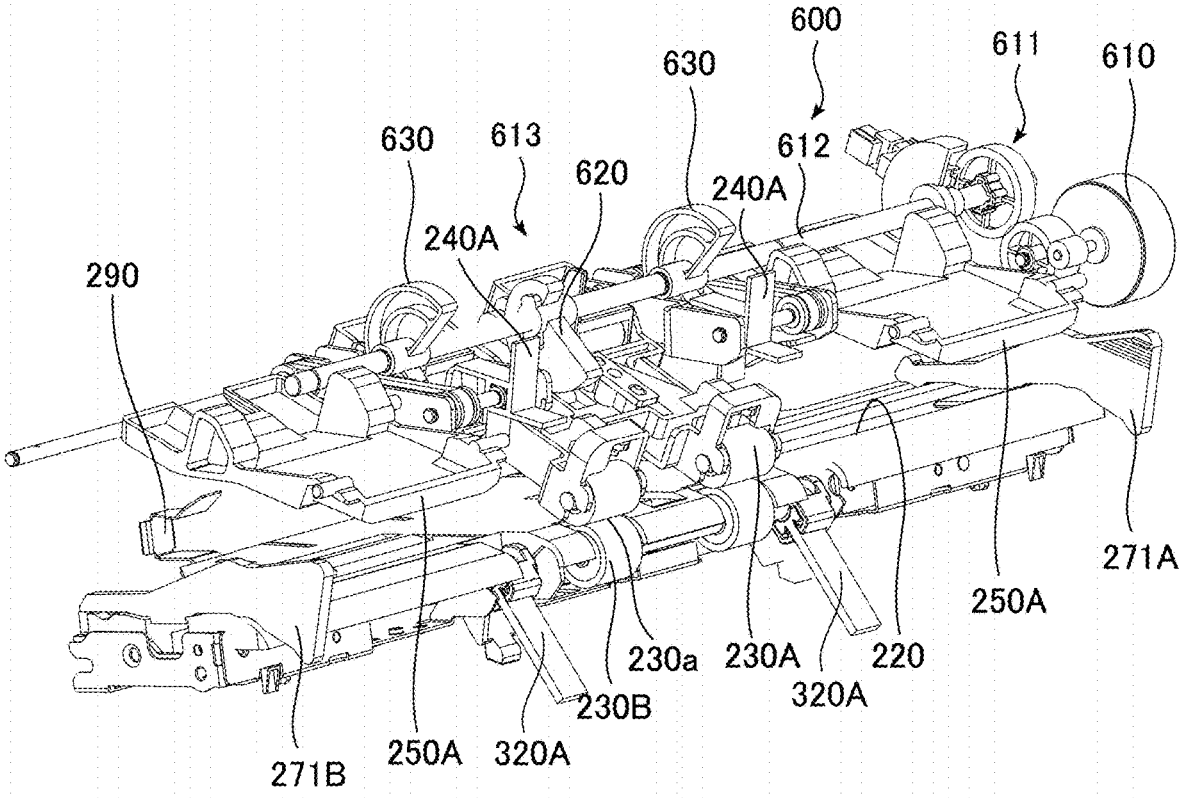
FIG. 13A is a perspective view of the vicinity of the processing tray at the time of sheet discharge of the sheet processing apparatus according to the first embodiment.
Figure 13B:
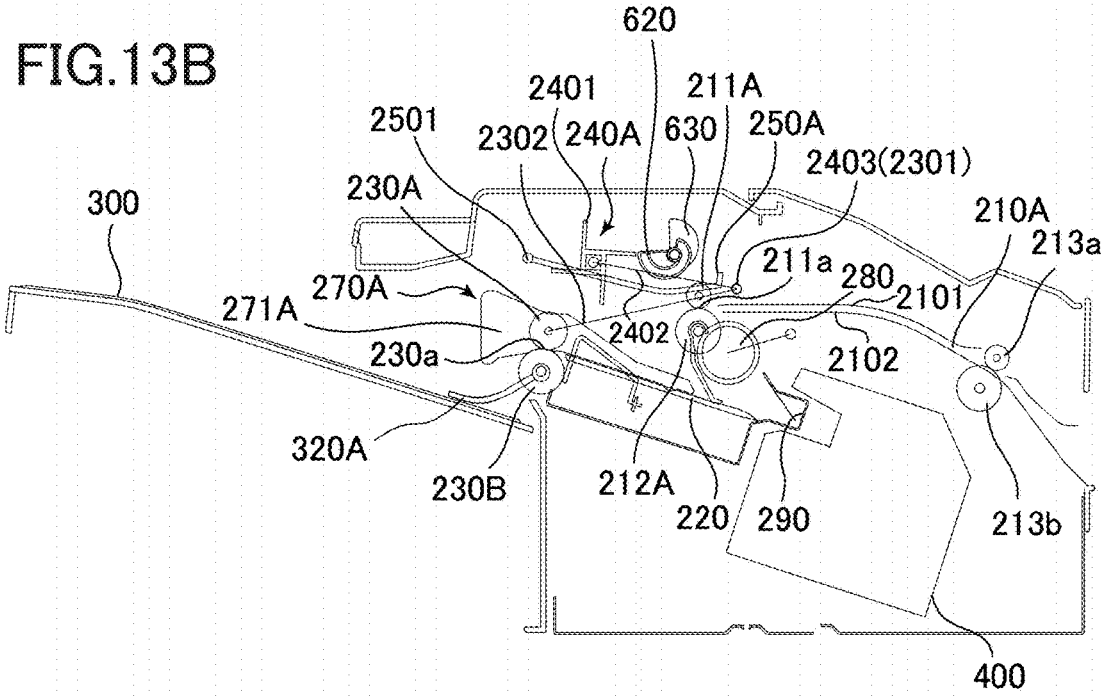
FIG. 13B is a schematic configurational section view of the sheet processing apparatus at the time of sheet discharge of the sheet processing apparatus according to the first embodiment.
Figure 14B:
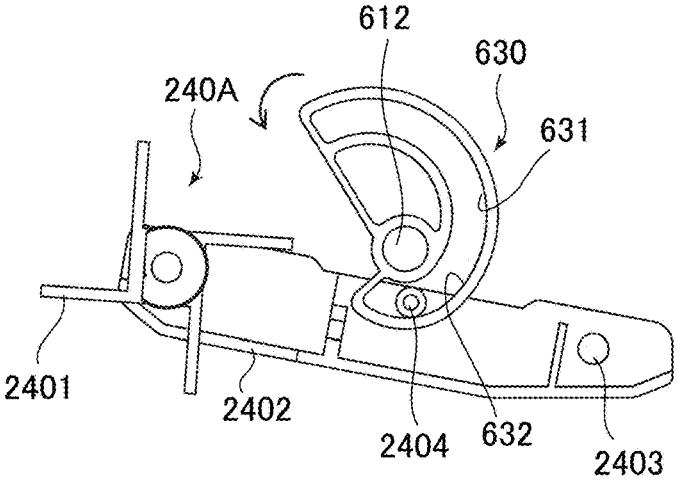
FIG. 14B is a diagram illustrating the state of the reversing paddle at the time of sheet discharge of the sheet processing apparatus according to the first embodiment as viewed in the width direction.
Figure 14C:
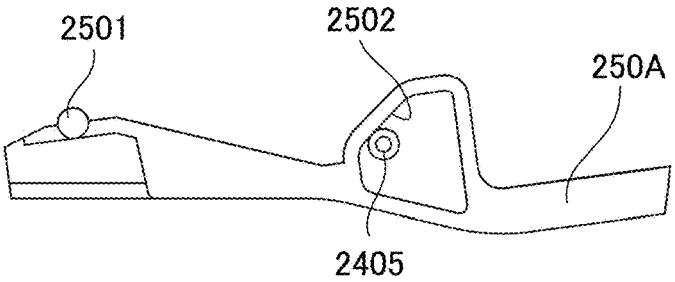
FIG. 14C is a diagram illustrating the state of the trailing end dropping member at the time of sheet discharge of the sheet processing apparatus according to the first embodiment as viewed in the width direction.

At this time, the second cam members 630 also rotate together with the rotation shaft 612, but as illustrated in FIG. 14B, the distance of the position where the inner cam surface 632 abuts against the first protrusion portion 2404 from the center of the rotation shaft 612 is approximately equal to the distance in the home position. Therefore, even if the second cam members 630 rotate, the reversing paddles 240A are maintained at the home position. Since the reversing paddles 240A are maintained at the home position, as illustrated in FIG. 14C, the trailing end dropping members 250A are also maintained at the home position. That is, in this state, as illustrated in FIG. 13B, the upper discharge rollers 230A move to the nipping position, but the reversing paddles 240A and the trailing end dropping members 250A are maintained at the home position.

In the case of moving up the upper discharge rollers 230A, the processing upper motor 610 is driven to rotate the rotation shaft 612 in a second direction (clockwise direction in FIGS. 14A and B) opposite to the first direction. Then, the first cam member 620 rotates in the same direction together with the rotation shaft 612, the protrusion portion 2303 moves along the inner cam surface 622, and the upper discharge rollers 230A move up. Then, return to the home position illustrated in FIG. 11A occurs.

Here, in the reversing paddles 240A and the trailing end dropping members 250A, the first protrusion portions 2404 move along the inner cam surfaces 632 of the second cam members 630 when returning from the state of FIGS. 14B and C to the state of FIGS. 11B and C, and the inner cam surfaces 632 are defined such that the distance of the position where the inner cam surfaces 632 abut against the first protrusion portions 2404 from the center of the rotation shaft 612 does not change at this time. Therefore, the reversing paddles 240A are maintained at the home position. Since the reversing paddles 240A are maintained at the home position, the trailing end dropping members 250A are also maintained at the home position.

Descent of Reversing Paddles and Trailing End Dropping Members

Figure 15A:
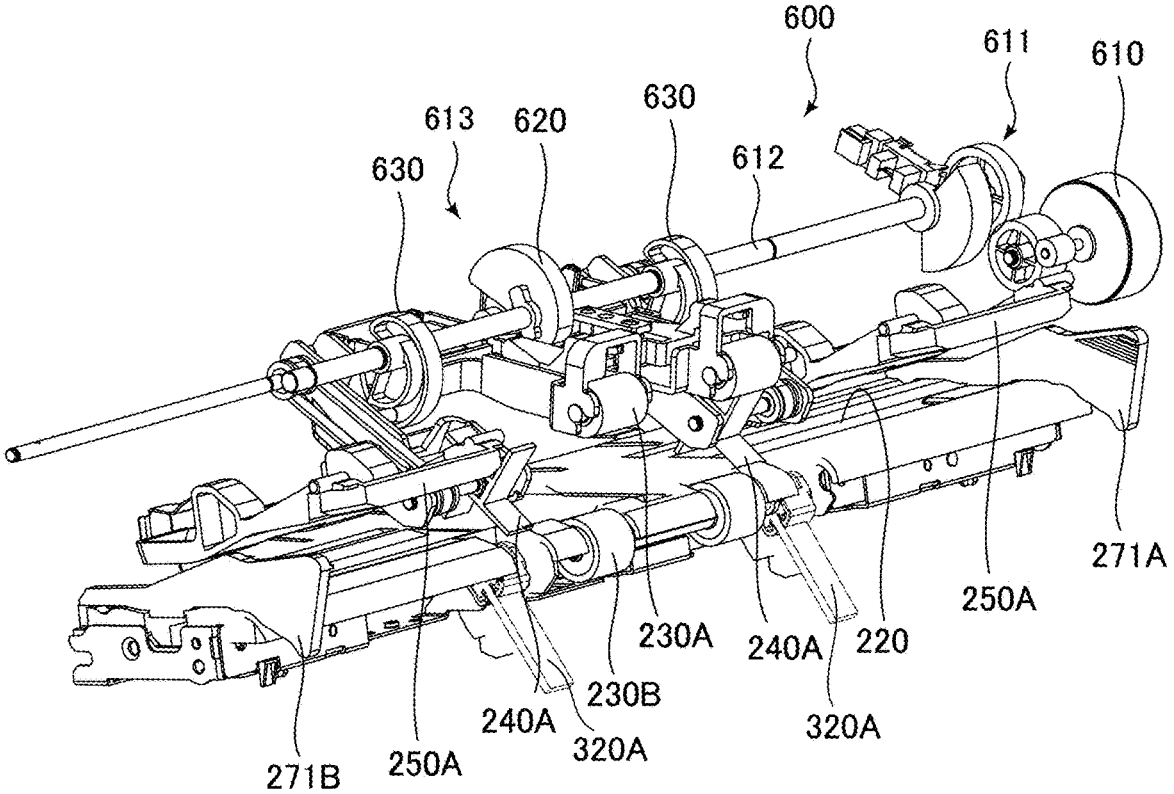
FIG. 15A is a perspective view of the vicinity of the processing tray at the time of sheet reversing of the sheet processing apparatus according to the first embodiment.
Figure 15B:
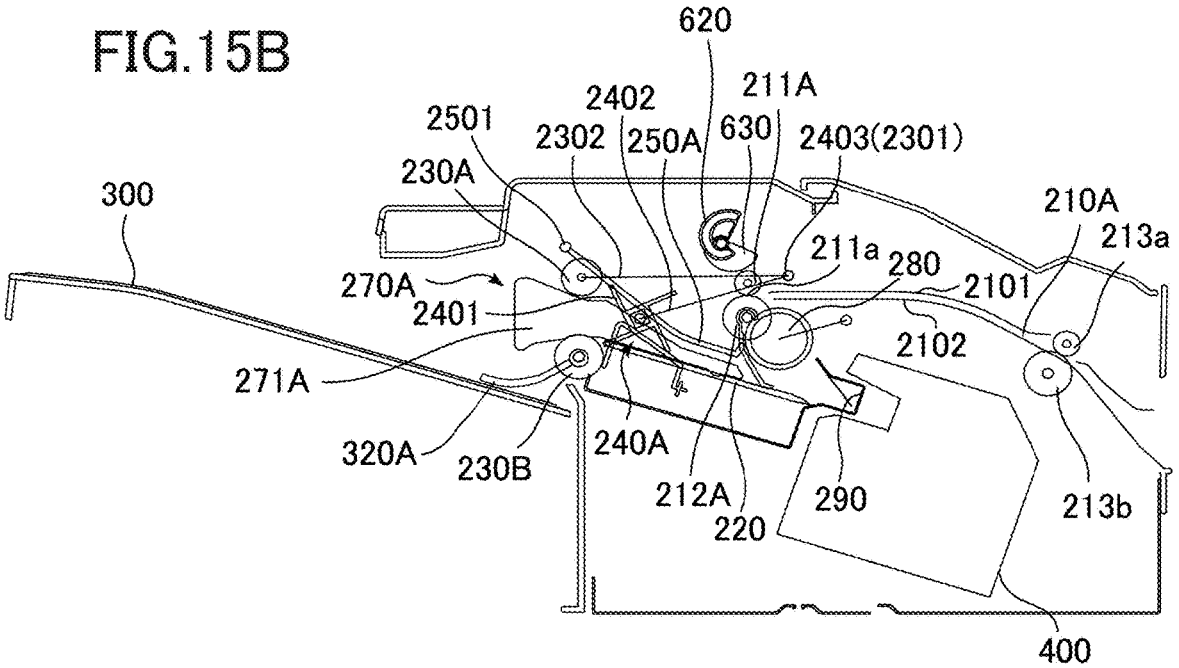
FIG. 15B is a schematic configurational section view of the sheet processing apparatus at the time of sheet reversing of the sheet processing apparatus according to the first embodiment.
Figure 16A:
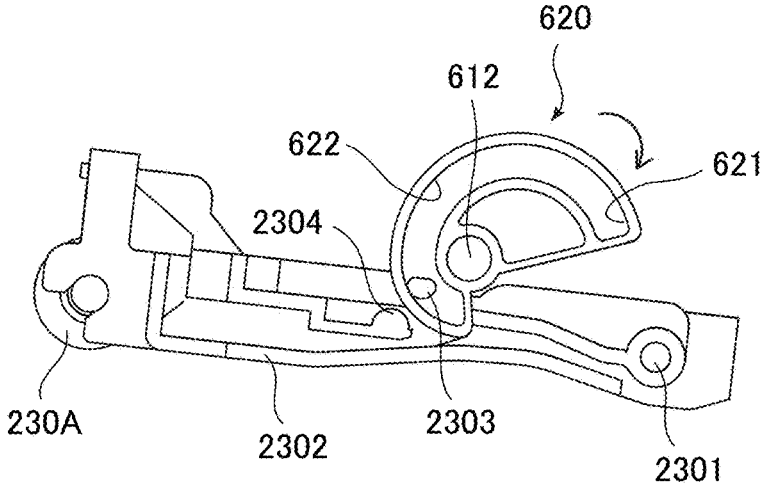
FIG. 16A is a diagram illustrating the state of the discharge roller at the time of sheet reversing of the sheet processing apparatus according to the first embodiment as viewed in the width direction.

Next, an operation of moving the reversing paddles 240A and the trailing end dropping members 250A from the home position (upper retracted position and upper position) to the returning position and the lower position will be described with reference to FIGS. 15A to 16C. When the processing upper motor 610 is driven to rotate the rotation shaft 612 in the second direction (clockwise direction in FIGS. 16A and B) opposite to the first direction to move down the reversing paddles 240A and the trailing end dropping members 250A from the home position, the first cam member 620 also rotates in the same direction, and the protrusion portion 2303 moves along the inner cam surface 622. The inner cam surface 622 is formed such that the distance from the center of the rotation shaft 612 does not change even in the case of rotating in the clockwise direction from the home position. Therefore, as illustrated in FIG. 16A, the upper discharge rollers 230A are maintained at the home position.

Meanwhile, the second cam members 630 also rotate in the same direction together with the rotation shaft 612, and the first protrusion portions 2404 move along the inner cam surfaces 632. The inner cam surfaces 632 are formed such that the distance from the center of the rotation shaft 612 changes in accordance with rotation in the clockwise direction from the home position. Therefore, as a result of this operation, the reversing paddles 240A move down, and move to the returning position.

At this time, the trailing end dropping members 250A also move down together with the reversing paddles 240A. In the present embodiment, the trailing end dropping member 250A includes a positioning portion 2503 positioned at the lower position by engaging with the upper guide 2101 of the conveyance path 210A when pivoting from the upper position to the lower position. The positioning portion 2503 is provided at an upper end portion of a projection portion 2504 provided to project upward from a distal end (upstream end in the first conveyance direction) of the trailing end dropping member 250A. The projection portion 2504 also has a function of regulating the leading end of the sheet conveyed toward the pre-processing nip portion 211*a* on the upstream side of the pre-processing nip portion 211*a* in the first conveyance direction in a state in which the trailing end dropping member 250A is at the lower position.

The positioning portion 2503 is an engagement portion provided at an upper edge of the projection portion 2504 to be capable of engaging with the upper guide 2101, and restricts further descent of the trailing end dropping member 250A by abutting against the upper surface of the upper guide 2101. The engagement recess portions 2502 are defined to be separated from the second protrusion portions 2405 in this state. Therefore, the trailing end dropping members 250A are in a state in which the engaged state with the reversing paddles 240A is cancelled, and are in a state of being positioned at the lower position by the positioning portions 2503.

As a result of this, even when the reversing paddles 240A have reached the returning position, the trailing end dropping members 250A do not move down further due to the engagement between the positioning portions 2503 and the upper guide 2101, and are positioned at the lower position. In such a state, as illustrated in FIG. 15B, the reversing paddles 240A and the trailing end dropping members 250A move to the returning position and the lower position, and the upper discharge rollers 230A are positioned at the home position.

To be noted, illustration of the projection portion 2504 and the positioning portion 2053 described above and illustrated in FIG. 16C is omitted in FIGS. 1 to 15B. The projection portion 2504 and the positioning portion 2053 configured in this manner may be omitted, and in this case, a different positioning mechanism may be provided to position the trailing end dropping members 250A at the lower position. For example, the positioning may be performed by engagement between the engagement recess portion 2502 and the second protrusion portion 2405 at the lower position.

Figure 16B:
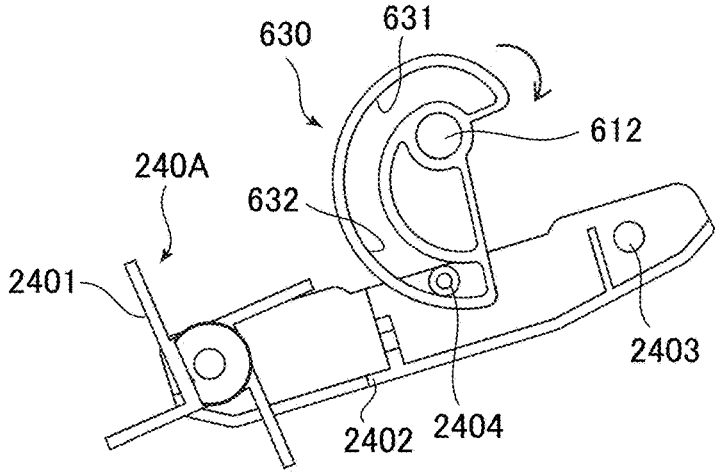
FIG. 16B is a diagram illustrating the state of the reversing paddle at the time of sheet reversing of the sheet processing apparatus according to the first embodiment as viewed in the width direction.
Figure 16C:
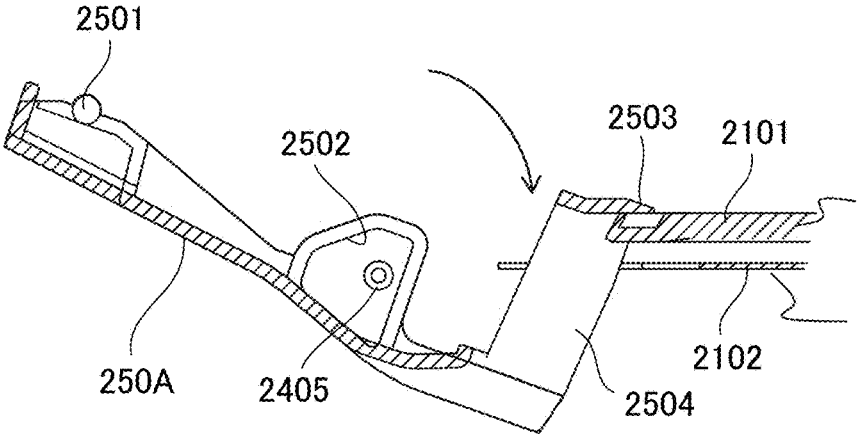
FIG. 16C is a diagram illustrating the state of the trailing end dropping member at the time of sheet reversing of the sheet processing apparatus according to the first embodiment as viewed in the width direction.

In the case of moving up the reversing paddles 240A and the trailing end dropping members 250A, the processing upper motor 610 is driven to rotate the rotation shaft 612 in the first direction (counterclockwise direction in FIGS. 16A and 16B). Then, the second cam members 630 rotate in the same direction together with the rotation shaft 612, the first protrusion portions 2404 move along the inner cam surfaces 632, and the reversing paddles 240A move up. At this time, the second protrusion portions 2405 engage with the engagement recess portions 2052 again slightly after the start of upward movement of the reversing paddles 240A, and the trailing end dropping members 250A also move up due to this engagement. That is, the reversing paddles 240A are capable of individually moving up by an amount corresponding to the gap between the second protrusion portions 2405 and the part of the engagement recess portions 2502 positioned above the second protrusion portions 2405 in a state in which the reversing paddles 240A are at the returning position, and the trialing end dropping members 250A are still at the lower position in a state in which the reversing paddles 240A have moved up by this amount corresponding to the gap. Further, if the second protrusion portions 2405 has moved up by the amount corresponding to the gap and engaged with the engagement recess portions 2502, the trailing end dropping members 250A start moving up in a manner delayed from the reversing paddles 240A. As a result of this, the reversing paddles 240A and the trailing end dropping members 250A return to the home position illustrated in FIGS. 10A to 11C.

Here, in the upper discharge rollers 230A, when returning from the state of FIG. 16A to the state of FIG. 11A, the protrusion portion 2303 moves along the inner cam surface 622 of the first cam member 620, but the inner cam surface 622 is formed such that the distance of the position where the inner cam surface 622 abuts against the protrusion portion 2303 from the center of the rotation shaft 612 does not change at this time. Therefore, the upper discharge rollers 230A are maintained at the home position.

In the present embodiment, when the rotation shaft 612 is rotated in the counterclockwise direction of FIGS. 11A to 11C from the home position, the upper discharge rollers 230A move down, and the reversing paddles 240A and the trailing end dropping members 250A are maintained at the home position. In contrast, when the rotation shaft 612 is rotated in the clockwise direction of FIGS. 11A and 11C from the home position, the upper discharge rollers 230A are maintained at the home position, and the reversing paddles 240A and the trailing end dropping members 250A move down.

In addition, when the rotation shaft 612 is rotated in the clockwise direction of FIGS. 14A to 14C in a state in which the upper discharge rollers 230A are at the nipping position illustrated in FIG. 14A, the upper discharge rollers 230A move up, and the reversing paddles 240A and the trailing end dropping members 250A are maintained at the home position. In contrast, when the rotation shaft 612 is rotated in the counterclockwise direction of FIGS. 16A to 16C in a state in which the reversing paddles 240A and the trailing end dropping members 250A are at the returning position and the lower position, the upper discharge rollers 230A are maintained at the home position, and the reversing paddles 240A and the trailing end dropping members 250A move up.

FIG. 17 illustrates the relationship between each motor and each component. The columns illustrated in FIG. 17 indicate, from the left side, the number, the name of the motor, the driven part, the operation, the operation direction at the time of normal rotation, and the operation direction at the time of reverse rotation. In FIG. 17, the processing upper motor MT12 is the processing upper motor 610 described above. As can be seen from FIG. 17, a conveyance motor MT11 drives either one roller of the upstream rollers (inlet rollers) 213*a* and 213*b*, either one roller of the pre-processing rollers 211A and 212A, the reversing paddles 240A, and the returning member 280.

In addition, the processing upper motor MT12 lifts and lowers the reversing paddles 240A, the trailing end dropping members 250A, and the upper discharge rollers (nipping members) 230A. Therefore, in the present embodiment, the processing upper motor MT12 corresponds to a moving portion that moves the upper discharge rollers 230A to the nipping position and the separated position (first separated position or second separated position). In the present embodiment, in addition to this, a returning lifting/lowering motor MT13 for lifting and lowering the returning member 280, a discharge roller motor MT14 for driving the lower discharge rollers 230B, a reversing motor (sheet pressor motor) MT15 for driving the discharged sheet reversing paddle (sheet pressing (bundle pressing) paddle) 320A, an F-side alignment plate moving motor MT16 for moving (laterally moving) the alignment plate 271A on the front side in the width direction, an R-side alignment plate moving motor MT17 for moving (laterally moving) the alignment plate 271A on the rear side in the width direction, an STP moving motor MT18 that moves the stapling unit (STP) 400 for changing the stapling position, an STP motor MT19 for driving the stapling unit 400 to staple the sheet bundle, and a stacking tray lifting/lowering motor MT20 that lifts and lowers the stacking tray 300 are provided.

Control Configuration of Sheet Processing Apparatus

Figure 18:
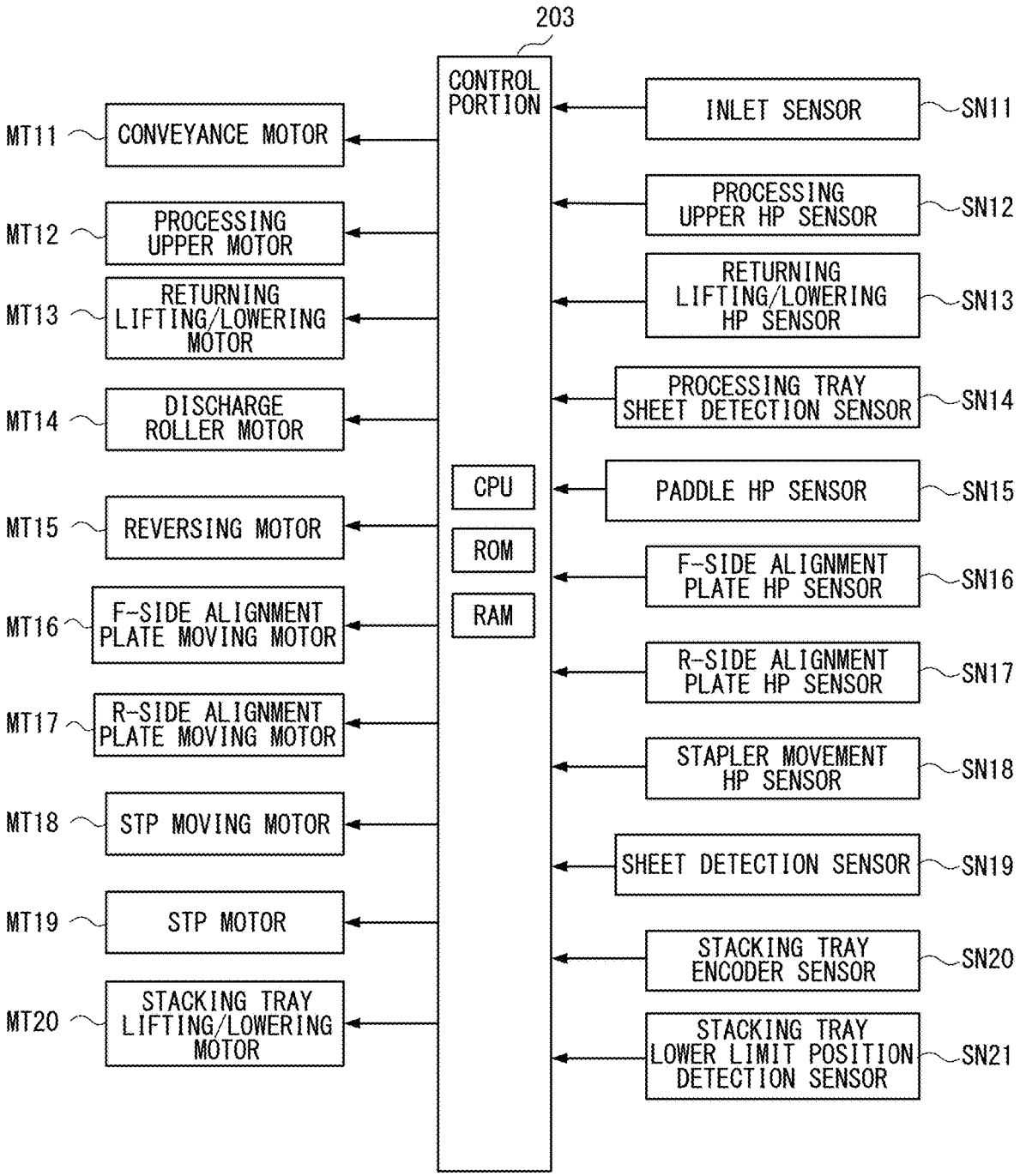
FIG. 18 is a block diagram illustrating a control configuration of the sheet processing apparatus according to the first embodiment.
Figure 19:
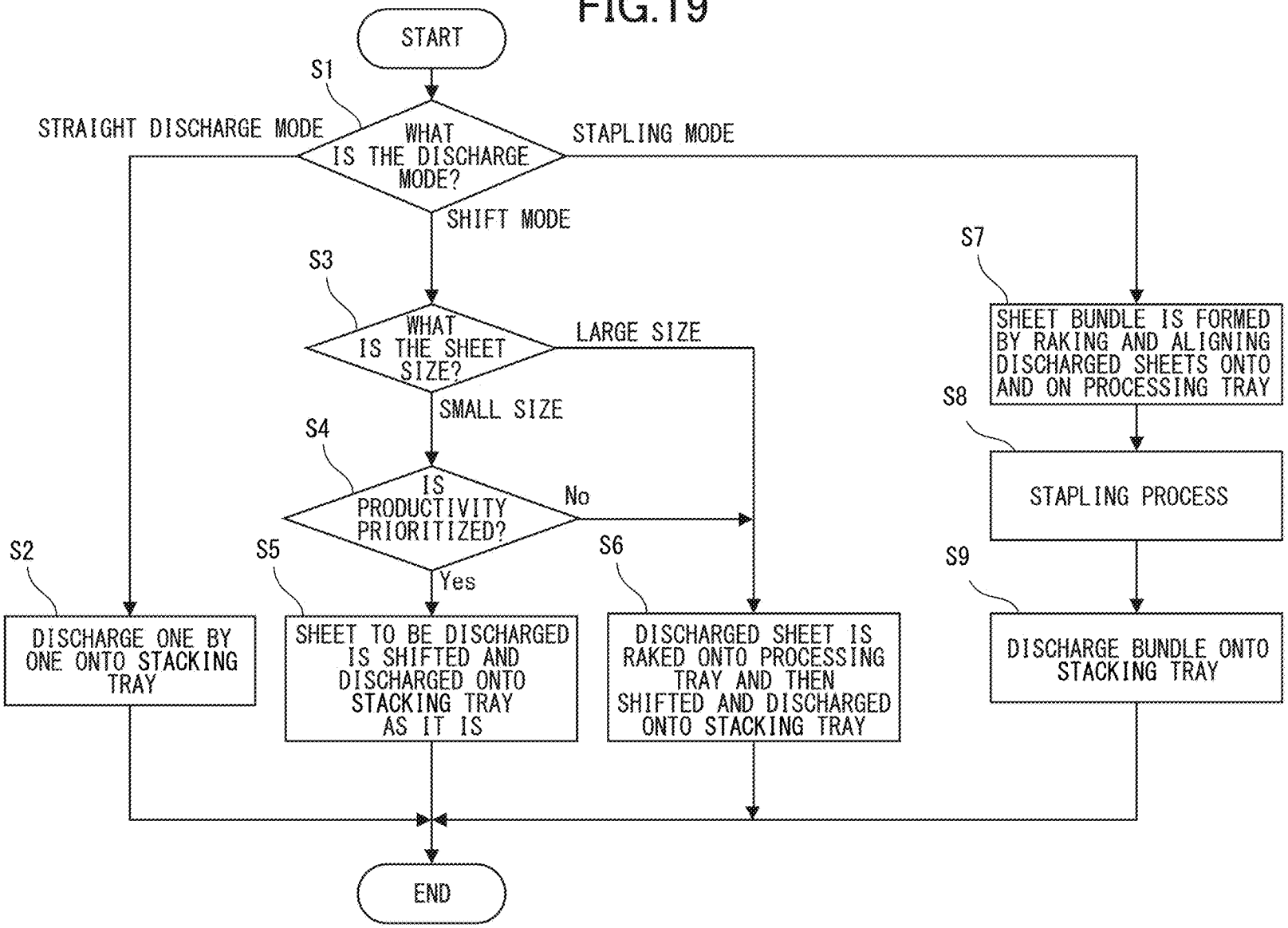
FIG. 19 is a flowchart illustrating an example of a control flow of the sheet processing apparatus according to the first embodiment.

The control configuration of the sheet processing apparatus 200 will be described with reference to FIGS. 18 and 19. FIG. 18 is a block diagram illustrating each motor and each sensor included in the sheet processing apparatus 200. The signal of each of these sensors is input to a control portion 203 serving as a control means, and each motor is controlled by the control portion 203. The control portion 203 is communicably connected to a control portion included in the image forming apparatus 100, and performs overall control of the sheet processing apparatus 200.

The control portion 203 configured in this manner includes a central processing unit (CPU), a read only memory (ROM), and a random access memory: RAM. The CPU controls each portion while reading out a program corresponding to a control procedure stored in the ROM. In addition, the RAM stores work data and input data, and the CPU performs control with reference to the data stored in the RAM on the basis of the program described above and the like.

Each motor illustrated in FIG. 18 is as described above. In contrast, each sensor will be described with reference to FIG. 2. First, an inlet sensor SN11 is provided in the conveyance path 210A, and detects the leading end of the sheet conveyed to the conveyance path 210A. A processing upper HP sensor SN12 detects the home position of the reversing paddles 240A, the trailing end dropping members 250A, and the upper discharge rollers (nipping members) 230A. A returning lifting/lowering HP sensor SN13 detects the home position of the returning member 280 (position retracted from the processing tray 220). A processing tray sheet detection sensor SN14 detects the presence or absence of the sheet on the processing tray 220. A paddle HP sensor (a sheet pressor HP sensor) SN15 detects the home position of the discharged sheet reversing paddle 320A.

An F-side alignment plate HP sensor SN16 and an R-side alignment plate HP sensor SN17 respectively detect the alignment plate 271A on the front side and the alignment plate 271A on the rear side being at positions (home positions) separated from the sheet placed on the processing tray 220 in the width direction. A stapler movement HP sensor SN18 detects the stapling unit 400 being at the home position. A sheet detection sensor SN19 detects the uppermost sheet placed on the stacking tray 300. A stacking tray encoder sensor SN20 detects the position of the stacking tray 300 in a lifting/lowering direction. A stacking tray lower limit position detection sensor SN21 detects the lower limit position of the stacking tray 300. The control portion 203 performs each control described later on the basis of the signal of each of these sensors.

Next, the flow of control of each mode of the present embodiment will be described with reference to FIG. 19. In the present embodiment, a straight discharge mode in which the sheet delivered to the sheet processing apparatus 200 is discharged onto the stacking tray 300 as it is without performing the predetermined process, a shift mode in which the sheet delivered to the sheet processing apparatus 200 is discharged onto the stacking tray 300 after being moved in the width direction (shifting operation) to classify the sheet discharged onto the stacking tray 300, and a stapling mode in which the sheet delivered to the sheet processing apparatus 200 is subjected to stapling as the predetermined process and then discharged onto the stacking tray 300 are provided. Each of these modes is selected by a user through an operation panel of the image forming apparatus 100 or a PC connected via a network or the like.

In the present embodiment, a manual mode setting by a user and an automatic setting according to the sheet type (sheet length) are possible, and which of the two shift discharge processes (switchbackless shift discharge process and switchback shift discharge process) that will be described later is selected in the shift mode can be appropriately set in accordance with the final product desired by the user.

Figure 31A:
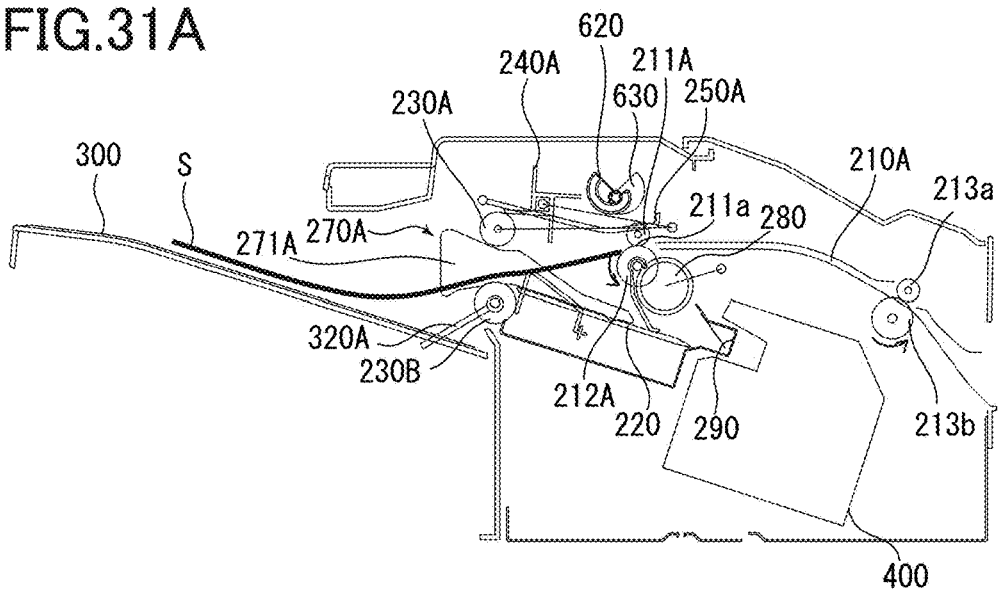
FIG. 31A is a schematic configurational section view of the sheet processing apparatus in the binding discharge process according to the first embodiment illustrating a state in which a sheet has been conveyed.
Figure 31B:
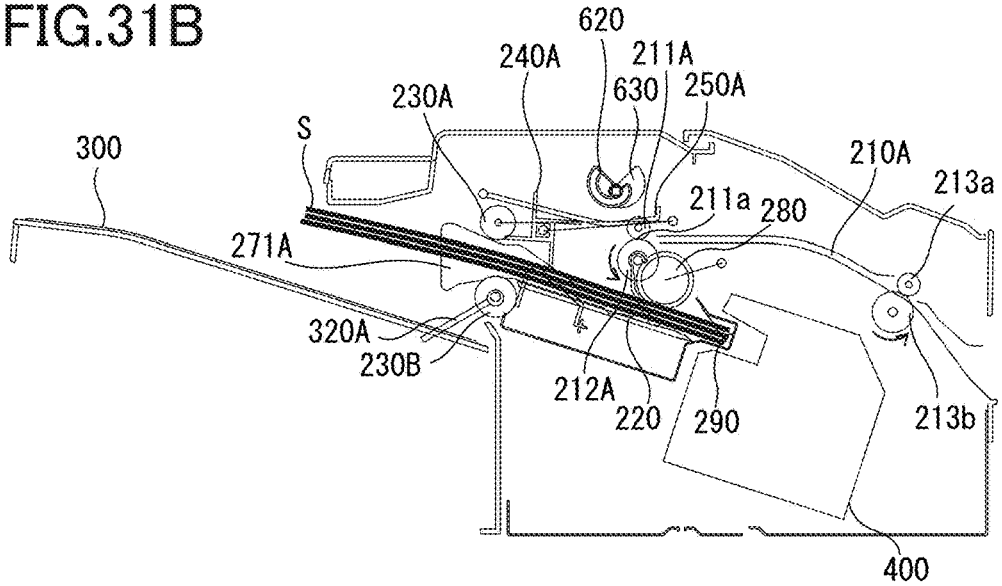
FIG. 31B is a schematic configurational section view of the sheet processing apparatus in the binding discharge process according to the first embodiment illustrating a state in which a sheet bundle is formed and aligned on the processing tray.
Figure 31C:
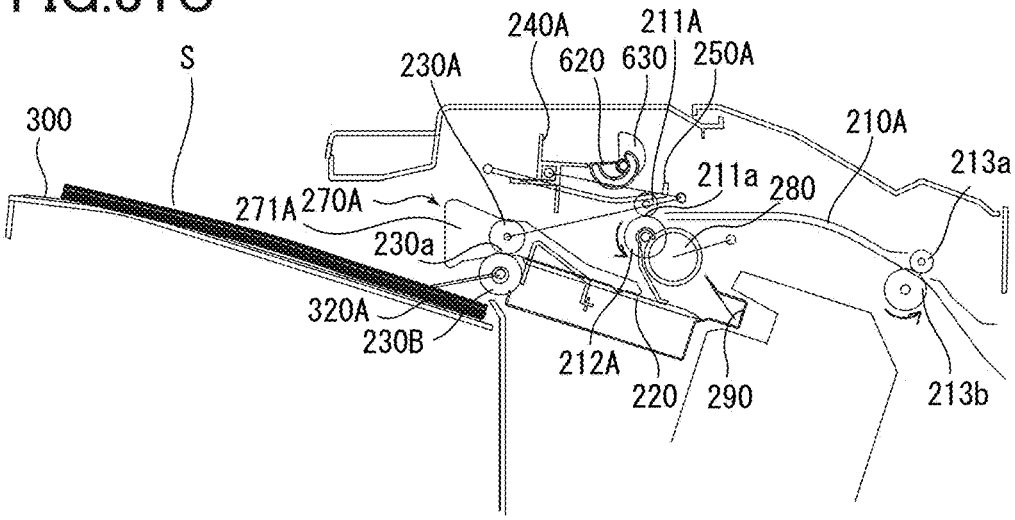
FIG. 31C is a schematic configurational section view of the sheet processing apparatus in the binding discharge process according to the first embodiment illustrating a state in which the sheet bundle subjected to a binding process has been discharged onto a stacking tray.

In the stapling mode serving as a binding discharge process, as illustrated in FIGS. 31A to 31C, the sheet S (FIG. 31A) conveyed downstream in the first conveyance direction by the pre-processing rollers 211A and 212A is conveyed in the second conveyance direction on the processing tray 220 by the reversing paddles 240A, and thus the downstream edge (trailing end) of the sheet in the second conveyance direction is caused to abut against the trailing end regulating member 290, that is, the trailing end of the sheet is regulated. Then, by driving the alignment portion 270A (pair of alignment plates 271A) by the F-side alignment plate moving motor MT16 and the R-side alignment plate moving motor MT17, the sheet caused to abut against the trailing end regulating member 290 by the alignment portion 270A is moved in the sheet width direction, and is positioned at the binding position. That is, an alignment process is performed. In the present embodiment, alignment is performed by hitting the sheet from both sides in the sheet width direction by using the pair of alignment plates 271A and 271B in center alignment. By repeating the operation of regulating the trailing end of the sheet and the alignment process described above, a sheet bundle is formed on the processing tray 220 (FIG. 31B). Then, the stapling process is performed on the sheet bundle positioned at the binding position, and the sheet bundle subjected to the stapling process is discharged onto the stacking tray 300 by the upper discharge rollers 230A and the lower discharge rollers 230B (FIG. 31C). In the shift mode described below, a shifting operation is performed for a sheet not subjected to the binding process, by using the pair of alignment plates 271A and 271B, the F-side alignment plate moving motor MT16, and the R-side alignment plate moving motor MT17 that are used in the alignment process for formation of the sheet bundle in the stapling mode.

In addition, in the shift mode, there are a case of performing a shifting operation on a sheet (first sheet, sheet of a small size) whose length in the conveyance direction of the sheet (first conveyance direction) is a first length, and a case of performing a shifting operation on a sheet (second sheet, sheet of a large size) whose length in the first conveyance direction is a second length larger than the first length. The sheet of a small size is, for example, a sheet whose length in the first conveyance direction is equal to or less than a predetermined length, and the sheet of a large size is, for example, a sheet whose length in the first conveyance direction is larger than the predetermined length. The predetermined length is, for example, a size of so-called A4 longitudinal in which a paper sheet of the A4 size is conveyed in the longitudinal direction (direction in which the longitudinal direction is the conveyance direction). In addition, in the shift mode, a productivity-prioritized mode in which the productivity is prioritized, and an alignment-prioritized mode in which alignment of the sheet is prioritized can be selected and executed. In addition, in either of the shift modes, the sheet can be shifted in both a direction from the rear side to the front side and a direction from the front side to the rear side (both directions are shift directions).

The productivity-prioritized mode as the switchbackless shift discharge process is a mode in which the sheet conveyed downstream in the first conveyance direction by the pre-processing rollers 211A and 212A subjected to a switchbackless shift operation and is discharged onto the stacking tray 300 by the upper discharge rollers 230A and the lower discharge rollers 230B. In the switchbackless shift operation, the sheet is moved (shifted) in the shift direction by the alignment portion 270A (pair of alignment plates 271A) by driving the F-side alignment plate moving motor MT16 and the R-side alignment plate moving motor MT17 without performing the conveyance in the second conveyance direction by the reversing paddles 240A.

The alignment-prioritized mode as the switchback shift discharge process is a mode in which the sheet conveyed downstream in the first conveyance direction by the pre-processing rollers 211A and 212A is subjected to a switchback shift operation, and is discharged onto the stacking tray 300 by the upper discharge rollers 230A and the lower discharge rollers 230B. In the switchback shift operation, the sheet is conveyed in the second conveyance direction on the processing tray 220 by the reversing paddles 240A to cause (regulate) the downstream edge of the sheet in the second conveyance direction to abut against the trailing end regulating member 290, and is then moved (shifted) in the shift direction by the alignment portion 270A (pair of alignment plates 271A) by driving the F-side alignment plate moving motor MT16 and the R-side alignment plate moving motor MT17 without performing the stapling process by the stapling unit 400.

When the control is started, the control portion 203 determines which of the straight discharge mode, the shift mode, and the stapling mode is selected as the discharge mode (S1). In the case where the straight discharge mode is selected, sheets conveyed to the sheet processing apparatus 200A are discharged one by one onto the stacking tray 300 as they are without performing the predetermined process (S2).

In S1, in the case where the shift mode is selected, whether the sheet size is a sheet of a large size or a sheet of a small size is determined (S3). In the case of the small size, whether or not the productivity is prioritized is determined (S4). In the case where the productivity is prioritized, the sheet discharged from the conveyance path 210A is discharged onto the stacking tray 300 by performing the shifting operation by the alignment portion 270A without conveyance in the second conveyance direction on the processing tray 220 (S5). In the case where the productivity is not prioritized in S4, the sheet discharged from the conveyance path 210A is raked onto the processing tray 220, is subjected to the shifting operation on the processing tray 220 by the alignment portion 270A, and is discharged onto the stacking tray 300 (S6). In the case of the sheet of the large size in S3, the process also proceeds to S6.

In the case where the stapling mode is selected in S1, the sheet discharged from the conveyance path 210A is conveyed in the second conveyance direction on the processing tray 220 by the reversing paddles 240A, and the downstream edge of the sheet in the second conveyance direction is caused to abut against the trailing end regulating member 290. That is, the trialing end of the sheet is regulated. Then, after regulating the trailing end of the sheet, the positioning (alignment) at the binding position is performed by the alignment portion 270A (pair of alignment plates 271A) by driving the F-side alignment plate moving motor MT16 and the R-side alignment plate moving motor MT17. By repeating the operation of trailing-end regulation and alignment of the sheet described above, a sheet bundle is formed on the processing tray 220 (S7). Then, the stapling process is performed on the sheet bundle (S8). Then, the sheet bundle subjected to the stapling process is discharged onto the stacking tray 300 (S9).

Switchbackless Shift Discharge Process (Productivity-Prioritized Mode)

The operation of the sheet processing apparatus 200 in the switchbackless shift discharge process among the two shift discharge processes described above will be described. In the switchbackless shift discharge process of the present embodiment, first, the sheet is conveyed in the first conveyance direction by the pre-processing rollers 211A and 212A. Next, when the downstream end (leading end) in the first conveyance direction of the sheet conveyed in the first conveyance direction by the pre-processing rollers 211A and 212A has passed through the gap between the upper discharge rollers 230A and the lower discharge rollers 230B (pair of discharge rotary members) and the upstream end (trailing end) in the first conveyance direction of this sheet has passed the pre-processing rollers 211A and 212A in a state in which the upper discharge rollers 230A and the lower discharge rollers 230B are at the first separated position, this sheet is nipped by the pair of alignment plates 271A and 271B without conveying this sheet in the second conveyance direction by the reversing paddles 240A. By moving the pair of alignment plates 271A and 271B in the shift direction that is one of the two directions in the width direction, a shift operation of moving the position of the sheet in the shift direction is performed. Next, after this shift operation, the pair of alignment plates 271A and 271B are retracted in the width direction from the sheet subjected to the shift operation, the upper discharge rollers 230A and the lower discharge rollers 230B are moved to the nipping position, and then the sheet is discharged onto the stacking tray 300 by the upper discharge rollers 230A and the lower discharge rollers 230B.

Figure 20A:
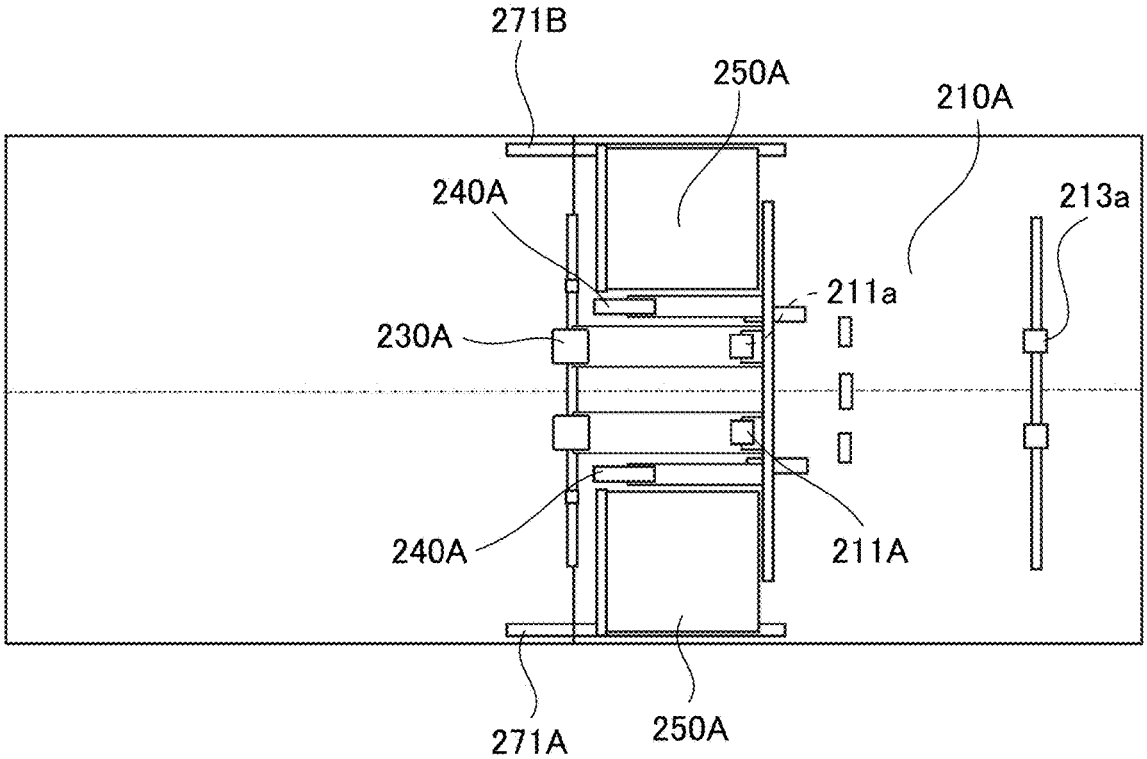
FIG. 20A is a schematic diagram illustrating a main part of the sheet processing apparatus at the home position in a switchbackless shift discharge process according to the first embodiment as viewed from above.
Figure 20B:
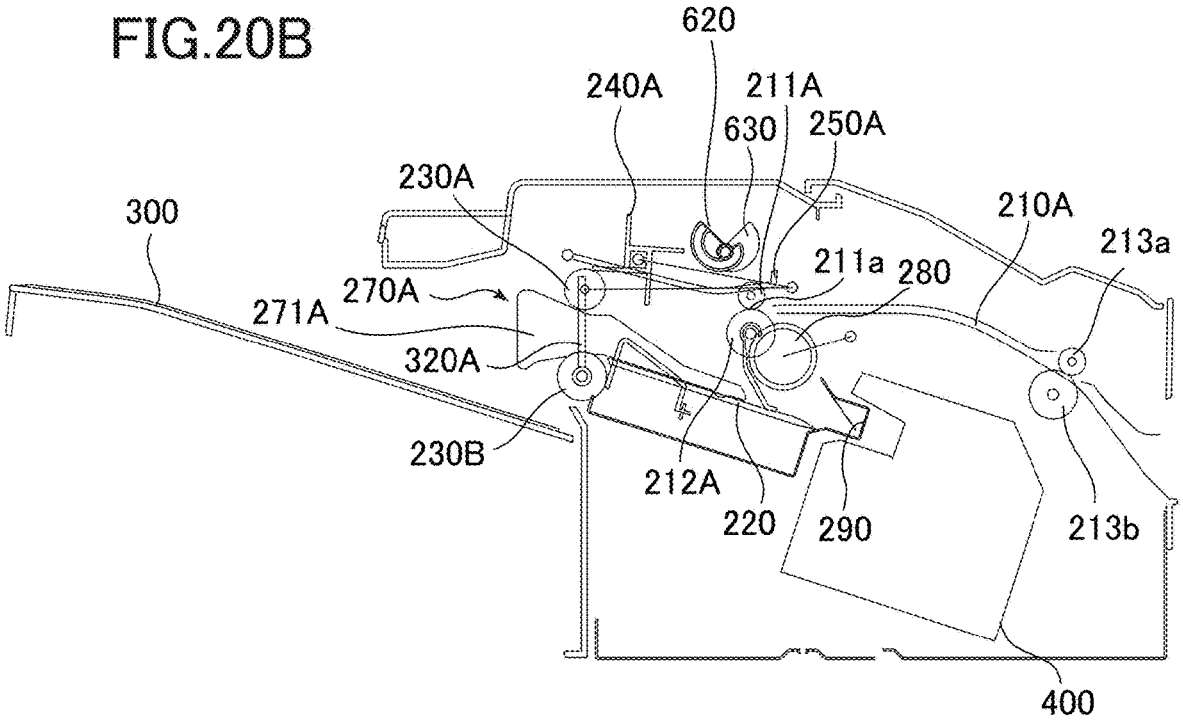
FIG. 20B is a schematic configurational section view of the sheet processing apparatus at the home position in the switchbackless shift discharge process according to the first embodiment.

The switchbackless shift discharge process will be described in more detail with reference to FIGS. 20A to 28B. As illustrated in FIGS. 20A and 20B, in a state in which the sheet S is not conveyed to the conveyance path 210A yet, the upper discharge roller 230A, the reversing paddles 240A and the trailing end dropping members 250A are each positioned at the home position. Particularly, the upper discharge rollers 230A and the lower discharge rollers 230B are at the first separated position in this state. In addition, the pair of alignment plates 271A and 271B are positioned at the home position where the pair of alignment plates 271A and 271B are the most separated from each other.

Figure 21A:
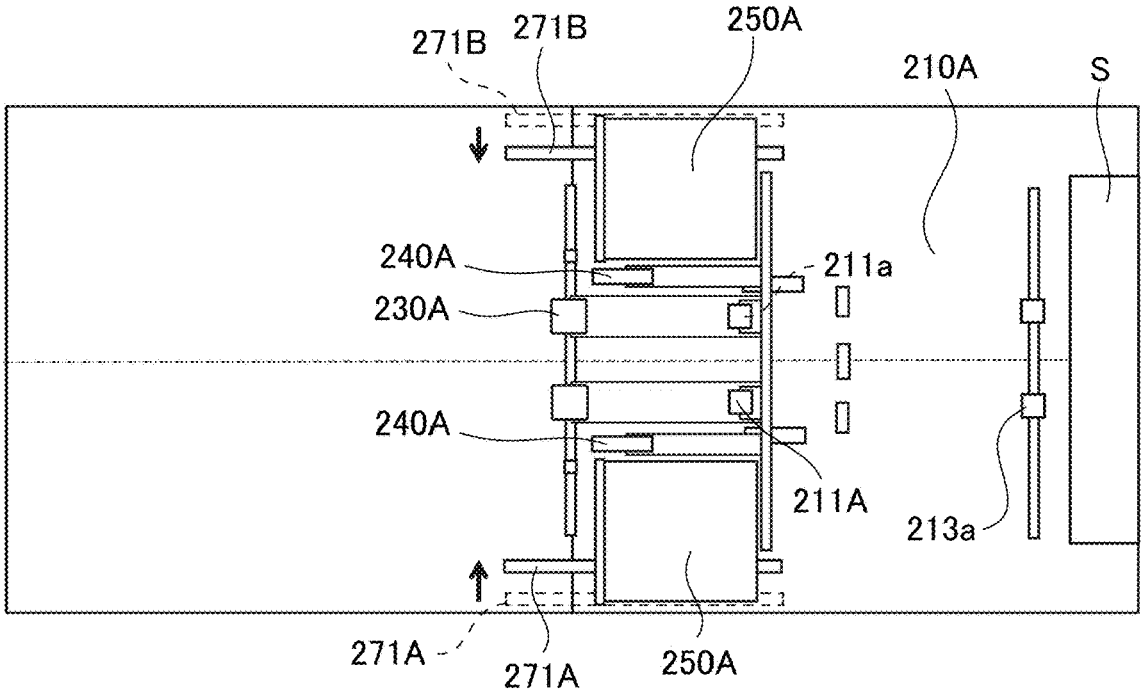
FIG. 21A is a schematic diagram illustrating the main part of the sheet processing apparatus at the time of sheet reception in the switchbackless shift discharge process according to the first embodiment as viewed from above.
Figure 21B:
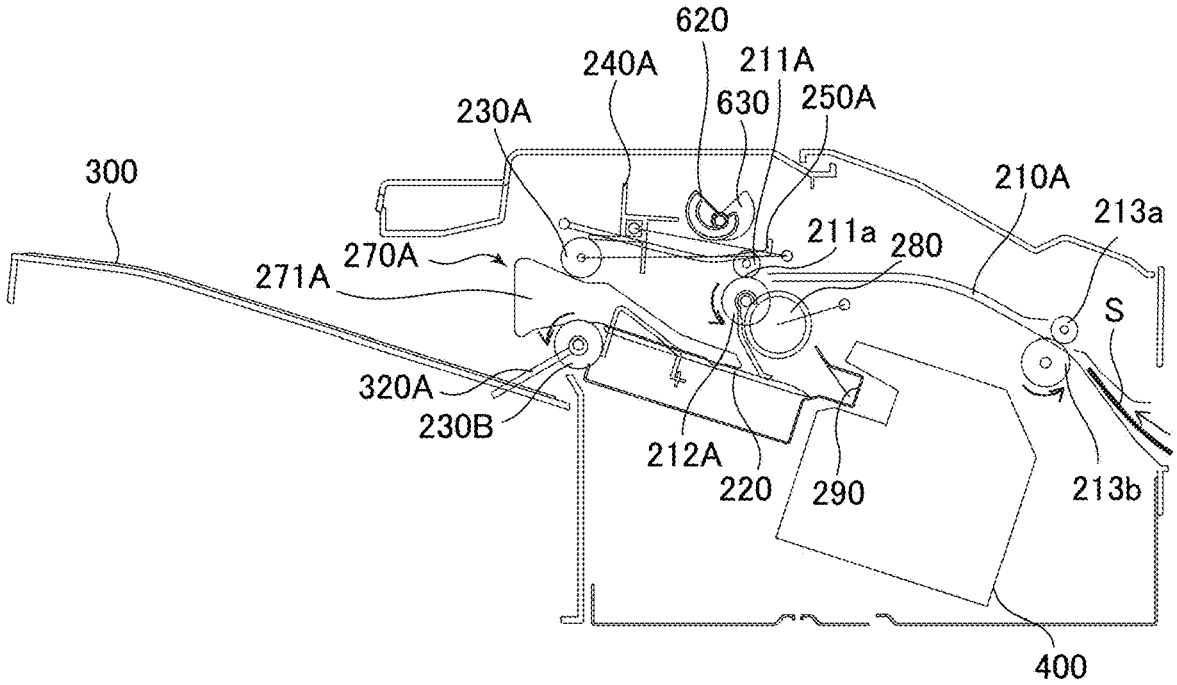
FIG. 21B is a schematic configurational section view of the sheet processing apparatus at the time of sheet reception in the switchbackless shift discharge process according to the first embodiment.

Next, as illustrated in FIGS. 21A and 21B, in a state in which the sheet S is conveyed to the entrance of the conveyance path 210A, the pair of alignment plates 271A and 271B move from the home position to be closer to each other, and stand by at a receiving position for receiving the sheet S. In addition, also in this state, the upper discharge rollers 230A, the reversing paddles 240A, and the trailing end dropping members 250A are each at the home position.

Figure 22A:
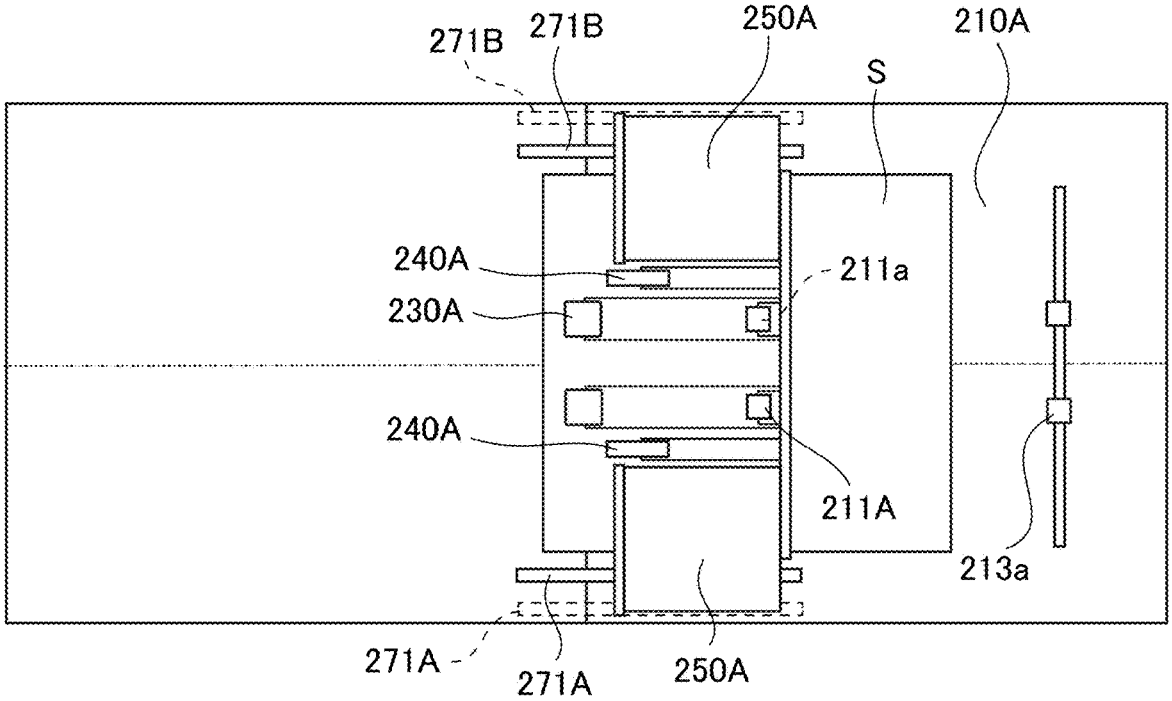
FIG. 22A is a schematic diagram illustrating the main part of the sheet processing apparatus at the time of lowering the upper discharge roller in the switchbackless shift discharge process according to the first embodiment as viewed from above.
Figure 22B:
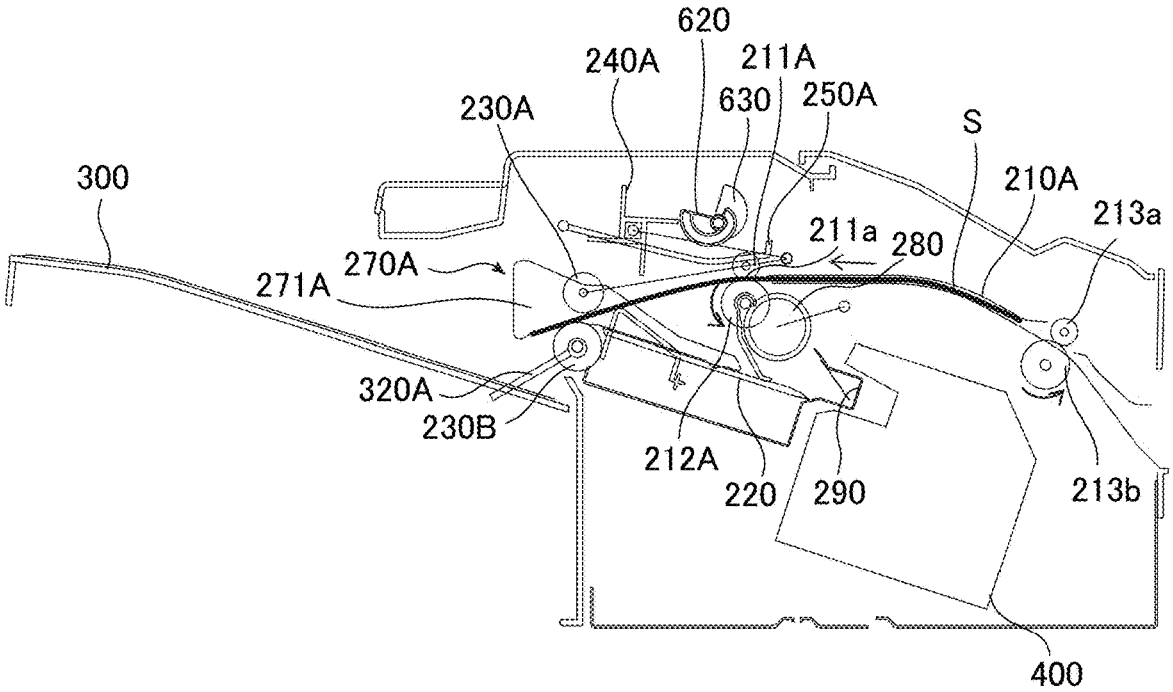
FIG. 22B is a schematic configurational section view of the sheet processing apparatus at the time of lowering the upper discharge roller in the switchbackless shift discharge process according to the first embodiment.

Next, when the downstream end (leading end) in the first conveyance direction of the sheet S has passed pre-processing nip portion 211*a* between the pre-processing rollers 211A and 212A and further the leading end of the sheet S has passed through the gap between the upper discharge rollers 230A and the lower discharge rollers 230B in a state in which the upper discharge rollers 230A and the lower discharge rollers 230B are at the first separated position, the upper discharge rollers 230A are moved to the second separated position as illustrated in FIGS. 22A and 22B. The relationship between the first separated position and the second separated position is as described above with reference to FIGS. 4 and 5, and the second separated position is a position to which the upper discharge rollers 230A are further moved down from the first separated position. At this time, the reversing paddles 240A and the trailing end dropping members 250A are still at the home position.

Figure 23A:
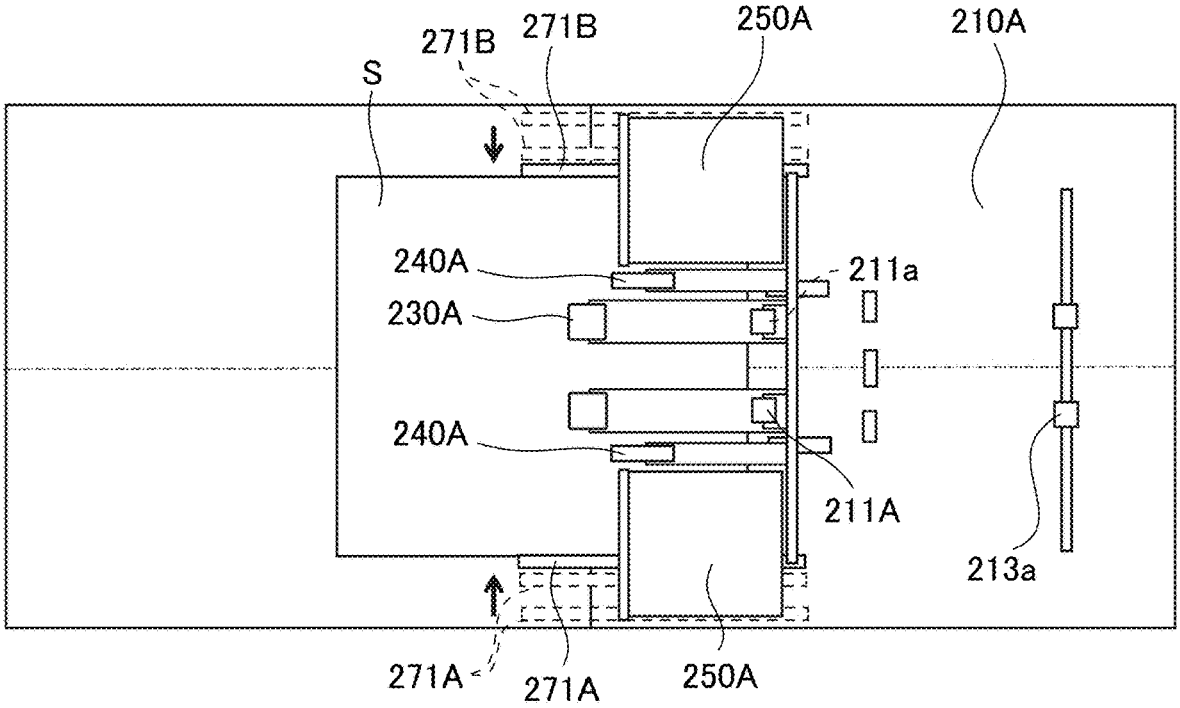
FIG. 23A is a schematic diagram illustrating the main part of the sheet processing apparatus at the time of moving the alignment plates in the switchbackless shift discharge process according to the first embodiment as viewed from above.
Figure 23B:
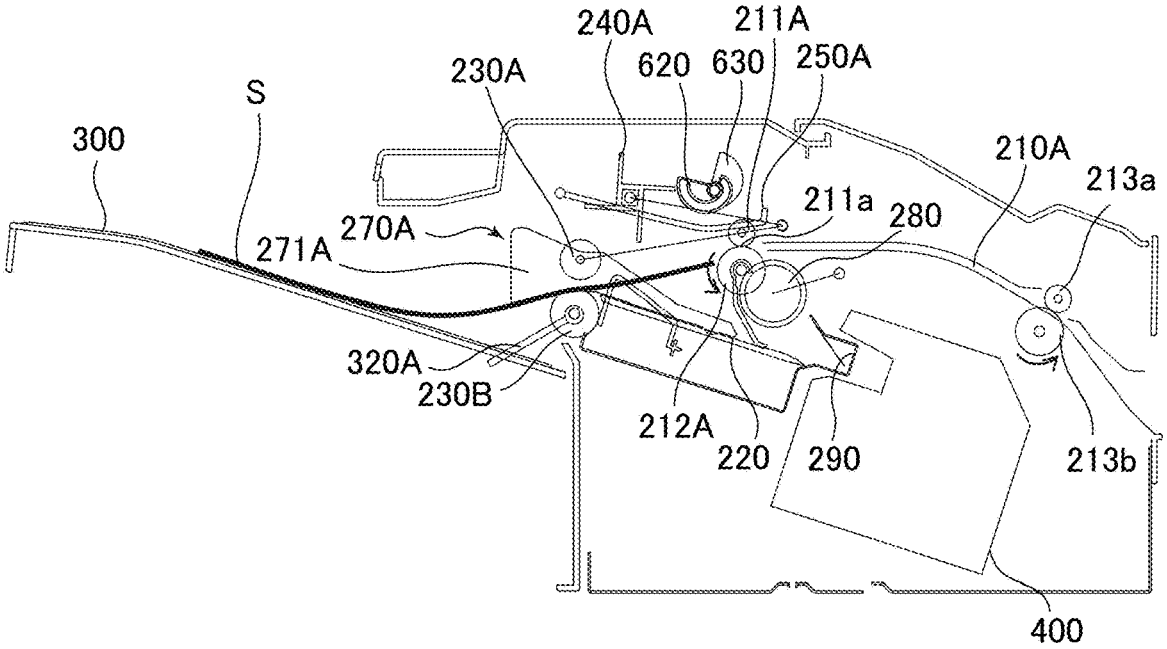
FIG. 23B is a schematic configurational section view of the sheet processing apparatus at the time of moving the alignment plates in the switchbackless shift discharge process according to the first embodiment.

Next, when the upstream end (trailing end) in the first conveyance direction of the sheet S has passed pre-processing nip portion 211*a* between the pre-processing rollers 211A and 212A as illustrated in FIGS. 23A and 23B in a state in which the upper discharge rollers 230A are positioned at the second separated position, the sheet S is nipped between the pair of alignment plates 271A and 271B in a state in which the sheet S is moved in the first conveyance direction without raking in this sheet S by the reversing paddles 240A. That is, the pair of alignment plates 271A and 271B are moved to a position (nipping position) in the width direction matching the size of the sheet S, and the sheet S is nipped from the two sides in the width direction (two sides in the shift direction) by the pair of alignment plates 271A and 271B. The timing at which the pair of alignment plates 271A and 271B start moving may be before or after the trailing end of the sheet S passes the pre-processing nip portion 211*a* as long as the trailing end of the sheet S has passed the pre-processing nip portion 211*a* when the pair of alignment plates 271A and 271B nip the sheet S.

In addition, in the case of the present embodiment, the movement speed of the pair of alignment plates 271A and 271B can be changed. Specifically, the movement speed of the pair of alignment plates 271A and 271B is made different between a case of moving the pair of alignment plates 271A and 271B to nip the sheet S in the switchbackless shift discharge process and a case of shifting the sheet, by changing the driving speed of the F-side alignment plate moving motor MT16 and the R-side alignment plate moving motor MT17. In the present embodiment, the movement speed at which the F-side alignment plate moving motor MT16 and the R-side alignment plate moving motor MT17 move the pair of alignment plates 271A and 271B from the receiving position to the nipping position for nipping the sheet when the pair of alignment plates 271A and 271B nip the sheet S whose trailing end has passed the pre-processing nip portion 211*a* without conveying the sheet S in the second conveyance direction by the reversing paddles 240A and in a state in which the sheet S is moved in the first conveyance direction is made lower than the moving speed at which the F-side alignment plate moving motor MT16 and the R-side alignment plate moving motor MT17 move the pair of alignment plates 271A and 271B when performing the shift operation. For example, the movement speed for nipping the sheet S by the pair of alignment plates 271A and 271B is set to 261 mm/sec, and the movement speed in the shift operation is set to 313 mm/sec.

This is because if the movement speed for nipping the sheet S by the pair of alignment plates 271A and 271B is high, the pair of alignment plates 271A and 271B abut against edges of the sheet S strongly, and this can skew the sheet S. In contrast, in the shift operation, the movement speed of the pair of alignment plates 271A and 271B is increased to improve the productivity. To be noted, the movement speed of the pair of alignment plates 271A and 271B in the shift operation may be set to be equal to the movement speed for nipping the sheet S by the pair of alignment plates 271A and 271B.

In addition, when nipping the sheet S by the pair of alignment plates 271A and 271B, the movement speed of the alignment plate 271A on the front side is set to be equal to the movement speed of the alignment plate 271B on the rear side. Further, after the sheet S is nipped by the pair of alignment plates 271A and 271B, the pair of alignment plates 271A and 271B are simultaneously moved in the shift direction, and thus the shift operation is performed. To be noted, in the present embodiment, the movement start timing of the alignment plates 271A and 271B when nipping the sheet S by the pair of alignment plates 271A and 271B is set to be different from each other. Specifically, in the case of shifting the sheet to the front side, the alignment plate 271A on the front side is moved after moving the alignment plate 271B on the rear side first.

As described above, in the present embodiment, the alignment plate 271A on the front side is urged to the rear side by the urging spring 2714 (see FIGS. 7 to 8B). Therefore, by moving the alignment plate 271B on the rear side first as described above, the alignment plate 271B on the rear side not provided with an urging spring abuts against the sheet first, and then the alignment plate 271A on the front side provided with the urging spring 2714 abuts against the sheet. As a result of this, the force of the pair of alignment plates 271A and 271B nipping the sheet can be efficiently absorbed by the urging spring 2714, and thus the alignment of the sheet can be improved. If the alignment plate 271A on the front side provided with the urging spring is caused to abut against the sheet first, the sheet will be quickly moved to the rear side by the urging force of the urging spring 2714, which can disturb the alignment of the sheet. Therefore, in the present embodiment, the alignment plate not provided with an urging spring is moved first to abut against the sheet first.

Here, in the case of the present embodiment, the pair of alignment plates 271A and 271B are each 10 mm from the corresponding one of the two end portions of the sheet at the receiving position. Further, when moving the pair of alignment plates 271A and 271B to the nipping position to nip the sheet, the alignment plate 271B on the rear side is moved to the front side by 10 mm, and the alignment plate 271A on the front side is moved to the rear side by 10.5 mm. Then, the sheet is aligned by pushing the sheet to the rear side by the alignment plate 271A on the front side when nipping the sheet by the pair of alignment plates 271A and 271B. At this time, the reaction force from the sheet when the alignment plate 271A on the front side pushes the sheet is absorbed by the urging spring 2714, and therefore warpage of the sheet can be suppressed. The alignment plate 271A on the front side moves to the rear side by 10.5 mm to push the sheet, and then returns to the front side by 0.5 mm. As a result of this, the pair of alignment plates 271A and 271B are positioned at the nipping position in a state in which the sheet is nipped and aligned therebetween.

In the present embodiment, the movement amount when nipping the sheet by the pair of alignment plates 271A and 271B is made to differ as described above between the side provided with an urging spring and the side not provided with an urging spring, the movement amount may be the same for these. That is, the movement amount of the front side may be set to be the same as the movement amount of the rear side.

To be noted, the alignment plate on the rear side may be provided with an urging spring, and the alignment plate on the front side not provided with an urging spring may be caused to abut against the sheet first. In addition, in the switchback shift discharge process, the sheet is subjected to the shift operation on the processing tray 220, but when nipping the sheet by the pair of alignment plates 271A and 271B to perform the shift operation, the same operation as described above is performed. In addition, in both of the switchbackless shift discharge process and the switchback shift discharge process, when nipping the sheet by the pair of alignment plates 271A and 271B, the pair of alignment plates 271A and 271*b* may be moved approximately simultaneously to abut against the sheet approximately simultaneously. Also in this case, the disturbance at the time of aligning the sheet is less likely to occur than in the case where the alignment plate provided with an urging spring abuts against the sheet first.

Figure 24A:
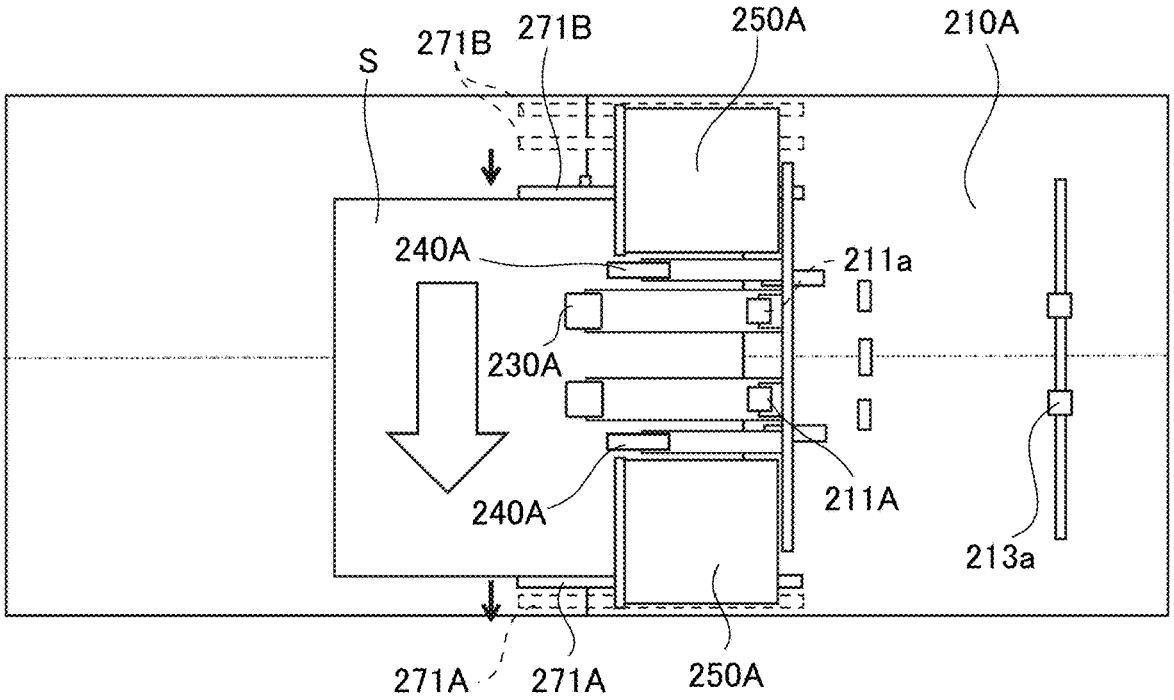
FIG. 24A is a schematic diagram illustrating the main part of the sheet processing apparatus at the time of shifting a sheet by the alignment plates in the switchbackless shift discharge process according to the first embodiment as viewed from above.
Figure 24B:
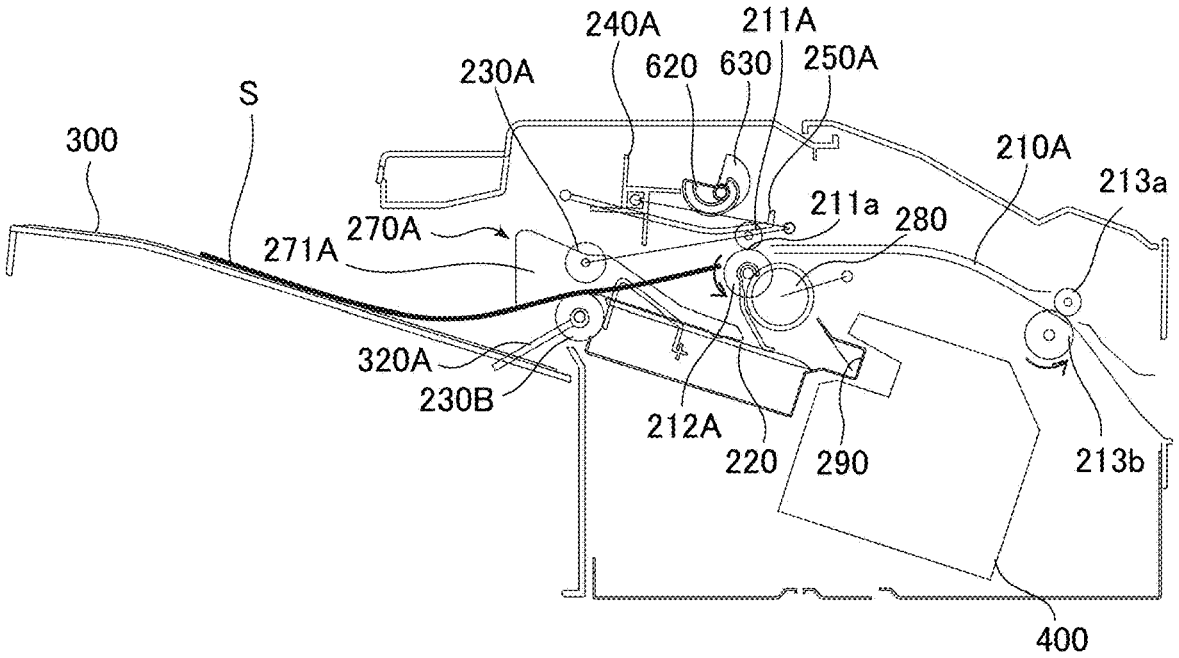
FIG. 24B is a schematic configurational section view of the sheet processing apparatus at the time of shifting a sheet by the alignment plates in the switchbackless shift discharge process according to the first embodiment.
Figure 25A:
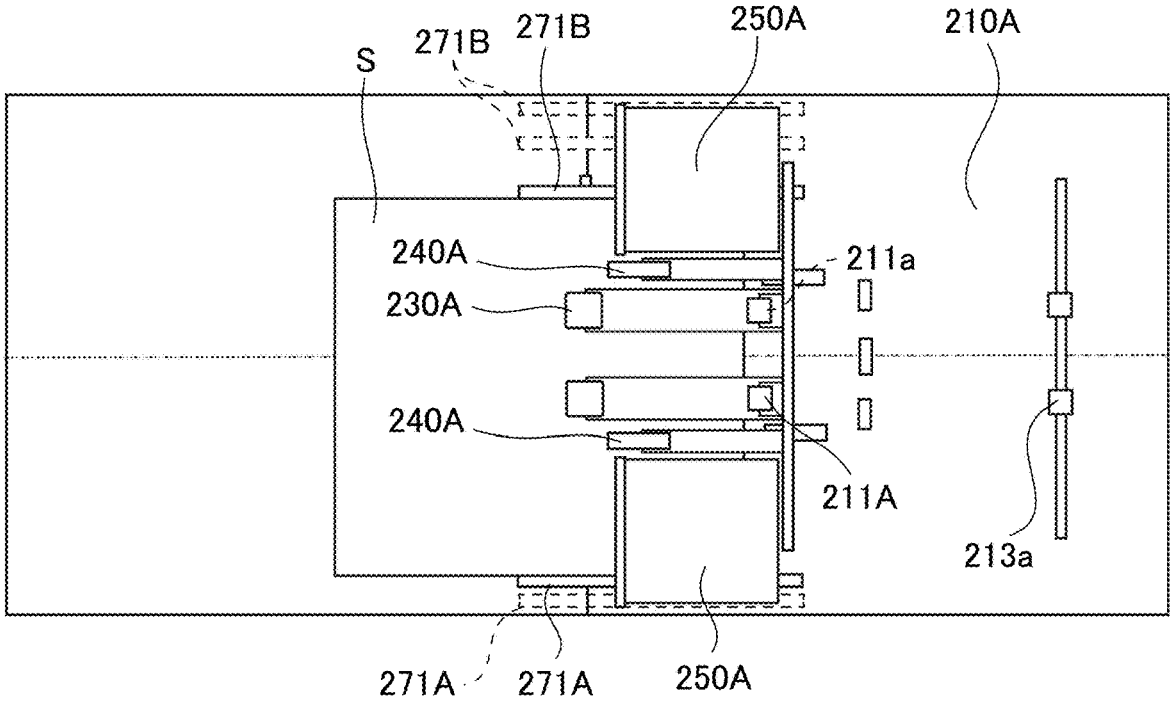
FIG. 25A is a schematic diagram illustrating the main part of the sheet processing apparatus when the shift of the sheet is completed in the switchbackless shift discharge process according to the first embodiment as viewed from above.
Figure 25B:
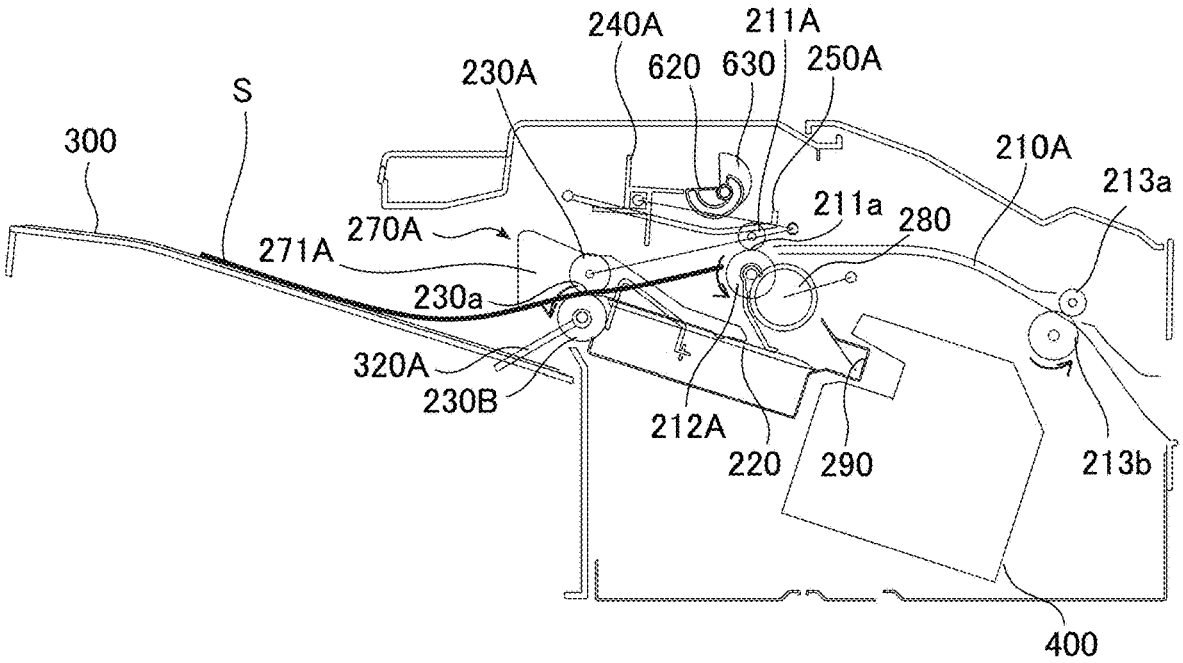
FIG. 25B is a schematic configurational section view of the sheet processing apparatus when the shift of the sheet is completed in the switchbackless shift discharge process according to the first embodiment.
Figure 26A:
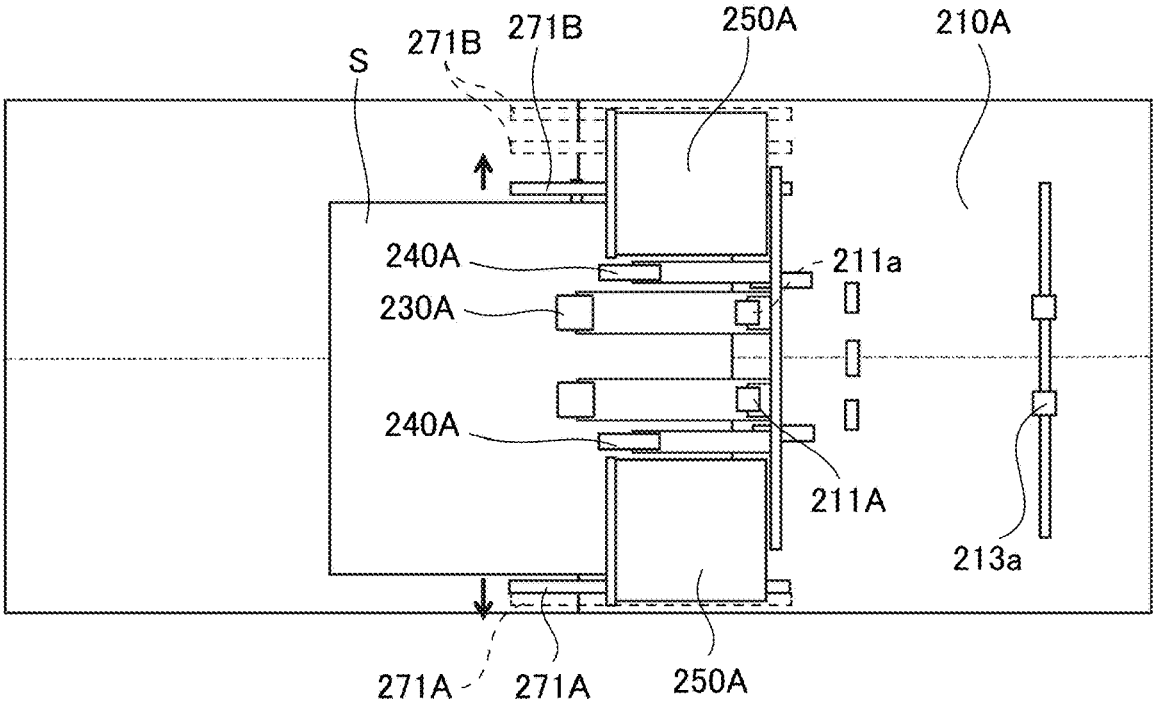
FIG. 26A is a schematic diagram illustrating the main part of the sheet processing apparatus when the alignment plates are retracted in the switchbackless shift discharge process according to the first embodiment as viewed from above.
Figure 26B:
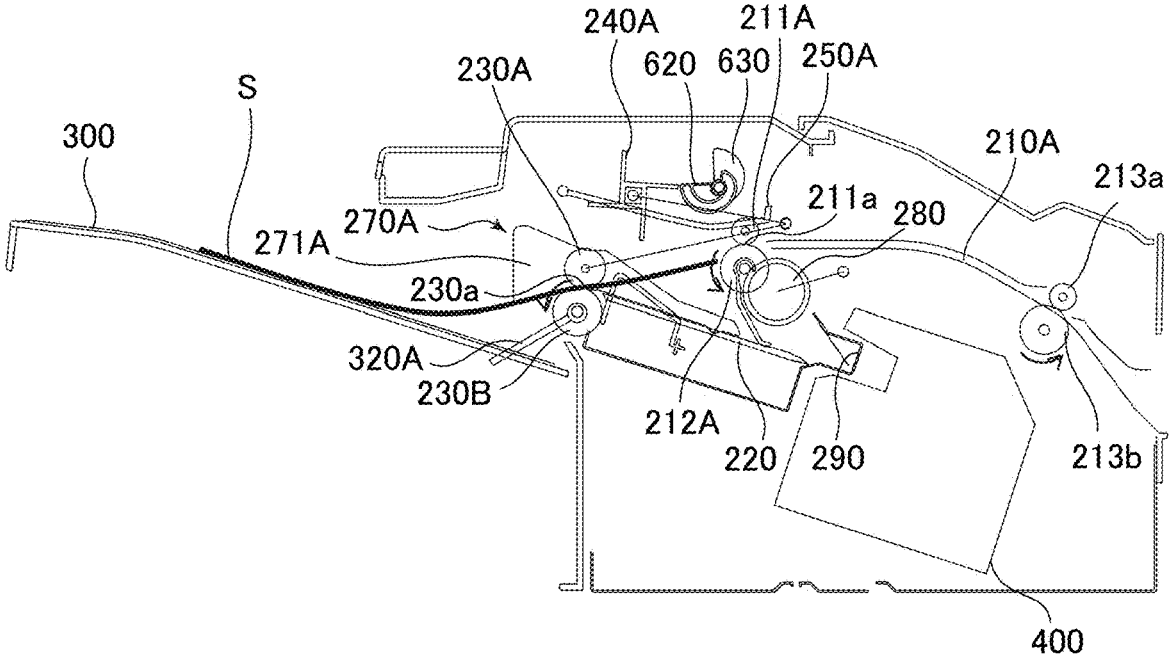
FIG. 26B is a schematic configurational section view of the sheet processing apparatus when the alignment plates are retracted in the switchbackless shift discharge process according to the first embodiment.

After the sheet S is nipped by the pair of alignment plates 271A and 271B as described above, the sheet S is moved in the shift direction in the state of being nipped by the pair of alignment plates 271A and 271B as illustrated in FIGS. 24A and 24B. That is, the shift operation is performed. After the completion of the shift operation, as illustrated in FIGS. 25A and 25B, the upper discharge rollers 230A are moved down to the nipping position, and the sheet S is nipped by the upper discharge rollers 230A and the lower discharge rollers 230B. After the sheet S is nipped by the upper discharge rollers 230A and the lower discharge rollers 230B, the pair of alignment plates 271A and 271B are moved to the first retracted position from the sheet S as illustrated in FIGS. 26A and 26B. In this example, the shift direction is a direction from the rear side to the front side, and therefore, among the pair of alignment plates 271A and 271B, the alignment plate 271A on the front side will be referred to as one alignment plate, and the alignment plate 271B on the rear side will be referred to as the other alignment plate.

Figure 27A:
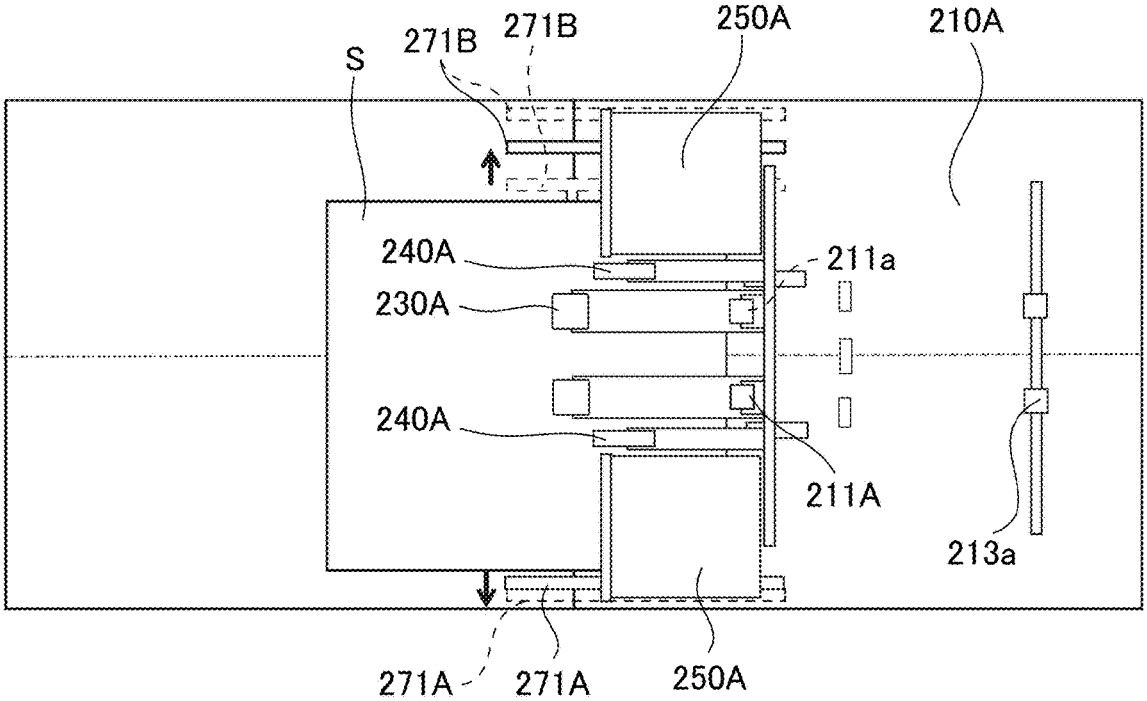
FIG. 27A is a schematic diagram illustrating the main part of the sheet processing apparatus when the sheet is discharged in the switchbackless shift discharge process according to the first embodiment as viewed from above.
Figure 27B:
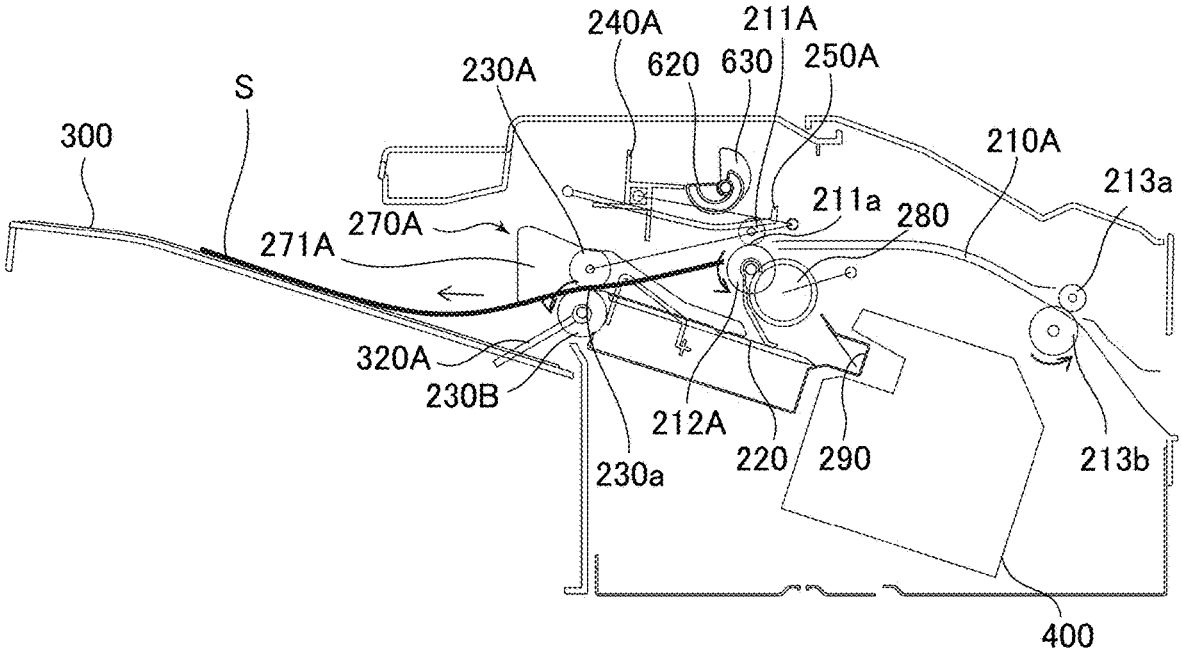
FIG. 27B is a schematic configurational section view of the sheet processing apparatus when the sheet is discharged in the switchbackless shift discharge process according to the first embodiment.

Next, as illustrated in FIGS. 27A and 27B, the lower discharge rollers 230B are rotated to discharge the sheet S nipped by the upper discharge rollers 230A and the lower discharge rollers 230B onto the stacking tray 300. At this time, the sheet is conveyed in the first conveyance direction by the upper discharge rollers 230A and the lower discharge rollers 230B after the shift operation by the pair of alignment plates 271A and 271B and in a state in which the pair of alignment plates 271A and 271B have been moved to the first retracted position from the nipping position with respect to the sheet subjected to the shift operation.

Next, the pair of alignment plates 271A and 271B are moved from the first retracted position to the second retracted position before the upstream end (trailing end) in the first conveyance direction of the sheet conveyed by the upper discharge rollers 230A and the lower discharge rollers 230B passes the discharge nip portion 230*a* formed by the upper discharge rollers 230A and the lower discharge rollers 230B at the nipping position. Then, the upper discharge rollers 230A and the lower discharge rollers 230B discharge the sheet onto the stacking tray 300 in a state in which the pair of alignment plates 271A and 271B are at the second retracted position.

That is, in the present embodiment, the pair of alignment plates 271A and 271B are positioned at the first retracted position that is closer to the sheet than the second retracted position while the sheet S is nipped and conveyed by the upper discharge rollers 230A and the lower discharge rollers 230B. As a result of this, the skew of the sheet S at the time of discharge is suppressed. Further, the pair of alignment plates 271A and 271B are moved to the second retracted position before the trailing end of the sheet S passes the discharge nip portion 230*a*. As a result of this, a situation in which the sheet S comes into contact with the pair of alignment plates 271A and 271B in a state in which the trailing end of the sheet S has passed the discharge nip portion 230*a* and the sheet S is not nipped by the upper discharge rollers 230A and the lower discharge rollers 230B is suppressed.

In the case of the present embodiment, as described above, the pair of alignment plates 271A and 271B are each disposed to extend across the upper discharge rollers 230A and the lower discharge rollers 230B in the first conveyance direction, and part of the pair of alignment plates 271A and 271B including the downstream end portion thereof in the first conveyance direction is positioned downstream of the discharge nip portion 230*a* in the first conveyance direction. Therefore, in the case where the pair of alignment plates 271A and 271B are still positioned at the first retracted position even after the trailing end of the sheet S has passed the discharge nip portion 230*a*, there is a possibility that the sheet S comes into contact with the part of the pair of alignment plates 271A and 271B downstream of the discharge nip portion 230*a*.

If the sheet S comes into contact with the pair of alignment plates 271A and 271B in a state in which the sheet S is not being conveyed by the upper discharge rollers 230A and the lower discharge rollers 230B, a resistance force against discharge of the sheet S is generated, and the stackability of the sheet S can be degraded. For example, trailing-end leaning in which the trailing end of the sheet S leans on the erecting surface 310*a* can occur when stacking the sheet S on the stacking tray 300. Therefore, in the present embodiment, the pair of alignment plates 271A and 271B are moved to the second retracted position before the trailing end of the sheet S passes the discharge nip portion 230*a* such that the sheet S not nipped by the upper discharge rollers 230A and the lower discharge rollers 230B is less likely to come into contact with the pair of alignment plates 271A and 271B.

In contrast, in the case where the pair of alignment plates 271A and 271B are positioned at the second retracted position from the start of the discharge operation of the sheet S, skew can occur in the sheet S while conveying the sheet S by the upper discharge rollers 230A and the lower discharge rollers 230B. Therefore, in the present embodiment, while the sheet S is conveyed by the upper discharge rollers 230A and the lower discharge rollers 230B, the skew of the sheet S is suppressed by positioning the pair of alignment plates 271A and 271B at the first retracted position as long as possible. Further, by moving the pair of alignment plates 271A and 271B to the second retracted position before the trailing end of the sheet S passes the discharge nip portion 230*a*, deterioration of the stackability of the sheet S on the stacking tray 300 is suppressed.

In the present embodiment, the timing at which the movement of the pair of alignment plates 271A and 271B to the first retracted position is started is started after the shift operation is after nipping the sheet S by the upper discharge rollers 230A and the lower discharge rollers 230B. In addition, the timing at which the movement of the pair of alignment plates 271A and 271B from the first retracted position to the second retracted position is started is when, for example, the trailing end of the sheet S is positioned at 10 mm on the front side (upstream side in the first conveyance direction) of the discharge nip point (center position in the first conveyance direction of the discharge nip portion 230*a*).

That is, in the present embodiment, the upper discharge rollers 230A and the lower discharge rollers 230B nip the sheet S and convey the sheet S by a predetermined amount (amount by which the trailing end of the sheet S is moved to the position at 10 mm on the front side of the discharge nip point) in a state in which the pair of alignment plates 271A and 271B are at the first retracted position, and then the pair of alignment plates 271A and 271B are moved to the second retracted position to discharge the sheet S onto the stacking tray 300. To be noted, in the speed (discharge speed) at which the sheet S is conveyed by the upper discharge rollers 230A and the lower discharge rollers 230B is reduced at a timing at which the movement of the pair of alignment plates 271A and 271B from the first retracted position to the second retracted position is started. As a result of this, disturbance of the position of the discharged sheet S on the stacking tray 300 is suppressed while suppressing deterioration of the productivity.

To be noted, the "position where the trailing end of the sheet S is at 10 mm on the upstream side of the discharge nip point" described above may be slightly displaced. In addition, the timing at which the pair of alignment plates 271A and 271B are moved from the first retracted position to the second retracted position and the timing at which the discharge speed is reduced may be different. In addition, a configuration in which the discharge speed is not reduced may be employed.

Figure 28A:
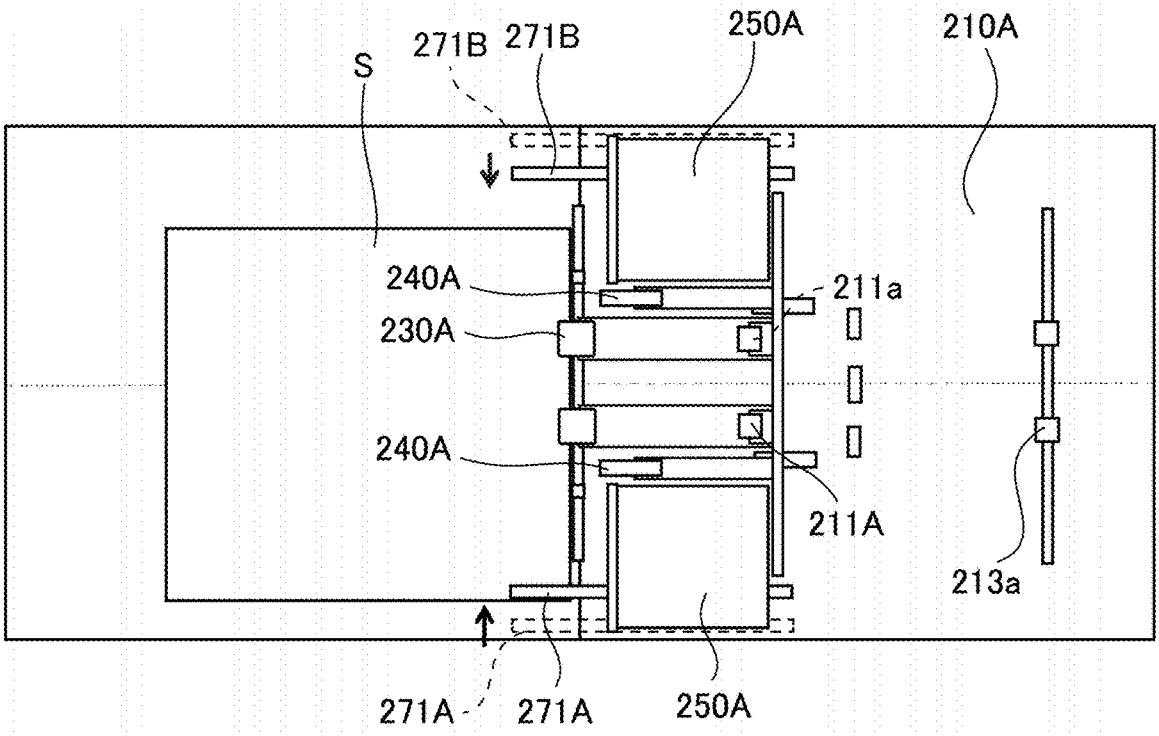
FIG. 28A is a schematic diagram illustrating the main part of the sheet processing apparatus when the discharge of the sheet is completed in the switchbackless shift discharge process according to the first embodiment as viewed from above.
Figure 28B:
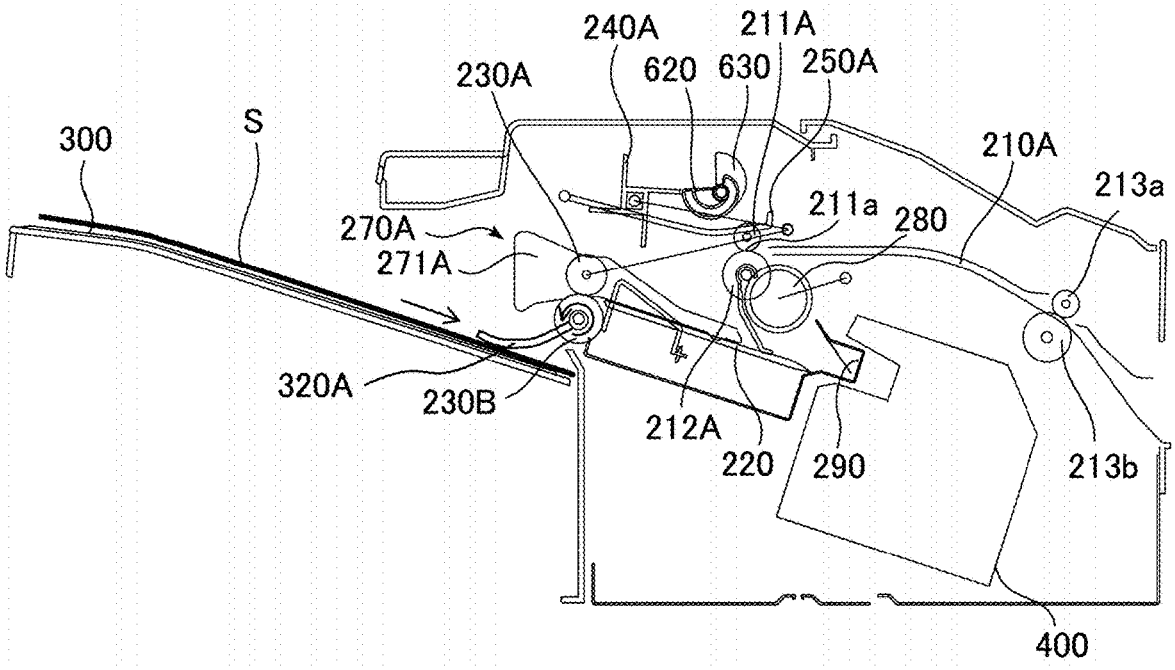
FIG. 28B is a schematic configurational section view of the sheet processing apparatus when the discharge of the sheet is completed in the switchbackless shift discharge process according to the first embodiment.

After the sheet S is discharged onto the stacking tray 300, as illustrated in FIGS. 28A and 28B, the sheet S is raked in and further pressed at the trailing end thereof by the discharged sheet reversing paddle 320A. At this time, the pair of alignment plates 271A and 271B move from the second retracted position to the receiving position to receive the next sheet.

In the case of the switchbackless shift discharge process (productivity-prioritized mode) as described above, since an operation of conveying the sheet S in the second conveyance direction on the processing tray 220 (switchback conveyance) is not involved, the shift operation of the sheet S can be performed more quickly than in the case of performing the shift operation on the processing tray 220. To be noted, the productivity-prioritized mode is preferably applicable to sheets of a small size, but may be executed for sheets of a large size. That is, the productivity-prioritized mode may be executed for all the sheets that are shifted and discharged without the stapling process.

Particularly, in the present embodiment, in the switchbackless shift discharge process, the sheet conveyed by the pre-processing rollers 211A and 212A is nipped by the pair of alignment plates 271A and 271B and shifted as it is without nipping the sheet by the upper discharge rollers 230A and the lower discharge rollers 230B. Therefore, the switchbackless shift discharge process can be further accelerated. That is, as in the configuration described in Japanese Patent Application Laid-Open No. 2023-20999, a configuration in which the sheet conveyed by the pre-processing rollers 211A and 212A is nipped by the upper discharge rollers 230A and the lower discharge rollers 230B, and the shift operation is performed by cancelling the nip and then nipping the sheet by the pair of alignment plates 271A and 271B is employed. In contrast, in the case of the present embodiment, the operation of nipping the sheet by the upper discharge rollers 230A and the lower discharge rollers 230B and the operation of cancelling this nip are not involved, and therefore the switchbackless shift discharge process can be further accelerated, and the productivity can be improved.

Formation of Sheet Bundle by Shift Discharge Process

Figure 32:
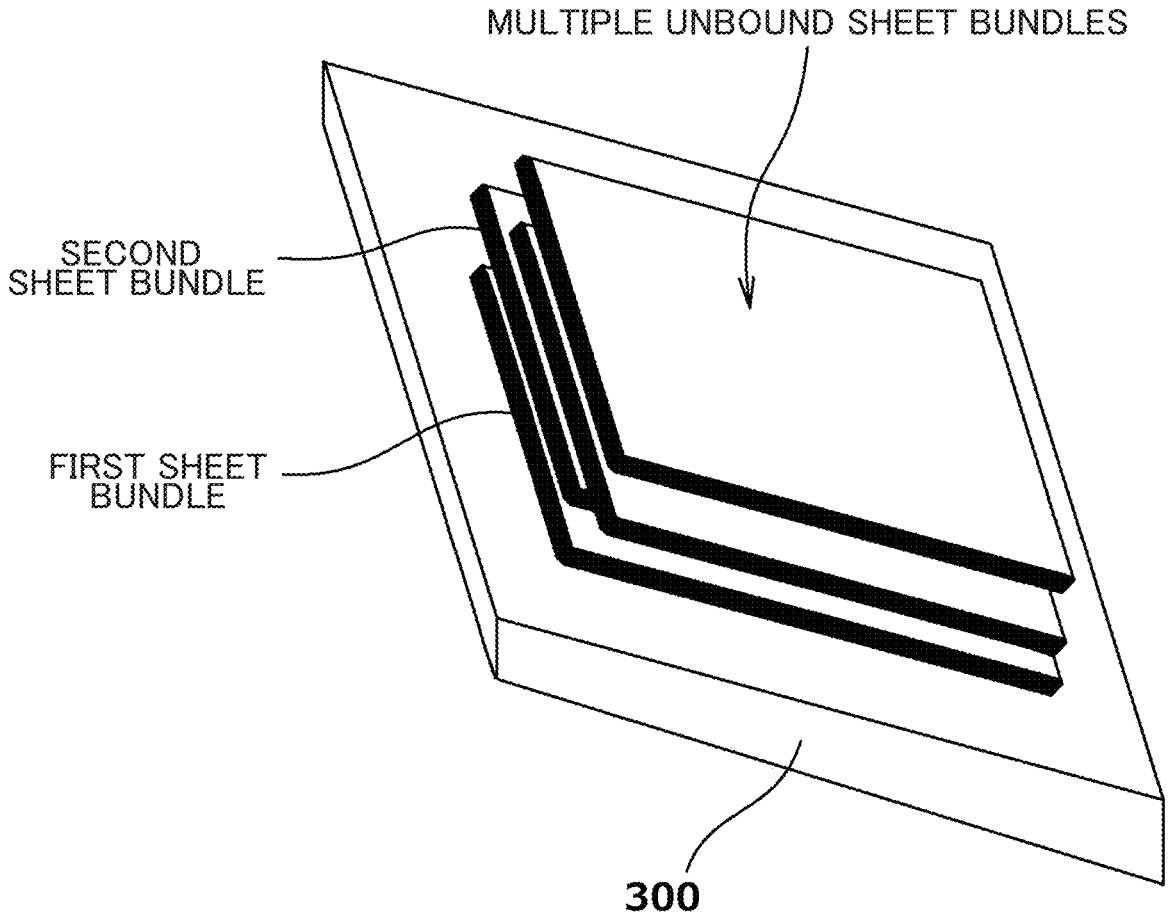
FIG. 32 is a perspective view illustrating a state in which an unbound sheet bundle moved in a shift direction is formed on the stacking tray.

Here, in the present embodiment, a process of shifting sheets in the shift direction one by one, discharging the sheets onto the stacking tray 300 without performing the binding process, and thus forming a sheet bundle constituted by a plurality of unbound sheets will be described. For example, as illustrated in FIG. 32, there is a case where a plurality of unbound sheet bundles are discharged onto the stacking tray 300 while shifting the plurality of unbound sheet bundles in the shift direction with respect to each other (this case may be also referred to as a sorting discharge process). This sorting discharge process is as follows. First, after the sheet is conveyed in the first conveyance direction by the pre-processing rollers 211A and 212A, the sheet conveyed by the pre-processing rollers 211A and 212A is nipped and moved in the shift direction by the pair of alignment plates 271A and 271B by driving the pair of alignment plates 271A and 271B by the front-side (F-side) alignment plate moving motor MT16 and the rear-side (R-side) alignment plate moving motor MT17 without conveying the sheet in the second conveyance direction by the reversing paddles 240A and in a state in which the sheet is moving in the first conveyance direction. Next, discharging the sheet moved in the shift direction by the pair of alignment plates 271A and 271B to a shift position on the stacking tray 300 by the upper discharge rollers 230A and the lower discharge rollers 230B is repeated a plurality of times, and thus a first unbound sheet bundle is stacked. Next, discharging the sheet conveyed by the pre-processing rollers 211A and 212A to a position upstream of the shift position in the shift direction on the stacking tray 300 by the upper discharge rollers 230A and the lower discharge rollers 230B without conveying the sheet in the second conveyance direction by the reversing paddles 240A is repeated a plurality of times, and thus a second unbound sheet bundle is stacked. To be noted, "stacking a sheet bundle" mentioned herein means forming a sheet bundle on the stacking tray 300, and a case of forming one sheet bundle as in the present embodiment will be also referred to as "stacking a sheet bundle" as long as a sheet bundle is formed on the stacking tray 300 by discharging a plurality of sheets one by one onto the stacking tray 300.

To be noted, in the sorting discharge process, the second sheet bundle may be stacked on the stacking tray 300 by discharging sheets by moving the sheets one by one by the pair of alignment plates 271A and 271B in a direction opposite to the shift direction of the first sheet bundle, or may be stacked by discharging the sheets one by one onto the stacking tray 300 at the position in the shift direction to which the sheets have been conveyed by the pre-processing rollers 211A and 212A, without moving the sheets in the direction opposite to the shift direction of the first sheet bundle (same as straight discharge mode). In short, as illustrated in FIG. 32, it suffices as long as the first sheet bundle and the second sheet bundle are stacked in the state of being displaced from each other in the shift direction. In addition, a sheet bundle may be stacked on the stacking tray 300 at the position in the shift direction to which the sheets have been conveyed by the pre-processing rollers 211A and 212A, without moving the sheets in the direction opposite to the shift direction of the first sheet bundle before the first sheet bundle, and then the first sheet bundle may be stacked on the stacking tray 300 by moving the first sheet bundle in the shift direction.

To be noted, in the case of discharging sheets onto the stacking tray 300 at the position in the shift direction to which the sheets have been conveyed by the pre-processing rollers 211A and 212A without moving the sheets in the direction opposite to the shift direction of the first sheet bundle when stacking the second sheet bundle on the stacking tray 300, the sheets may be discharged by the upper discharge rollers 230A and the lower discharge rollers 230B after only aligning the sheets in the width direction by the pair of alignment plates 271A and 271B. As a result of this, the alignment of the second sheet bundle on the stacking tray 300 is improved. In addition, also in the case of only the straight discharge mode, the sheets may be discharged onto the stacking tray 300 after aligning the sheets one by one in the width direction by the pair of alignment plates 271A and 271B.

Examples of the sorting discharge process configured in this manner include a sorting process and a grouping process. For example, in the case of discharging ten copies of a sheet bundle including five sheets, the sorting process is a process of stacking the sheet bundles on the stacking tray 300 while shifting the sheet bundles on the per-bundle basis. In addition, the grouping process is a process of stacking the sheets on the stacking tray 300 by shifting the ten sheets of the first page, the ten sheets of the second page, . . . the ten sheets of the fifth page with respect to each other. The sorting process and the grouping process can be selected by the user via an operation panel of the image forming apparatus 100, an external terminal such as a personal computer connected thereto via a network or the like, or the like. Then, a command of the process selected by the user is transmitted from the image forming apparatus 100 to the sheet processing apparatus 200A, and the sheet processing apparatus 200A executes the process.

In addition, examples of the sorting discharge process include a process of shifting sheet bundles on the per-job basis and stacking the sheet bundles on the stacking tray 300 in the case where jobs of different contents are consecutively input to the image forming system 1000A. For example, a case where A inputs a job for forming a sheet bundle of ten sheets as a first job and then B inputs a job for forming a sheet bundle of five sheets as a second job is considered. In this case, the sheet bundle of the first job is moved in the shift direction and stacked on the stacking tray 300, and then the sheet bundle of the second job is stacked on the stacking tray 300 without being shifted or after being shifted in a direction opposite to the shift direction.

In addition, as a process of shifting sheets and discharging the sheets without performing the binding process as described above, in the present embodiment, the switchback shift discharge process (alignment-prioritized mode) and the sorting discharge process can be executed. Further, examples of the sorting discharge process include the switchbackless shift discharge process (productivity-prioritized mode) described above.

In the switchbackless shift discharge process, the sheets are shifted one by one and discharged onto the stacking tray 300. At this time, there is a possibility that the alignment of the sheets on the stacking tray 300 deteriorates in the case where a sheet bundle is formed by simply stacking shifted sheets on the stacking tray 300. In addition, if it is attempted to rake-in the sheets by the discharged sheet reversing paddle 320A after forming the sheet bundle on the stacking tray 300, there is a possibility that conversely, only the uppermost sheet of the sheet bundle is raked in, and the alignment of the sheets deteriorates. Therefore, in the present embodiment, the sheet is raked in by the discharged sheet reversing paddle 320A each time a sheet is discharged onto the stacking tray 300 as described above with reference to FIGS. 28A and 28B.

That is, in the case of forming a shifted sheet bundle on the stacking tray 300 (on the stacking portion) without performing the binding process, a sheet bundle constituted by a plurality of sheets is formed on the stacking tray 300 by repeatedly executing the shift discharge process and the reversing process on a plurality of sheets. The shift discharge process is a process of shifting a sheet by the alignment portion 270A and discharging the sheet shifted in the alignment portion 270A onto the stacking tray 300 by the upper discharge rollers 230A and the lower discharge rollers 230B, which is the switchbackless shift discharge process described above. The reversing process is a process of conveying the sheet discharged onto the stacking tray 300 by the discharged sheet reversing paddle 320A in the third conveyance direction.

In addition, when repeating the shift discharge process and the reversing process, the reversing paddle 320A is stopped at a position pressing the upper surface of the raked-in sheet on the stacking tray 300 after raking in the sheet and until the next sheet is discharged (until the trailing end of the sheet passes the nip point of the upper discharge rollers 230A and the lower discharge rollers 230B). Then, when the next sheet is discharged onto the stacking tray 300, the reversing paddle 320A rotates and rakes in the sheet, and further presses the trailing end of the sheet. As a result of this, an already raked-in sheet being displaced on the stacking tray 300 by the next sheet can be suppressed.

As a result of this, the alignment of the sheet bundle when forming an unbound sheet bundle moved in the shift direction on the stacking tray 300 can be improved. That is, by discharging a shifted sheet onto the stacking tray 300 and further raking in this sheet by the discharged sheet reversing paddle 320A, the sheet discharged onto the stacking tray 300 can be caused to abut against the erecting surface 310*a* provided at an upstream end in the first conveyance direction of the stacking tray 300. Further, by repeating this operation on each sheet, the alignment of the sheet bundle discharged onto the stacking tray 300 can be improved.

To be noted, such operation can be also performed in the switchback shift discharge process. That is, normally, in the case of performing the switchback shift discharge process, a sheet bundle is formed on the processing tray 220, and then the sheet bundle is discharged onto the stacking tray 300. However, sheets may be shifted one by one on the processing tray 220 and discharged onto the stacking tray 300. Also in this case, the alignment of the sheet bundle discharged onto the stacking tray 300 can be improved by performing the reversing process on each of the sheets discharged onto the stacking tray 300 one by one.

In addition, also in the case of forming the second sheet bundle on the stacking tray 300 or in the case of the straight discharge mode, by performing the reversing process described above on each of the sheets discharged onto the stacking tray 300 one by one, the alignment of the second sheet bundle and the sheet bundle formed by the discharge in the straight discharge mode can be improved.

Second Embodiment

A second embodiment will be described with reference to FIG. 29. In the first embodiment described above, in the switchbackless shift discharge process, the upper discharge rollers 230A are moved to the second separated position after the leading end of the sheet has passed through the gap between the upper discharge rollers 230A and the lower discharge rollers 230B (see FIG. 22B). In contrast, in the present embodiment, the trailing end dropping members 250A are moved from the upper position to the lower position after the trailing end of the sheet has passed the pre-processing nip portion 211*a*. The other elements and functions are substantially the same as in the first embodiment described above, and therefore substantially the same elements are denoted by the same reference signs to omit or simplify the description and the illustration, and parts different from the first embodiment will be mainly described below.

Also in the present embodiment, in the case of performing switchbackless shift discharge process, the sheet S is conveyed toward the pre-processing rollers 211A and 211B via the conveyance path 210A similarly to the case illustrated in FIGS. 20A to 21B. Further, as illustrated in FIG. 29, the trailing end dropping members 250A are moved from the upper position to the lower position after the leading end of the sheet S conveyed in the first conveyance direction by the pre-processing rollers 211A and 211B has passed through the gap between the upper discharge rollers 230A and the lower discharge rollers 230B and after the trailing end of the sheet S has passed the pre-processing rollers 211A and 211B. As a result of this, the sheet S is dropped onto the processing tray 220, and the two edges of the sheet S in the width direction face the pair of alignment plates 271A and 271B in a wide range in the first conveyance direction.

In this state, similarly to FIG. 23A and so on of the first embodiment, the sheet S is nipped by the pair of alignment plates 271A and 271B to be subjected to the shift operation, and is discharged without conveying the sheet S in the second conveyance direction by the reversing paddles 240A. By dropping the sheet S onto the processing tray 220 by the trailing end dropping members 250A as described above, the sheet S can be more reliably nipped by the pair of alignment plates 271A and 271B. Therefore, the alignment of the sheet can be improved.

Figure 29:
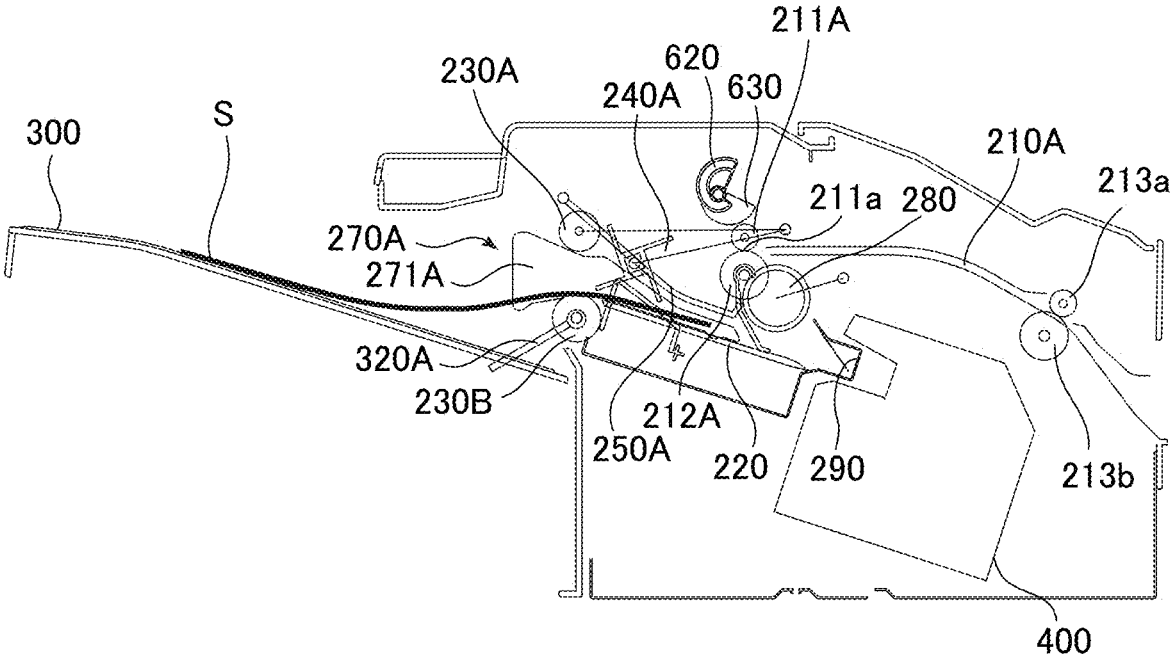
FIG. 29 is a schematic configurational section view of the sheet processing apparatus when a trailing end dropping member is lowered in a switchbackless shift discharge process according to a second embodiment.

To be noted, in the case of the present embodiment, as illustrated in FIG. 29, when the trailing end dropping members 250A are moved to the lower position, the reversing paddles 240A also move from the upper retracted position to the returning position. This is because the components of each part are interlocked by the cam mechanism 613 described above. In the present embodiment, as described with reference to FIG. 16, the reversing paddles 240A are capable of individually moving up by an amount corresponding to the gap between the second protrusion portions 2405 and the part of the engagement recess portions 2502 positioned above the second protrusion portions 2405 in a state in which the reversing paddles 240A are at the returning position. Therefore, after dropping the sheet S by the trailing end dropping members 250A, the reversing paddles 240A are moved up by the amount corresponding to the gap described above from the returning position such that the reversing paddles 240A are separated from the sheet S. As a result of this, the shift operation of the sheet by the pair of alignment plates 271A and 271B being interrupted by the reversing paddles 240A can be suppressed.

In addition, the trailing end dropping members 250A may be immediately returned to the upper position after dropping the sheet S onto the processing tray 220. For example, the movement of the trailing end dropping members 250A to the upper position may be started before the pair of alignment plates 271A and 271B nip the sheet S, or the movement of the trailing end dropping members 250A may be started before the shift operation. Further, a configuration in which the trailing end dropping members 250A do not operate in an interlocked manner with the reversing paddles 240A, for example, a configuration in which the trailing end dropping members 250A and the reversing paddles 240A are separately driven may be employed.

Third Embodiment

Figure 30A:
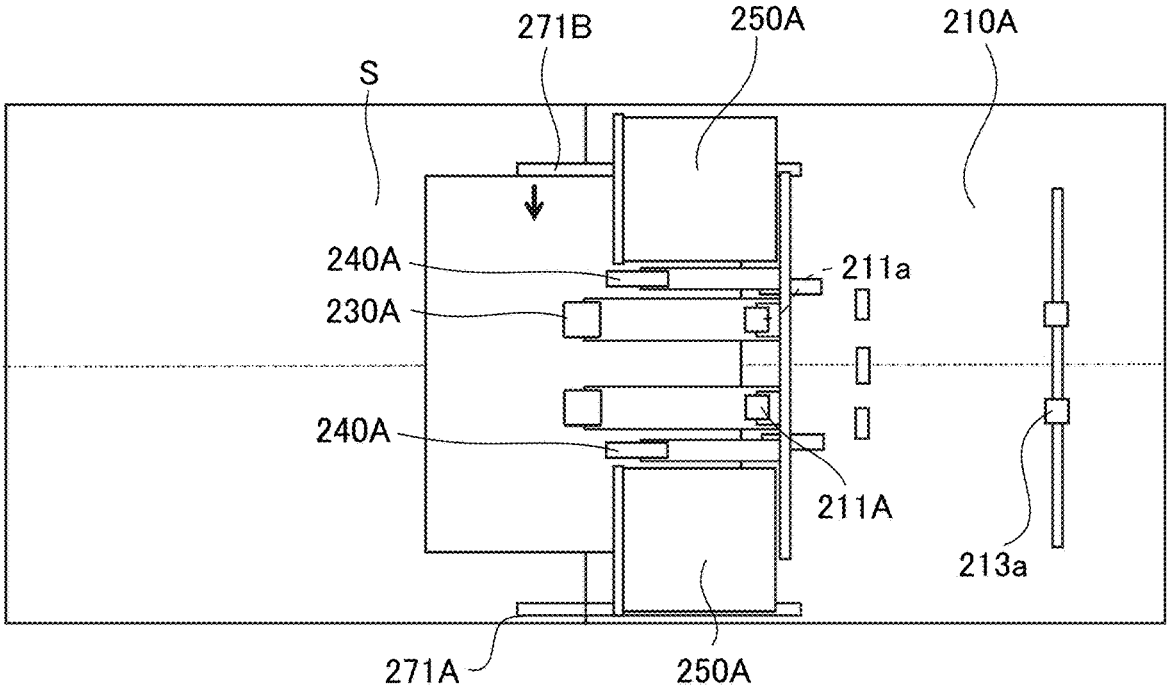
FIG. 30A is a schematic diagram illustrating a main part of the sheet processing apparatus when a sheet is shifted by the alignment plates in a switchbackless shift discharge process according to a third embodiment as viewed from above.
Figure 30B:
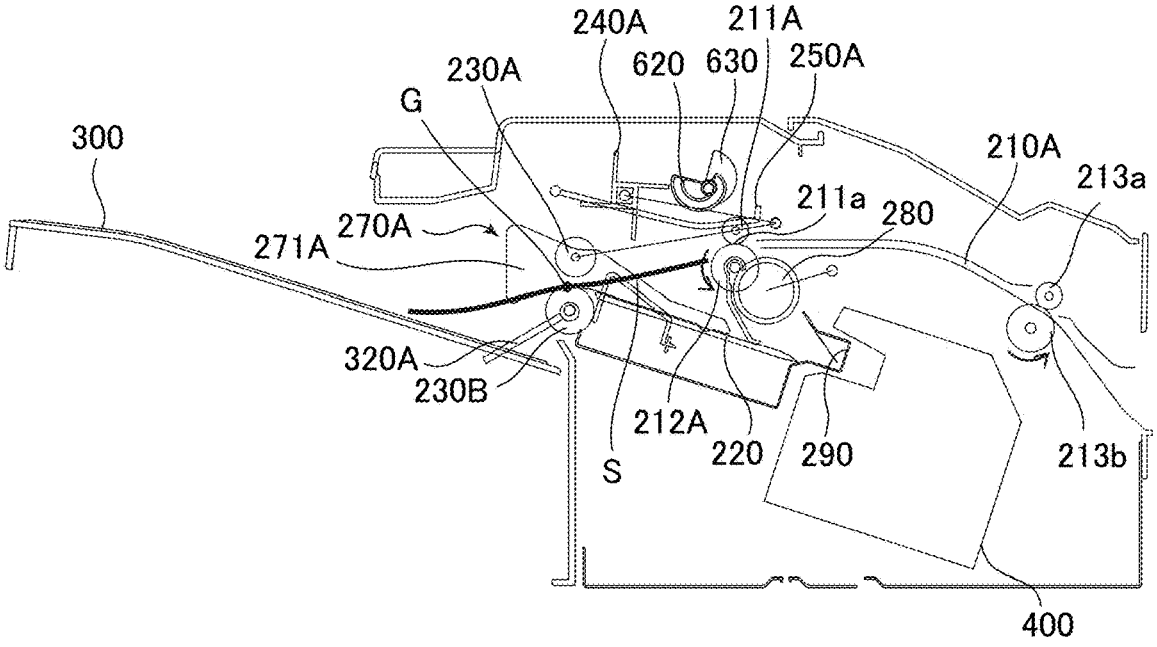
FIG. 30B is a schematic configurational section view of the sheet processing apparatus when the sheet is shifted by the alignment plates in the switchbackless shift discharge process according to the third embodiment.

A third embodiment will be described with reference to FIGS. 30A and 30B. In the first embodiment described above, after the leading end of the sheet S conveyed in the first conveyance direction by the pre-processing rollers 211A and 211B has passed through the gap between the upper discharge rollers 230A and the lower discharge rollers 230B and after the trailing end of the sheet S has passed the pre-processing rollers 211A and 211B, the sheet S is nipped by the pair of alignment plates 271A and 271B, and then the shift operation is performed (see FIGS. 23A to 24B). In contrast, in the present embodiment, the shift operation is performed by moving one of the pair of alignment plates 271A and 271B in a state in which the sheet S is moving in the first conveyance direction without nipping the sheet S by the pair of alignment plates 271A and 271B. The other elements and functions are substantially the same as in the first embodiment described above, and therefore substantially the same elements are denoted by the same reference signs to omit or simplify the description and the illustration, and parts different from the first embodiment will be mainly described below.

In the first embodiment described above, in the shift mode, a configuration in which the switchbackless shift discharge process is performed on sheets of a small size and the switchback shift discharge process is performed on sheets of a large size has been described. In the present embodiment, in the switchbackless shift discharge process on sheets of a small size, two kinds of switchbackless shift discharge processes can be executed further in accordance with the size of the sheet.

That is, in the present embodiment, as the two kinds of switchbackless shift discharge processes, a first shift discharge process and a second shift discharge process can be executed. The first shift discharge process is executed in the case where the sheet conveyed by the pre-processing rollers 211A and 212A is of a first size, and the second shift discharge process is executed on a sheet of a second size whose length in the first conveyance direction of the sheet conveyed by the pre-processing rollers 211A and 212A is smaller than that of the sheet of a first size. The first shift discharge process is a switchbackless shift discharge process described in the first embodiment or the second embodiment. In addition, the sorting discharge process described with reference to FIG. 32 may be executed as the second shift discharge process.

In contrast, in the second shift discharge process, the operation illustrated in FIG. 30 is performed without performing the operation of FIGS. 23A and 23B after the operation of FIGS. 22A and 22B of the first embodiment. That is, the alignment plate 271B on one side in the width direction among the pair of alignment plates 271A and 271B is moved in the shift direction (predetermined shift direction) toward the other side in the width direction without conveying the sheet S in the second conveyance direction by the reversing paddles 240A and in a state in which the sheet S is moving in the first conveyance direction, after the leading end of the sheet S conveyed in the first conveyance direction by the pre-processing rollers 211A and 212A has passed through the gap between the upper discharge rollers 230A and the lower discharge rollers 230B and after the trailing end of the sheet S has passed the pre-processing rollers 211A and 212A, and thus the shift operation of moving the position of the sheet S in the shift direction is performed. In the present embodiment, since the shift direction is a direction toward the front side, the alignment plate on the one side is the alignment plate 271B on the rear side, and the alignment plate on the other side is the alignment plate 271A on the front side.

Here, the sheet of the second size on which the second shift discharge process is executed is, for example, a sheet of the B5 size or a sheet of a size smaller than the B5 size, which is, as illustrated in FIG. 30, a sheet S whose center of gravity G is positioned within the range of the alignment plate 271B on the one side when the alignment plate 271B abuts against an end portion of the sheet S in the width direction. The sheet of the second size varies depending on the configuration and the size of the sheet processing apparatus, and is not limited to a sheet of the B5 size or a size smaller than this as long as this requirement is satisfied.

When the alignment plate 271B on the one side abuts against an end portion of the sheet S in the width direction as described above, that is, in the case where the sheet S is a sheet whose center of gravity G in a state in which the leading end of the sheet S has passed through the gap between the upper discharge rollers 230A and the lower discharge rollers 230B and the trailing end of the sheet S has passed the pre-processing rollers 211A and 212A overlaps with the alignment plate 271B as viewed in the width direction, the shift operation can be performed by causing the alignment plate 271B to directly abut against the sheet without nipping the sheet by the pair of alignment plates 271A and 271B.

If the second shift discharge process is performed on a sheet whose center of gravity G is not within the range of the alignment plate 271B in the state described above, for example, a sheet whose center of gravity G is positioned further downstream of the downstream end of the alignment plate 271B in the first conveyance direction, there is a possibility that the sheet is inclined when the alignment plate 271B abuts against the sheet. Therefore, for a sheet like this, the switchbackless shift discharge process (that is, the first shift discharge process) as described in the first and second embodiments is executed.

After the shift operation by the alignment plate 271B on the one side, the alignment plate 271B on the one side is retracted in the width direction from the sheet S subjected to the shift operation, and the upper discharge rollers 230A and the lower discharge rollers 230B are moved to the nipping position. Then, the sheet S is discharged onto the stacking tray 300 by the upper discharge rollers 230A and the lower discharge rollers 230B.

In the case of the present embodiment configured in this manner, since the shift operation is performed by moving the alignment plate on one side in the shift direction without nipping the sheet by the pair of alignment plates 271A and 271B, the switchbackless shift discharge process can be further accelerated, and the productivity can be improved.

OTHER EMBODIMENTS

In each embodiment described above, although a configuration in which the sheet processing apparatus 200 is disposed in the in-body space 130 of the image forming apparatus 100 is employed, the sheet processing apparatus of the present invention may be, for example, configured to be attached to a side surface of the image forming apparatus. In addition, the sheet processing apparatus may have a configuration controlled by a controller included in an image forming apparatus.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-108588, filed on Jun. 30, 2023, and Japanese Patent Application No. 2024-086112, filed on May 28, 2024, which are hereby incorporated by reference herein in their entirety.

What is claimed is:

1. A sheet processing apparatus comprising:

a first conveyance portion configured to convey a sheet in a first conveyance direction;

a placement portion on which the sheet conveyed by the first conveyance portion is placed;

an abutment portion against which an upstream edge in the first conveyance direction of the sheet on the placement portion abuts;

a second conveyance portion configured to convey the sheet in a second conveyance direction in which the upstream edge in the first conveyance direction of the sheet on the placement portion moves toward the abutment portion;

a pair of alignment plates disposed on two sides of the sheet in a width direction intersecting with the first conveyance direction and configured to align the sheet, abutting against the abutment portion, in the width direction;

a driving portion configured to move the pair of alignment plates in the width direction;

a processing portion configured to perform a binding process on a sheet bundle constituted by a plurality of sheets aligned in the width direction by the pair of alignment plates;

a stacking portion disposed downstream of the placement portion in the first conveyance direction and on which the sheet conveyed in the first conveyance direction by the first conveyance portion is stacked;

a pair of discharge rotary members configured to discharge the sheet conveyed in the first conveyance direction by the first conveyance portion onto the stacking portion; and a moving portion configured to move a position of at least one of the pair of discharge rotary members to a nipping position and a separated position, the nipping position being a position where the pair of discharge rotary members are configured to nip the sheet, the separated position being a position where the pair of discharge rotary members are separated from each other, wherein the sheet processing apparatus is configured to perform a binding discharge process and a sorting discharge process, wherein in the binding discharge process, a first operation is repeatedly performed to align a plurality of sheets at a binding position, the binding process is performed by the processing portion on the plurality of sheets aligned at the binding position, and the plurality of sheets having undergone the binding process are discharged onto the stacking portion by the pair of discharge rotary members, wherein in the first operation, the sheet is conveyed in the first conveyance direction by the first conveyance portion, then the sheet conveyed by the first conveyance portion is conveyed in the second conveyance direction on the placement portion by the second conveyance portion to cause a downstream edge in the second conveyance direction of the sheet to abut against the abutment portion, and the sheet is aligned by the pair of alignment plates at the binding position, wherein in the sorting discharge process, a second operation is repeatedly performed to form an unbound first sheet bundle on the stacking portion, and a third operation is repeatedly performed to form an unbound second sheet bundle on the stacking portion, wherein in the second operation, the sheet is conveyed in the first conveyance direction by the first conveyance portion such that a downstream end of the sheet in the first conveyance direction passes through a gap between the pair of discharge rotary members and an upstream end of the sheet in the first conveyance direction passes the first conveyance portion in a state in which the pair of discharge rotary members are at the separated position, then the sheet is nipped by the pair of alignment plates without conveying the sheet in the second conveyance direction by the second conveyance portion and in a state in which the sheet is moving in the first conveyance direction, a shift operation of moving a position of the sheet in a shift direction is performed by moving the pair of alignment plates nipping the sheet, the shift direction being a direction toward one of the two sides in the width direction, and then the sheet is discharged to a shift position on the stacking portion by the pair of discharge rotary members after the pair of alignment plates are retracted in the width direction from the sheet subjected to the shift operation and the pair of discharge rotary members are moved to the nipping position, and wherein in the third operation, the sheet conveyed by the first conveyance portion is discharged by the pair of discharge rotary members to a position displaced upstream from the shift position on the stacking portion in the shift direction without conveying the sheet in the second conveyance direction by the second conveyance portion.

2. The sheet processing apparatus according to claim 1, wherein the moving portion is configured to move a position of at least one of the pair of discharge rotary members to a first separated position where the pair of discharge rotary members are more separated from each other than in the nipping position, and a second separated position where the pair of discharge rotary members are more separated from each other than in the nipping position and a distance between the pair of discharge rotary members is smaller than in the first separated position, and wherein in the sorting discharge process, after the downstream end in the first conveyance direction of the sheet conveyed in the first conveyance direction by the first conveyance portion has passed the gap between the pair of discharge rotary members in a state in which the pair of discharge rotary members are at the first separated position, the pair of discharge rotary members are moved to the second separated position, and the shift operation is performed by nipping the sheet whose upstream end in the first conveyance direction has passed the first conveyance portion by the pair of alignment plates without conveying in the second conveyance direction by the second conveyance portion, and in the state in which the sheet is moving in the first conveyance direction.

3. The sheet processing apparatus according to claim 1, wherein a moving speed of the pair of alignment plates at which the driving portion moves the pair of alignment plates in a case of nipping the sheet whose upstream end in the first conveyance direction has passed the first conveyance portion by the pair of alignment plates without conveying in the second conveyance direction by the second conveyance portion, and in the state in which the sheet is moving in the first conveyance direction, is lower than a moving speed of the pair of alignment plates at which the driving portion moves the pair of alignment plates in the shift operation.

4. The sheet processing apparatus according to claim 1, wherein in the sorting discharge process, after the shift operation by the pair of alignment plates, the sheet is conveyed in the first conveyance direction by the pair of discharge rotary members in a state in which the pair of alignment plates are retracted from the sheet subjected to the shift operation to a first retracted position, and before the upstream end in the first conveyance direction of the sheet conveyed by the pair of discharge rotary members passes a discharge nip portion formed by the pair of discharge rotary members at the nipping position, the pair of alignment plates are retracted to a second retracted position where the pair of alignment plates are further retracted from the sheet than at the first retracted position, and the sheet is discharged onto the stacking portion by the pair of discharge rotary members in a state in which the pair of alignment plates are at the second retracted position.

5. An image forming system comprising:

an image forming portion configured to form an image on a sheet;

a first conveyance portion configured to convey a sheet on which the image has been formed by the image forming portion in a first conveyance direction;

a placement portion on which the sheet conveyed by the first conveyance portion is placed;

an abutment portion against which an upstream edge in the first conveyance direction of the sheet on the placement portion abuts;

a second conveyance portion configured to convey the sheet in a second conveyance direction in which the upstream edge in the first conveyance direction of the sheet on the placement portion moves toward the abutment portion;

a pair of alignment plates disposed on two sides of the sheet in a width direction intersecting with the first conveyance direction and configured to align the sheet, abutting against the abutment portion, in the width direction;

a driving portion configured to move the pair of alignment plates in the width direction;

a processing portion configured to perform a binding process on a sheet bundle constituted by a plurality of sheets aligned in the width direction by the pair of alignment plates;

a stacking portion disposed downstream of the placement portion in the first conveyance direction and on which the sheet conveyed in the first conveyance direction by the first conveyance portion is stacked;

a pair of discharge rotary members configured to discharge the sheet conveyed in the first conveyance direction by the first conveyance portion onto the stacking portion;

a moving portion configured to move a position of at least one of the pair of discharge rotary members to a nipping position and a separated position, the nipping position being a position where the pair of discharge rotary members are configured to nip the sheet, the separated position being a position where the pair of discharge rotary members are separated from each other; and a control portion, wherein the control portion is configured to perform a binding discharge process and a sorting discharge process, wherein in the binding discharge process, a first operation is repeatedly performed to align a plurality of sheets at a binding position, the binding process is performed by the processing portion on the plurality of sheets aligned at the binding position, and the plurality of sheets having undergone the binding process are discharged onto the stacking portion by the pair of discharge rotary members, wherein in the first operation, the sheet is conveyed in the first conveyance direction by the first conveyance portion, then the sheet conveyed by the first conveyance portion is conveyed in the second conveyance direction on the placement portion by the second conveyance portion to cause a downstream edge in the second conveyance direction of the sheet to abut against the abutment portion, and the sheet is aligned by the pair of alignment plates at the binding position, wherein in the sorting discharge process, a second operation is repeatedly performed to form an unbound first sheet bundle on the stacking portion, and a third operation is repeatedly performed to form an unbound second sheet bundle on the stacking portion, wherein in the second operation, the sheet is conveyed in the first conveyance direction by the first conveyance portion such that a downstream end of the sheet in the first conveyance direction passes through a gap between the pair of discharge rotary members and an upstream end of the sheet in the first conveyance direction passes the first conveyance portion in a state in which the pair of discharge rotary members are at the separated position, then the sheet is nipped by the pair of alignment plates without conveying the sheet in the second conveyance direction by the second conveyance portion and in a state in which the sheet is moving in the first conveyance direction, a shift operation of moving a position of the sheet in a shift direction is performed by moving the pair of alignment plates nipping the sheet, the shift direction being a direction toward one of the two sides in the width direction, and then the sheet is discharged to a shift position on the stacking portion by the pair of discharge rotary members after the pair of alignment plates are retracted in the width direction from the sheet subjected to the shift operation and the pair of discharge rotary members are moved to the nipping position, and wherein in the third operation, the sheet conveyed by the first conveyance portion is discharged by the pair of discharge rotary members to a position displaced upstream from the shift position on the stacking portion in the shift direction without conveying the sheet in the second conveyance direction by the second conveyance portion.

6. A sheet processing apparatus comprising:

a first conveyance portion configured to convey a sheet in a first conveyance direction;

a placement portion on which the sheet conveyed by the first conveyance portion is placed;

an abutment portion against which an upstream edge in the first conveyance direction of the sheet on the placement portion abuts;

a second conveyance portion configured to convey the sheet in a second conveyance direction in which the upstream edge in the first conveyance direction of the sheet on the placement portion moves toward the abutment portion;

a pair of alignment plates disposed on two sides of the sheet in a width direction intersecting with the first conveyance direction and configured to align the sheet abutting against the abutment portion in the width direction;

a driving portion configured to move the pair of alignment plates in the width direction;

a processing portion configured to perform a binding process on a sheet bundle constituted by a plurality of sheets aligned in the width direction by the pair of alignment plates;

a stacking portion disposed downstream of the placement portion in the first conveyance direction and on which the sheet conveyed in the first conveyance direction by the first conveyance portion is stacked;

a pair of discharge rotary members configured to discharge the sheet conveyed in the first conveyance direction by the first conveyance portion onto the stacking portion; and a moving portion configured to move a position of at least one of the pair of discharge rotary members to a nipping position and a separated position, the nipping position being a position where the pair of discharge rotary members are configured to nip the sheet, the separated position being a position where the pair of discharge rotary members are separated from each other, wherein the sheet processing apparatus is configured to perform a binding discharge process and a sorting discharge process, wherein in the binding discharge process, a first operation is repeatedly performed to align a plurality of sheets at a binding position, the binding process is performed by the processing portion on the plurality of sheets aligned at the binding position, and the plurality of sheets having undergone the binding process are discharged onto the stacking portion by the pair of discharge rotary members, wherein in the first operation, the sheet is conveyed in the first conveyance direction by the first conveyance portion, then the sheet conveyed by the first conveyance portion is conveyed in the second conveyance direction on the placement portion by the second conveyance portion to cause a downstream edge in the second conveyance direction of the sheet to abut against the abutment portion, and the sheet is aligned by the pair of alignment plates at the binding position, wherein in the sorting discharge process, a second operation is repeatedly performed to form an unbound first sheet bundle on the stacking portion, and a third operation is repeatedly performed to form on the stacking portion, wherein in the second operation, the sheet is conveyed in the first conveyance direction by the first conveyance portion such that a downstream end of the sheet in the first conveyance direction passes through a gap between the pair of discharge rotary members and an upstream end of the sheet in the first conveyance direction passes the first conveyance portion in a state in which the pair of discharge rotary members are at the separated position, then a shift operation of moving a position of the sheet in a predetermined shift direction is performed by moving one of the pair of alignment plates on one side in the width direction in the predetermined shift direction that is a direction toward another side in the width direction without conveying the sheet in the second conveyance direction by the second conveyance portion and in a state in which the sheet is moving in the first conveyance direction, and after the shift operation, the one alignment plate is retracted in the width direction from the sheet subjected to the shift operation and the pair of discharge rotary members are moved to the nipping position, and then the sheet is discharged to a shift position on the stacking portion by the pair of discharge rotary members, and wherein in the third operation, the sheet conveyed by the first conveyance portion is discharged by the pair of discharge rotary members to a position displaced upstream from the shift position on the stacking portion in the predetermined shift direction without conveying the sheet in the second conveyance direction by the second conveyance portion.

7. The sheet processing apparatus according to claim 6, wherein the sheet processing apparatus is configured to perform a first shift discharge process in a case where the sheet conveyed by the first conveyance portion is of a first size and a second shift discharge process in a case where the sheet conveyed by the first conveyance portion is of a second size in which a length of the sheet in the first conveyance direction is smaller than in the first size, and wherein the first shift discharge process is a process in which the sheet is conveyed in the first conveyance direction by the first conveyance portion such that a downstream end of the sheet in the first conveyance direction passes through a gap between the pair of discharge rotary members and an upstream end of the sheet in the first conveyance direction passes the first conveyance portion in a state in which the pair of discharge rotary members are at the separated position, then the sheet is nipped by the pair of alignment plates without conveying the sheet in the second conveyance direction by the second conveyance portion and in a state in which the sheet is moving in the first conveyance direction, a shift operation of moving a position of the sheet in the shift direction is performed by moving the pair of alignment plates nipping the sheet in the shift direction, and after the shift operation by the pair of alignment plates, the pair of alignment plates are retracted in the width direction from the sheet subjected to the shift operation, the pair of discharge rotary members are moved to the nipping position, and then the sheet is discharged onto the stacking portion by the pair of discharge rotary members, and wherein the second shift discharge process is the sorting discharge process.

8. An image forming system comprising:

an image forming portion configured to form an image on a sheet;

a first conveyance portion configured to convey a sheet on which the image has been formed by the image forming portion in a first conveyance direction;

a placement portion on which the sheet conveyed by the first conveyance portion is placed;

an abutment portion against which an upstream edge in the first conveyance direction of the sheet on the placement portion abuts;

a second conveyance portion configured to convey the sheet in a second conveyance direction in which the upstream edge in the first conveyance direction of the sheet on the placement portion moves toward the abutment portion;

a pair of alignment plates disposed on two sides of the sheet in a width direction intersecting with the first conveyance direction and configured to align the sheet abutting against the abutment portion in the width direction;

a driving portion configured to move the pair of alignment plates in the width direction;

a processing portion configured to perform a binding process on a sheet bundle constituted by a plurality of sheets aligned in the width direction by the pair of alignment plates;

a stacking portion disposed downstream of the placement portion in the first conveyance direction and on which the sheet conveyed in the first conveyance direction by the first conveyance portion is stacked;

a pair of discharge rotary members configured to discharge the sheet conveyed in the first conveyance direction by the first conveyance portion onto the stacking portion;

a moving portion configured to move a position of at least one of the pair of discharge rotary members to a nipping position and a separated position, the nipping position being a position where the pair of discharge rotary members are configured to nip the sheet, the separated position being a position where the pair of discharge rotary members are separated from each other; and a control portion, wherein the control portion is configured to perform a binding discharge process and a sorting discharge process, wherein in the binding discharge process, a first operation is repeatedly performed to align a plurality of sheets at a binding position, the binding process is performed by the processing portion on the plurality of sheets aligned at the binding position, and the plurality of sheets having undergone the binding process are discharged onto the stacking portion by the pair of discharge rotary members, wherein in the first operation, the sheet is conveyed in the first conveyance direction by the first conveyance portion, then the sheet conveyed by the first conveyance portion is conveyed in the second conveyance direction on the placement portion by the second conveyance portion to cause a downstream edge in the second conveyance direction of the sheet to abut against the abutment portion, and the sheet is aligned by the pair of alignment plates at the binding position, wherein in the sorting discharge process, a second operation is repeatedly performed to form an unbound first sheet bundle on the stacking portion, and a third operation is repeatedly performed to form on the stacking portion, wherein in the second operation, the sheet is conveyed in the first conveyance direction by the first conveyance portion such that a downstream end of the sheet in the first conveyance direction passes through a gap between the pair of discharge rotary members and an upstream end of the sheet in the first conveyance direction passes the first conveyance portion in a state in which the pair of discharge rotary members are at the separated position, then a shift operation of moving a position of the sheet in a predetermined shift direction is performed by moving one of the pair of alignment plates on one side in the width direction in the predetermined shift direction that is a direction toward another side in the width direction without conveying the sheet in the second conveyance direction by the second conveyance portion and in a state in which the sheet is moving in the first conveyance direction, and after the shift operation, the one alignment plate is retracted in the width direction from the sheet subjected to the shift operation and the pair of discharge rotary members are moved to the nipping position, and then the sheet is discharged to a shift position on the stacking portion by the pair of discharge rotary members, and wherein in the third operation, the sheet conveyed by the first conveyance portion is discharged by the pair of discharge rotary members to a position displaced upstream from the shift position on the stacking portion in the predetermined shift direction without conveying the sheet in the second conveyance direction by the second conveyance portion.

* * * * *